US006097903A

United States Patent [19]

Yahata et al.

[11] Patent Number: 6,097,903

[45] Date of Patent: Aug. 1, 2000

[54] TONER SUPPLYING DEVICE, TONER CONTAINER THEREFOR AND IMAGE FORMING APPARATUS USING SAME TONER SUPPLYING DEVICE AND TONER CONTAINER

[75] Inventors: Masasumi Yahata, Kamakura; Shunji Katoh, Sagamihara; Yuuji Kitajima, Kawasaki, all of Japan

[73] Assignee: Ricoh Company, Ltd., Tokyo, Japan

[21] Appl. No.: 09/136,050

[22] Filed: Aug. 18, 1998

[30] Foreign Application Priority Data

| | | | |
|---|---|---|---|
| Aug. 18, 1997 | [JP] | Japan | 9-236540 |
| Sep. 25, 1997 | [JP] | Japan | 9-278127 |
| Feb. 19, 1998 | [JP] | Japan | 10-035473 |

[51] Int. Cl.[7] ..... G03C 15/08

[52] U.S. Cl. ..... 399/27; 399/106; 399/262

[58] Field of Search ..... 399/27, 106, 258, 399/259, 262, 263; 222/DIG. 1; 141/363, 364, 383, 284

[56] References Cited

U.S. PATENT DOCUMENTS

| | | | |
|---|---|---|---|
| 3,915,208 | 10/1975 | Anderson | 141/363 |
| 4,060,105 | 11/1977 | Feldeisen et al. | 141/1 |
| 4,384,785 | 5/1983 | Katoh et al. . | |
| 5,329,340 | 7/1994 | Fukuchi et al. | 399/254 |
| 5,345,297 | 9/1994 | Katakabe et al. | 399/263 |
| 5,472,026 | 12/1995 | Herbst et al. | 141/383 |
| 5,493,382 | 2/1996 | Takagaki et al. . | |
| 5,500,719 | 3/1996 | Ichikawa et al. | 399/238 |
| 5,604,575 | 2/1997 | Takagaki et al. . | |
| 5,710,963 | 1/1998 | Dirx | 399/262 |
| 5,737,680 | 4/1998 | Takagaki et al. . | |

FOREIGN PATENT DOCUMENTS

| | | |
|---|---|---|
| 2-277083 | 11/1990 | Japan . |
| 3-118569 | 5/1991 | Japan . |
| 4-80779 | 3/1992 | Japan . |
| 7-043999 | 2/1995 | Japan . |
| 7-219329 | 8/1995 | Japan . |
| 8-030082 | 2/1996 | Japan . |
| 8-137227 | 5/1996 | Japan . |
| 9-106160 | 4/1997 | Japan . |

*Primary Examiner*—Joan Pendegrass

*Attorney, Agent, or Firm*—Oblon, Spivak, McClelland, Maier & Neustadt, P.C.

[57] ABSTRACT

A toner supplying device for supplying toner contained in each of a plurality of toner containers attached to the device to a developing device of an image forming apparatus. The device includes a toner container insertion part for inserting the plurality of toner containers into the toner supplying device so as to be attached to the toner supplying device, the insertion part having at least two insertion inlets, a toner container holder for detachably holding each of the plurality of toner containers inserted through the insertion inlets so as to position an opening of each of the plurality of toner containers at a predetermined position, an open/close device for opening and closing the opening of each of the plurality of toner containers held by the toner container holder, a toner deposit section for receiving and depositing therein toner discharged from each of the plurality of toner containers, a toner delivery device for delivering the toner deposited in the toner deposit section to the developing device of the image forming apparatus by mixing the toner with air, and a toner near-end determining device for determining that one of the plurality of toner containers, which is discharging the toner, is running out of toner. When the toner near-end determining device determines that the one of the plurality of toner containers, discharging the toner, is running out of toner, other toner container of the plurality of toner containers, not discharging the toner, starts to discharge toner therefrom.

92 Claims, 49 Drawing Sheets

FIG. (a2)

TONER SUPPLYING DEVICE, TONER CONTAINER THEREFOR AND IMAGE FORMING APPARATUS USING SAME TONER SUPPLYING DEVICE AND TONER CONTAINER

BACKGROUND OF THE INVENTION

1. Field of the Invention

This invention relates to a toner supplying device, a toner container therefor, and an image forming apparatus using the same toner supplying device and toner container.

2. Discussion of the Background

In image forming apparatuses using electrophotography, such as copying apparatuses, facsimile apparatuses and printers, a latent image of image information is formed on a surface of a drum or belt-like shaped image bearing member by first uniformly charging the surface of the image bearing member and then exposing the charged surface with light modulated with the image information. The latent image is then developed by toner, and the developed toner image is transferred onto a recording medium such as a sheet of paper directly or via an intermediate transfer member, thereby an image is formed on the sheet of paper. The image forming apparatuses of this type include a developing device for developing the latent image by toner, and generally include a toner supplying device for supplying toner to the developing device as the developing device consumes the toner as a result of developing images.

A toner container that contains toner therein is attached to the toner supplying device. Once the toner contained in the toner container attached to the toner supplying device is consumed by having been supplied to the developing device, the image forming apparatus generally stops the image forming operation and displays a message indicating that the toner container has run out of toner. The apparatus returns to an operable state once the toner container whose toner is used up is replaced with a new toner container containing toner therein and the toner is supplied to the developing device.

As related art, Japanese Patent Laid Open Publication 7-219329 describes a device in which a toner supplying device is placed apart from a developing device and connected with the developing device via a toner delivery device which delivers toner while mixing the toner with air. In the device, the capacity of a toner container for containing toner therein is made large so as to reduce the frequency of replacing the toner container and reduce the burden on a user who is unfamiliar with handling the toner container.

Japanese Patent Laid Open Publications 4-80779 and 8-137227 describes a toner supplying device including a toner container accommodating device in which a plurality of toner containers can be attached. Toner discharged from each of the plurality of toner containers is merged with each other and conveyed to the developing device. Each of the plurality of toner containers is individually attachable to and detachable from the toner supplying device and the size of the toner container is made such that the container is easy to be handled, such that the toner container can be replaced with a new toner container without stopping the operation of the apparatus.

Japanese Patent Laid Open Publication 8-137227 further describes that the toner container accommodating device accommodates two toner containers and when a sensor detects non-existence of toner in a toner conveying pipe to a developing device, an agitator of one of the two toner containers, which has not been operated, is started to be rotated to supply toner therefrom.

Japanese Patent Laid Open Publication 2-277083 describes a toner supplying device having a plurality of toner containers, which are disposed near a developing device. The toner container chosen to supply toner to the developing device is changed by rotating the toner supplying device.

Further, the present inventors have proposed a toner supplying device which includes a plurality of toner containers. The device is disposed in a position apart from a developing device and toner is conveyed to the developing device from the toner supplying device via a toner conveying device connecting the developing device and the toner supplying device.

In toner supplying devices including a plurality of toner containers as discussed above, a reserve toner container is not used until toner in a dispensing toner container is exhausted and the reserve toner container is repositioned so as to become the dispensing toner container. Therefore, it occurs that supplying of toner from the toner supplying device to the developing device is intermittent and the image forming operation is forced to be stopped when the reserve toner containers are being repositioned. Also, some toner remains inside the toner container without being discharged and supplied to the developing device and the remaining toner spills when the toner container is removed from the toner supplying device for replacement.

Further, attaching and detaching a toner container to and from a toner supplying device is not easy and the operability is poor. In particular, a related toner supplying device has a problem when removing a toner container from the toner supplying device in that a portion of the toner container which extends out of the toner supplying device is small and thus is difficult to be grasped, as described below.

FIG. 60 is a schematic drawing of a toner container attaching/detaching part of the related toner supplying device and FIG. 61 is a schematic drawing of a device for releasing the toner container from being held by a toner container holder. When detaching a toner container 101 from a toner supplying device 100, the toner container 101 is released from being held by a toner container holder 102 by pushing a release lever 104*a* of a release device 104, which is disposed at an circumferential part of a toner container insertion inlet 107 of the toner supplying device 100, in a direction indicated by an arrow J in FIG. 60. Then, the toner container 101 can be grasped at a bottom part 101*c* of the container 101 and taken out from the toner supplying device 100 through a notched part provided at a housing case 108.

When attaching a new toner container 101 to the toner supplying device 100, the toner container 101 is inserted into the toner container insertion inlet 107 from a head portion of the toner container 101 where an opening portion 101*a* is formed. When the toner container 101 reaches a predetermined position inside the housing case 108, a stopper 102*a* (which has a tang formed thereon) of the toner container holder 102 engages with an engaging protrusion 101*e* of the toner container 101, and thereby the toner container 101 is prevented from being removed from the toner supplying device 100. Further, an end part of the toner container 101 where the opening portion 101*a* for discharging the toner therethrough is formed is held at a predetermined position.

FIG. 62 is a schematic drawing illustrating a state where the toner container 101 (not shown) is removed from the inside of the toner container insertion inlet 107 by pushing the release lever 104*a* in a direction indicated by the arrow J to open the stopper 102*a* in a direction indicated by an arrow L. FIG. 63 is a schematic drawing illustrating that the toner container 101 is inserted into the toner container insertion inlet 107 from the side of the opening portion 101*a* in a direction indicated by the arrow J and the stopper 102*a* of the toner container holder 102 engages with the engaging protrusion 101*e* of the toner container 101, such that the toner container 101 is held at the predetermined position inside the housing case 108 in a state that prevents the toner container from being removed from the toner supplying device 100. A cap 101*g* is a device to open/close the opening portion 101 such that opening/closing the opening portion 101*a* with the cap 101*g* is accomplished by an operation of an open/close device 103 when the toner container 101 is held at the predetermined position inside the toner insertion inlet 107 as described above. In this state, because the head part of the toner container 101 pushes a slider 103*a* of the open/close device 103 in the direction J, a gap d1 is formed between an end part of the holder 102*b* of the toner container holder 102 and an end part of the slider 103*a*. By thus forming the gap d1 between the end part of the holder 102*b* and the end part of the slider 103*a*, it becomes possible to completely close the opening portion 101*a* of the toner container 101 with the cap 101*g*.

FIGS. 64–69 are sectional drawings illustrating an open/close operation of the opening portion 101*a* with the cap 101*g*. In FIG. 64, when a chuck 103*b* of the open/close device 103 is moved in a direction P by a motor (not shown), because a spring 103*c* is pushing the slider 103*a* in a direction K, only the chuck 103*b* moves in the direction P relative to the slider 103*a* to change the relative position between them, and due to an operation of a small-diameter portion 103*a*1, a tip end 103*b*1 of the chuck 103*b* is closed so as to grasp a protrusion 101*g*1 of the cap 101*g*. The spring 103*c* is a device to restrict the slider 103*a* to move in a direction opposite to the direction K and the slider 103*a* is a device to control opening/closing of the tip end 103*b*1 of the chuck 103*b*. In FIGS. 65 and 66, when the chuck 103*b* is moved in the direction P, the cap 101*g* can be detached from the opening portion 101*a* of the toner container 101. The slider 103*a* stops moving when an end of the slider 103*a* strikes a holder housing case 102*c*. The slider 103*a* may be stopped when a predetermined period of time, which is sufficiently long for detaching the cap 101*g* from the opening portion 101*a,* is elapsed, when a predetermined current is detected at a driving motor (not shown), or when the slider 103*a* is detected by a sensor (not shown) at a predetermined position. In a state that the cap 101*g* is detached from the opening portion 101*a,* as shown in FIGS. 67 and 68, when the chuck 103*b* is moved in a direction Q by a driving motor (not shown) until a gap d2 between the slider 103*a* and the chuck 103*b* disappears, due to friction between the opening portion 101*a* and the cap 101*g,* the tip end 103*b*1 of the chuck 103*b* opens. In FIG. 69, when the chuck 103*b* is further moved in the direction Q, the opening portion 101*a* of the toner container 101 can be completely closed by the cap 101*g*. For completely closing the opening portion 101*a* by the cap 101*g,* the gap d1 is formed between the right side end of the holder 102*b* and an engaging part 103A (FIG. 68) of the chuck 103*b* such that the engaging part 103A does not interfere with the right side end of the holder 102*b*. In this state, when the release lever 104*a* of the release device 104 is pushed in the direction J, because a tip end of the release lever 104*a* contacts a tapered surface of the stopper 102*a*, the stopper 102*a* is disengaged from the engaging protrusion 101*e* of the toner container 101, and thereby the toner container 101 becomes detachable from the toner supplying device 100. The toner container 101 is moved by a pressing force of the spring 103*c* in a direction R, such that the bottom part of the toner container 101 comes out of the toner container insertion inlet 107 by the distance d1.

For enhancing easiness of taking out the toner container 101 from the toner supplying device 100 by grasping the bottom part of the toner container 101, it is desirable to increase the distance that the bottom part of the toner container 101 comes out of the toner supplying device 100. However, if the gap d1 is made wider, the positional relation between the slider 103*a* and the chuck 103*b* changes and causes that the chuck 103*b* to move left before the slider 103*a* moves. Therefore, when the chuck 103*b* is moved to the extent to enable the toner container 101 can be detached from the toner supplying device 100 as shown in FIG. 69, the tip end 103*b*1 of the chuck 103*b* is closed to grasp the cap 101 g, causing a problem that the cap 101*g* is detached from the toner container 101 being in a state to be removed from the toner supplying device 100. When the toner container 101 is removed from the toner supplying device 100, the toner remaining inside the toner container 101 spills out.

Accordingly, for avoiding the above problem, as presently recognized, the distance d1 needs to be restricted to within a predetermined limitation so as to not cause the above problem, and as a result, the distance the toner container 101 comes out of the housing case 108 becomes short. This makes difficult to grasp the toner container 101 for removing the container 101 from the toner supplying device 100. Further, because the distance the toner container 101 comes out of the housing case 108 is short, it is not easy to recognize that the toner container 101 is in a released state. Therefore, when the toner container 101 is not released from the held state by pushing the release lever 104*a* and if the release lever 104 is let go, the stopper 102*a* engages with the engaging protrusion 101*e* again, and than the toner container 101 can not be removed from the toner supplying device 100. Further, handling of the toner container 101 for replacement is not so easy because the engaging protrusion 101*e* of the toner container 101 is easily hooked to other members of the toner supplying device 100 when removing the toner container 101 from the toner supplying device 100.

Furthermore, generally, handling of a toner container for a toner supplying device is poor not only in attaching to and detaching from the toner supplying device but also in transportation. Sometimes, the user drops the toner container or the toner container tumbles by itself. When the toner container is large, these problems becomes significant. Also, when a toner container has been stored in a standing condition for some time, because the toner contained inside the container is put to one side, it occurs that the toner is not conveyed out of the container smoothly, causing insufficient amount of toner supplied to a developing device and thereby causing a decrease of an image quality.

SUMMARY OF THE INVENTION

The present invention has been made in view of the above-discussed problems and an object of the invention is to address and resolve these and other problems. A non-exhaustive description of the features and attributes of the invention is presented in this section, with a more complete description provided by the figures and description of the preferred embodiment section of this document.

A feature of the present invention is a novel toner supplying device for supplying toner to a developing device of an image forming apparatus, in which a reserve toner container attached to the toner supplying device starts to discharge toner before a primary toner container that has been discharging toner runs out of toner, such that supplying of toner to the developing device is not intermittent and is not forced to be stopped. The present invention further provides a toner supplying device that prevents residual toner that remains inside a toner container from spilling when the toner container is removed from the toner supplying device for replacement.

The present invention further provides a toner supplying device in which it is easily recognized that a toner container is detached from a toner supplying device and is in a released state for replacement, the released toner container can be easily grasped by an operator's hand to be removed from the toner supplying device, and a cap of the toner container used for closing an opening portion of the toner container is prevented from being removed when the toner container is removed from the toner supplying device.

Furthermore, the present invention provides a novel toner container that can be easily and safely attached to and detached from a toner supplying device, prevented from being stored in a standing condition, and further, easily handled in transportation. By preventing the toner container from being stored in the standing condition, it is avoided that the toner contained inside the container is put to one side and that when attached to a toner supplying device the toner is not discharged smoothly from the container causing insufficient toner to be supplied to a developing device.

The above-described, as well as many other, attributes and features are offered by a novel toner supplying device for supplying toner, contained in each of a plurality of toner containers attached to the device, to a developing device of an image forming apparatus, according to the present invention. The toner supplying device includes a toner container insertion part for inserting the plurality of toner containers into the toner supplying device so as to be attached to the toner supplying device, and the insertion part has at least two toner container insertion inlets. A toner container holder detachably holds each of the plurality of toner containers inserted through the insertion inlets so as to position an opening of each of the plurality of toner containers at a predetermined position, and an open/close device opens and closes the opening of each of the plurality of toner containers held by the toner container holder. A toner deposit section receives and deposits therein toner discharged from each of the plurality of toner containers held by the toner container holder, and a toner delivery device delivers the toner deposited in the toner deposit section to the developing device of the image forming apparatus by mixing the toner with air. The toner supplying device of the present invention includes a toner near-end determining device for determining that one of the plurality of toner containers held by the toner container holder, which is discharging the toner, is running low on toner, and, when the toner near-end determining device determines that the one of the plurality of toner containers, discharging the toner, is running out of toner, another toner container of the plurality of toner containers, not discharging the toner, starts to discharge the toner.

According to an aspect of the present invention, the opening of the one of the plurality of toner containers discharging the toner is closed by a cap when the toner near-end detect device determines that the one of the plurality of toner containers discharging the toner is running out of toner. Alternatively, the opening of the one of the plurality of toner containers discharging the toner may be closed by the cap a predetermined period of time after the toner near-end detect device determines that the one of the plurality of toner containers discharging the toner is running out of toner. The above predetermined time is so made to be sufficiently long to discharge the toner remaining in the one of the plurality of toner containers discharging the toner.

According to another aspect of the present invention, the toner near-end determining device may include a sensor to detect a presence (i.e., existence) of the toner and the toner near-end determining device may determine that the one of the plurality of toner containers discharging the toner is running out of toner when the sensor does not detect the presence of the toner for a predetermined period of time. The sensor may be configured so as to detect the presence of the toner above a predetermined level in the toner deposit section of the toner supplying device or so as to detect the presence of the toner above a predetermined level in a toner supplying device receiving the toner supplied from the toner supplying device and supplying the received toner to the developing device of the image forming apparatus.

The toner near-end determining device may alternatively include a weight sensor to detect a weight of each of the plurality of toner containers held by the toner container holder and the toner near-end determining device may determine that one of the plurality of toner containers discharging the toner is running out of toner when a weight detected by the weight sensor for the one of the plurality of toner containers is lighter than a predetermined level.

The toner supplying device according to the present invention may further include a housing case for housing at least the plurality of toner containers and the toner container holder, a release device for releasing each of the plurality of toner containers from a state being held by the toner container holder, and a toner container discharging device for discharging each of the plurality of toner containers from the housing case. According to present invention, an end part of each of the plurality of toner containers comes out of the housing case to a position where each of the plurality of toner containers can be grasped when each of the plurality of toner containers is released from the state being held by the toner container holder by the release device and discharged from the housing case by the toner container discharging device.

Furthermore, according to the present invention, a novel toner container for a toner supplying device for supplying toner to a developing device of an image forming apparatus is provided, which is attachable to and detachable from the toner supplying device, and includes a cylindrical toner container body for storing toner therein, an opening capable of being closed and is formed axially at one end of the toner container for discharging toner, another end part for closing the other side of the opening, and a handhold provided on the outside surface of the other end part.

The handhold may be a recessed part formed on the outside surface of the other end part and the recessed part may have a rib inside thereof. The handhold may alternatively be a projected part, such as a rib, or a knob, formed on the outside surface of the other end part. In addition, each of the above-mentioned handholds may have such a shape that it can prevent the toner container body from being set longitudinally.

A toner container for a toner supplying device for supplying toner to a developing device of an image forming apparatus, according to the present invention, includes a handhold provided on the outer surface of the toner container body.

The handhold may be a recessed part formed on the outer surface of the toner container body and the recessed part may have a rib inside thereof. The handhold may alternatively be projected part, such as a knob. When the handhold is a projected part, the toner supplying device may include a detection device for detecting the number of rotations of the handhold when the toner container is rotated so as to obtain information on the rotation of the toner container body from the detection result. The handhold may alternatively be a small diameter part provided around the outer surface of the toner container body and the small diameter part may be coupled to a large diameter part of the outer surface of the toner container body through a tapered part. The toner container body of the above toner containers may further include a handhold or one or more rolling prevention parts around the outer surface so as to prevent the toner container body from rolling.

Other objects, features, and advantages of the present invention will become apparent from the following detailed description when read in conjunction with the accompanying drawings. Furthermore, while the drawings and descriptions illustrate specific structures, the present specification clearly explains the function, concepts and attributes of the present invention in sufficient detail so as to make clear all possible equivalent structures and techniques obtaining the desired result as discussed herein.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 7 shows a state where the toner container is set in a holder portion of a toner container holder of the toner supplying device and the opening portion is closed with the cap, FIG. 8 shows a state where the cap is taken off to open the opening portion, FIG. 9 shows an example of a moving device for moving a chuck of the open/close mechanism shown in FIGS. 7 and 8, and FIG. 10 shows an example of a stopper for preventing the toner container from being moved when closing the opening portion of the container with the cap;

DESCRIPTION OF THE PREFERRED EMBODIMENTS

Figure 1:
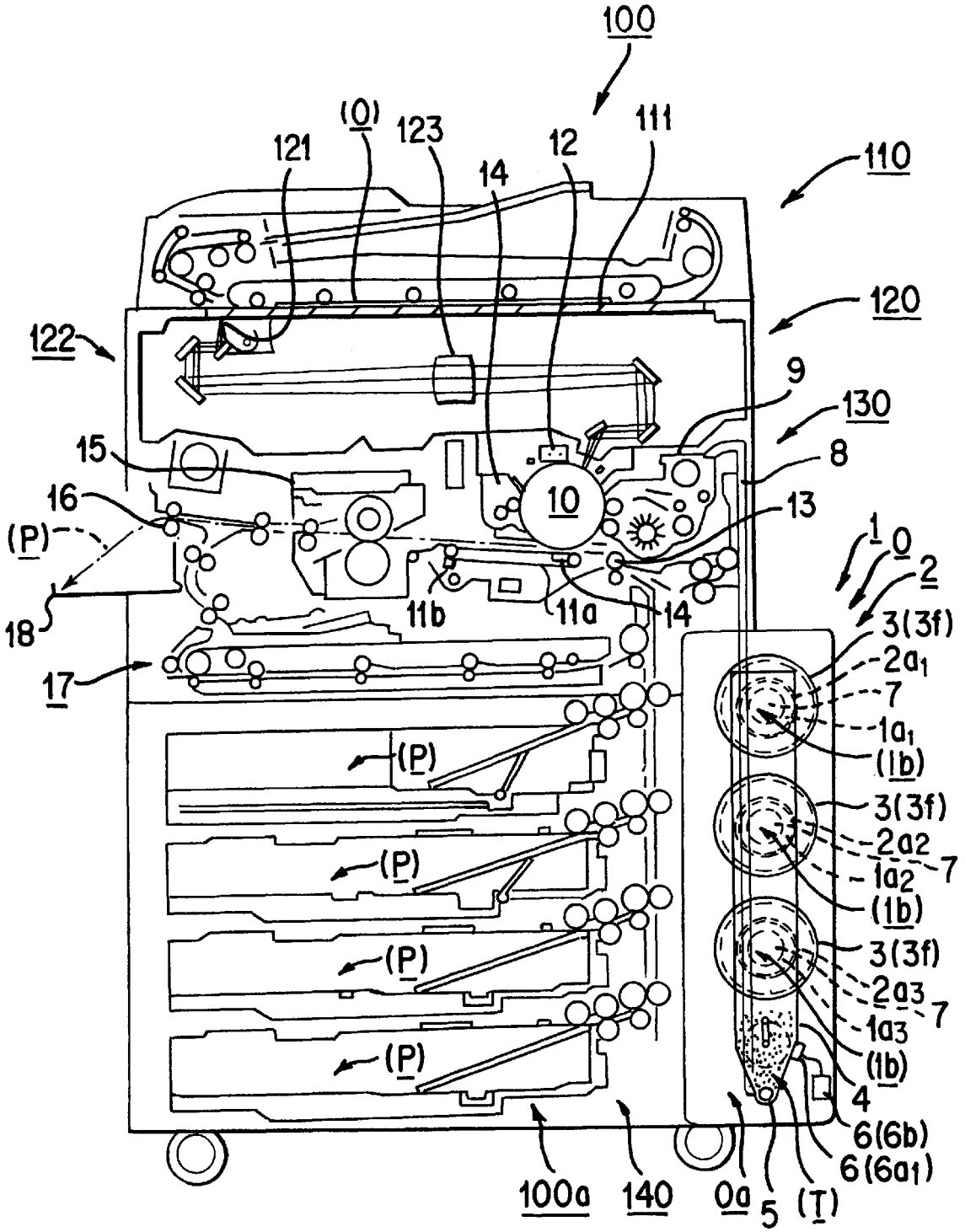
FIG. 1 is a schematic drawing illustrating an overall view of an exemplary configuration of an image forming apparatus including a toner bank as a toner supplying device according to the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, there is illustrated an overall view of a configuration of a copying apparatus for showing an exemplary embodiment of the present invention.

In FIG. 1, there is shown an example of an image forming apparatus 200, which is a copying machine. The copying machine 200 includes an automatic document feeder (ADF) 110, an exposing section 120 for forming an image in a conventional known electrophotographic system, an image forming section 130, and a paper feeding section 140. The exposing section 120 has an exposure optical system with a light source 121 for putting light on a document (O) placed on a contact glass 111 by the ADF 110 or with a manual insertion, a series of mirrors 122 and a lens 123 for using a reflected light image from the document to expose a surface of a photosensitive drum 10, which is a latent image carrier of the image forming section 130.

The image forming section 130 has the photosensitive drum 10 as the image carrier, a charging device 12, a developing device 9, a resist roller 13, a transfer device 11, a photosensitive body cleaning device 14, a fixing device 15, a paper output roller 16, a transfer paper reversing/delivering section 17 for duplex copying, and a paper output tray 18, arranged around the photosensitive drum 10. In the paper feed section 140, a plurality of paper feed cassettes are set containing transfer paper (P) in various sizes. Although the above exposing section 120 is an example of an analog-type exposure optical system, it can serve as a laser printer if it is configured in a system in which an image is optically recorded on the photosensitive drum 10 based on an image signal by using a laser scan optical system in which a laser light source and a deflector are used as an exposing section, and it can serve as a digital copying machine or a facsimile if a document reader is arranged between the ADF 110 and the exposing section 120.

In FIG. 1, when an image forming operation is started, the photosensitive drum 10 is charged by the charging device 12 and then exposed for a document image from the exposing section 120 so that a static latent image is formed on it. The static latent image is developed by developer (two-component developer or one-component developer) in the developing device 9, and a toner image is formed on the photosensitive drum 10. A toner image formed on the photosensitive drum 10 is transferred to a transfer paper (P) fed to a transfer section (a nip portion between the photosensitive drum 10 and the transfer belt 11*a* of the transfer device 11) through the resist roller 13 from the paper feed section 140, the transfer paper (P) to which the toner image is transferred is delivered to the fixing device 15 by way of the transfer belt 11*a* of the transfer device 11, and the toner image is fixed to the transfer paper (P) by the fixing device 15. The transfer paper (P) after fixing is output to the paper output tray 18 via the paper output roller 16. The photosensitive drum 10, after transferring the toner image, is cleaned by the photosensitive body cleaning device 14 to salvage or remove remaining toner and contaminant such as paper lint. The transfer belt 11*a* after transfer paper delivery is also cleaned by a cleaning device 11*b* in the transfer device 11 to salvage or remove remaining toner and paper lint.

In FIG. 1, as a developing device 9, there is shown an example in which a magnetic brush developing method using a two-component developer including toner (T) and a carrier is applied.

Apart from the developing position of the developing device 9, a toner bank 0 as a toner supplying device is provided. In this embodiment, the toner bank 0, including a plurality of toner containers 1*a*1, 1*a*2, 1*a*3, is positioned at a lower right side of the image forming apparatus 200. The toner bank 0 may alternatively be positioned at a lower left side of the image forming apparatus 200 or in another appropriate place.

Each of the toner containers 1*a*1, 1*a*2, 1*a*3 has a cylindrical-like shape and contains therein toner (T) for developing a latent image in electrophotography. Each of the toner containers 1*a*1, 1*a*2, 1*a*3 is detachably mounted on toner container insertion inlets 2*a*1, 2*a*2, 2*a*3 of a toner container insertion part 2. Each of the toner containers 1*a*1, 1*a*2, 1*a*3 is held by a toner container holder 3.

When the power of the main motor is turned on and one of the plurality of toner containers 1, for example, the toner container 1*a*1, is started to be rotated by a rotation driving device 3*f* while being supported by the toner container holder 3, the toner (T) contained in the toner container 1*a*1 is discharged from the toner container 1*a*1 through an opening portion 1*b* provided at an axial end of the toner container 1*a*1 and is deposited in a toner deposit section 4. The toner (T) deposited in the toner deposit section 4 is conveyed to the developing device 9 by way of a toner delivery device 5.

The toner supply from the toner container 1 to the toner deposit section 4 in this embodiment is controlled by a sensor 6*a*1 of a toner near-end determining device 6 arranged at a lower part of the toner deposit section 4 and a controller 6*b* arranged at a bottom part of the toner bank 0. If the sensor 6*a*1 does not detect the toner, i.e., the toner level in the toner deposit section 4 is below a predetermined level, the toner container 1*a*1 is rotated so as to discharge the toner through the opening portion 1*b* to supply the toner to the toner deposit section 4. When a toner amount in the toner deposit section 4 reaches the predetermined level or greater, the toner is detected by the sensor 6*a*1 of the toner near-end determining device 6 and the rotation of the toner container 1*a*1 is stopped to stop the toner supply. With these controls, the toner deposit section 4 always contains a certain amount of toner and the toner is supplied to the developing device 9 reliably, so that a stable developing process is assured.

Additionally, if the toner near-end determining device 6 does not detect the toner a predetermined number of times (if a periodic or regular interval detection process is performed) or for a predetermined period of time, it is determined that the toner contained in the toner container 1*a*1 is almost empty. Then, stoppage (i.e., by a stopper or cap) of another toner container 1*a*2 or 1*a*3 is released and the toner contained in the toner container 1*a*2 or 1*a*3 starts to be discharged to be supplied to the toner deposit section 4. The opening portion 1*b* of the toner container 1*a*1 is closed by the cap 7 when a predetermined period of time, which is sufficiently long to discharge the toner remaining in the container 1*a*1 completely therefrom, is elapsed after the toner near-end determining device 6 has determined that the toner in the container 1*a*1 is almost empty as explained above. After the opening portion 1*b* of the toner container 1*a*1 is closed by the cap 7, a message informing that the toner container 1*a*1 has exhausted its contents of toner and needs to be replaced is displayed at a display panel (not shown).

Accordingly, immediately before toner in a toner container from which the toner has been supplied is used up, another toner container starts to discharge toner therefrom, such that supplying of toner to the toner deposit section 4 will not be intermittent. Further, it will not occur that some residual toner remains in a toner container and that the residual toner spills from the toner container when the toner container is removed from the toner bank 0 when replaced.

The toner bank 0 is connected to the developing device 9 via a flexible toner conveying pipe as a toner conveying path 8 through which toner is conveyed while being mixed with air. Toner stored in the toner bank 0 is supplied to the developing device 9 through the toner conveying pipe 8 by way of a powder pump unit as a toner delivery device 5. As shown in FIG. 1, in this embodiment, the powder pump unit 5 is arranged in a lower portion of the toner bank 0.

Figure 2:
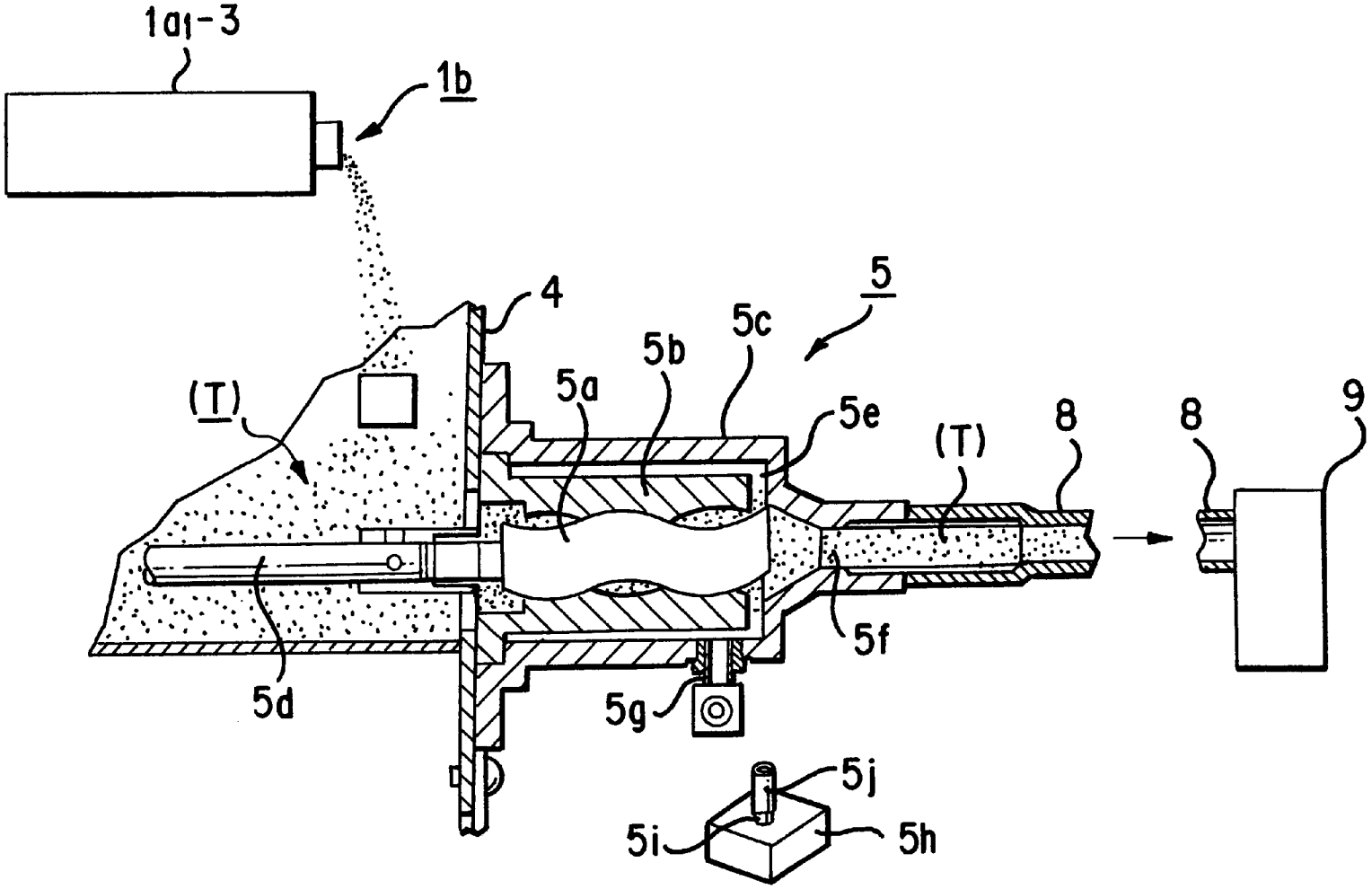
FIG. 2 is a sectional view showing a main part of a powder pump unit as a toner delivery device for delivering toner from the toner bank to a developing device of the image forming apparatus of FIG. 1.

FIG. 2 is a main portion sectional view showing a configuration of the powder pump unit as the toner delivery device 5 for transferring toner from the toner bank 0 to the developing device 9. For this powder pump unit 5, a screw pump which is conventionally known and commonly called a Moineau-pump is used. As shown in FIG. 2, the powder pump unit 5 includes a rotor 5*a*, a stator 5*b*, and a holder 5*c*.

The rotor 5*a* is engaged with a driving source such as a driving motor (not shown) via a driving shaft 5*d* (or a horizontal delivery screw with a screw attached to the driving shaft on its outer periphery in some cases) and the rotor 5*a* is rotatively driven by a rotation of the driving source. The stator 5*b* is made of an elastic body such as a rubber material and surrounds the rotor 5*a*. The holder 5*c* holds the stator 5*b*.

The toner delivery device 5 takes in toner at the bottom part of the toner bank 0 from the side of the driving shaft 5*d* to deliver the toner toward a toner passageway (a discharging section) 5*f* with a rotation of the rotor 5*a*. In addition, there is about a 1-mm gap 5*e* between a side of the stator 5*b* and an inner side of the holder 5*c* for communication with the toner passageway 5*f*. An air supply port 5*g* is provided so that an air blows from the gap 5*e* to the toner passageway 5*f*. The air supply port 5*g* communicates with the toner passageway 5*f*, and further communicates with an air exhaust outlet 5*i* of an air pump as an air supplying device 5*h* via an air supply tube 5*j*. When the air pump 5*h* starts to run, air blows on the toner (T) in the toner passageway 5*f* via the air supply tube 5*j* and the air supply port 5*i* by approximately 0.5 to 1 liter/minute of a blow amount, whereby fluidization is accelerated for toner that is discharged from the toner passageway 5*f* of the powder pump unit 5 and the toner is discharged to the toner conveying pipe 8 while being mixed with air. Therefore, toner delivery with the powder pump 5 becomes more reliable.

Figure 3:
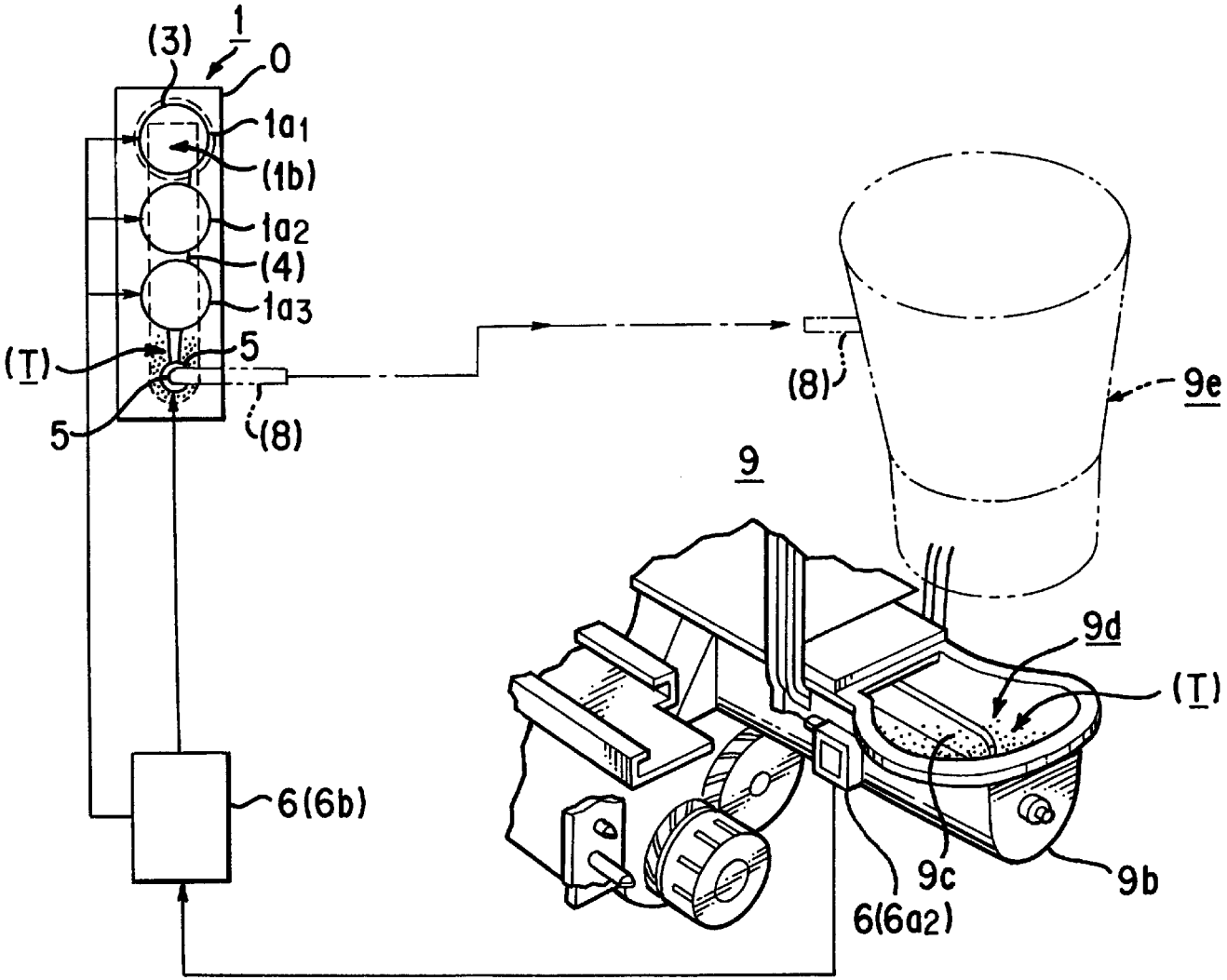
FIG. 3 is a schematic drawing illustrating a main part of the toner supplying device shown in FIG. 1.

FIG. 3 is a schematic drawing illustrating the toner bank 0, a toner supplying section of the developing device 9 and the toner conveying pipe 8 connecting them. The toner which has passed via the powder pump unit 5 is transmitted to a toner supplying section 9*b* of the developing device 9 through the toner conveying pipe 8. For the toner conveying pipe 8, it is advantageous to use a material that is flexible and has excellent (i.e., low) frictional resistance to toner, such as, for example, nylon, Teflon, etc. In the image forming apparatus in this embodiment, the connection between the developing device 9 and the toner bank 0 is flexible, whereby a positional restriction on each arrangement is dissolved and therefore it is possible to utilize the layout effectively. Further, it becomes possible to achieve a large-volume toner bank 0.

The toner supply from the toner bank 0 to the developing device 9 in this embodiment is performed by a sensor 6*a*2 arranged in the developing device 9 and the controller 6*b*.

As described earlier, when the power of the main motor is turned on and one of the plurality of toner containers 1, for example, the toner container 1*a*1, is started to be rotated by the rotation driving device 3*f* while being supported by the toner container holder 3, toner (T) contained in the toner container 1*a*1 is discharged from the toner container 1*a*1 through the opening portion 1*b* provided at an axial end of the toner container 1*a*1 and is deposited in the toner deposit section 4. The toner (T) deposited in the toner deposit section 4 is conveyed to the toner supplying section 9*b* of the developing device 9 by way of the toner delivery device 5.

If the sensor 6*a*2 does not detect the toner, that is, when the height of the accumulated toner in the toner supplying section 9*b* is lower than a predetermined level, the above powder pump unit 5 is driven to supply toner from the toner bank 0 to the toner supplying section 9*b* of the developing device 9. When the height of the accumulated toner in the toner supplying section 9*b* reaches the predetermined level, the toner is detected by the sensor 6*a*2 of the toner near-end determining device 6 and the supplying of toner to the toner supplying section 9*b* from the toner bank 0 is stopped. With these controls, the toner supplying section 6*b* always contains a certain amount of toner, so that a stable developing process is assured. Additionally, if the sensor 6*a*2 dose not detect the toner a predetermined number of times (i.e., at periodic or predetermined intervals) or for a predetermined period of time, it is determined that toner contained in the toner container 1*a*1 is almost exhausted. Then, toner contained in another toner container 1*a*2 or 1*a*3 starts to be discharged to the toner supplying section 9*b* of the developing device 9.

In the toner supplying section 9*b* of the developing device 9, as shown in FIG. 3, a toner supplement opening 9*d* is formed in the side of an axial end of a stirring member 9*c* arranged in the toner supplying section 9*b*, and in this toner supplement opening 9*d*, a toner salvaging device 9*e* described next is removably attached.

Figure 4:
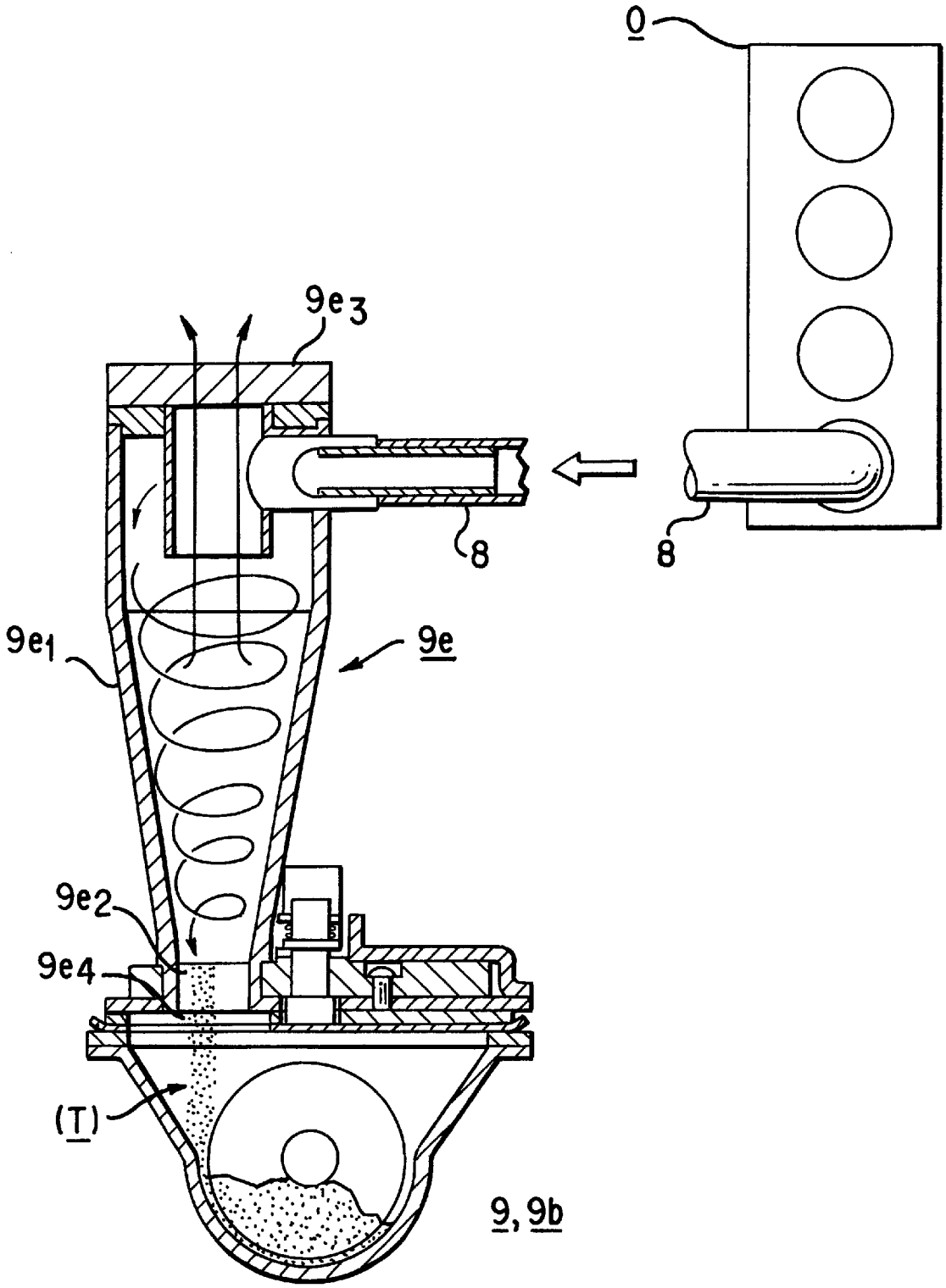
FIG. 4 is a schematic drawing illustrating a toner salvaging device attached to a toner supplying section of the developing device of the image forming apparatus shown in FIG. 1.

FIG. 4 is a schematic drawing illustrating the toner salvaging device 9*e* attached to the toner supplying section 9*b* of the developing device 9. The toner salvaging device 9*e* has a unit structure that is configured separately from the developing device 9. The toner salvaging device 9*e* is used to salvage toner that has been delivered while being mixed with air through the toner conveying pipe 8 from the toner bank 0 by separating the toner (T) from the air so as to supply the toner in preparation for decreased supplement toner in the toner supplying section 9*b* of the developing device 9.

In FIG. 4, the toner salvaging device 9*e* has a funnel-shaped toner separating section 9*e*1 whose longer direction is vertical. The toner separating section 9*e*1 includes a hopper that separates air from toner transmitted with being pressed by an air from the toner bank 0 and drops the toner only by gravity so as to put it into the toner supplying section 9*b* of the developing device 9. Therefore, in the upper part of the toner separating section 9*e*1, an end of the toner conveying pipe 8 through which the toner is delivered from the toner bank 0 is connected, while an opening 9*e*2 which can be connected to the toner supplying section 9*b* of the developing device 9 is formed in the lower part. With this configuration, a mixture of air and toner transmitted from the toner conveying pipe 8 falls spiraling, when striking an inner wall of the toner separating section 9*e*1, due to the shape of the toner separating section 9*e*1 and the discharging position of the toner conveying pipe 8, and the air having a lower specific gravity rises while only the toner having a higher specific gravity drops, whereby the air is separated from the toner. On the top surface of the toner separating section 9*e*1, there is provided a filter 9*e*3 for discharging only air, and on the bottom surface, there is provided an opening/closing member 9*e*4 for opening or closing the opening 9*e*2.

Figure 5:
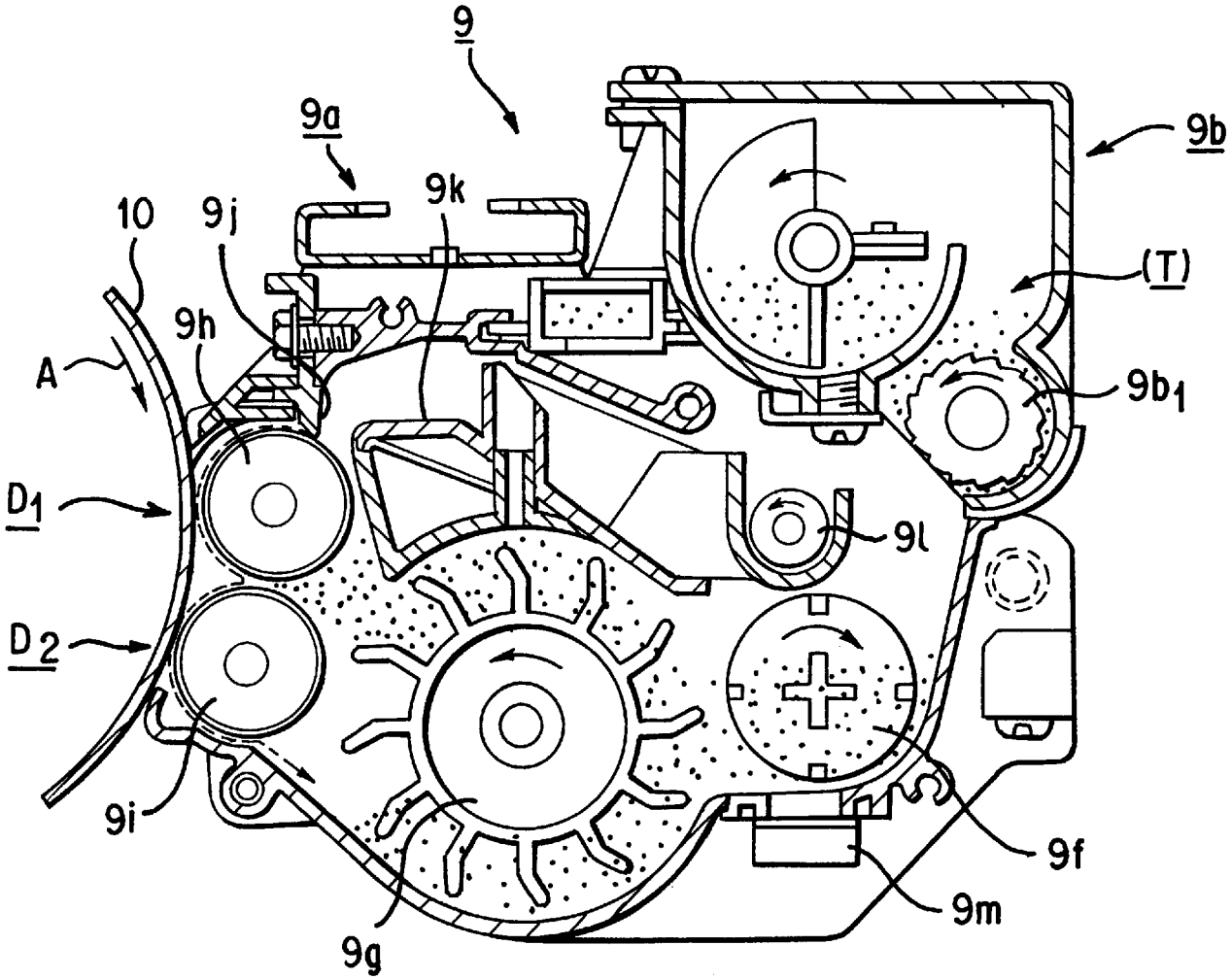
FIG. 5 is a sectional view illustrating an example of a configuration of the developing device of the image forming apparatus shown in FIG. 1.

Next, the developing device 9 will be described below. FIG. 5 is a sectional view illustrating an example of a configuration of the developing device 9. In FIG. 5, the developing device 9 includes a developing container 9*a* and the toner supplying section 9*b*. The developing container 9*a* is arranged near the photosensitive drum 10, which is a latent image carrier movable in a direction indicated by an arrow A in the drawing and the toner supplying section 9*b* is mounted on the developing container 9*a*. In the developing container 9*a*, a stirring roller 9*f* and a paddle wheel 9*g* are arranged for development, so as to scoop up a two-component developer having magnetic or non-magnetic toner and magnetic carrier subjected to frictional electrification in opposite polarities by being stirred to be mixed by the stirring roller 9*f* by using the paddle wheel 9*g*. In addition, the toner supplying section 9*b* stirs the toner (T) with a rotation of a toner supplying roller 9*b*1 and transmits it toward the stirring roller 9*f* if a density of the toner supplied to the photosensitive drum 10 is lowered.

In a position where the developer is scooped up by the paddle wheel 9*g*, there is arranged a plurality of (two in an example in the drawing) developing rollers 9*h* and 9*i* near the photosensitive drum 10. These two developing rollers 9*h* and 9*i* are arranged in the upstream side and the downstream side along a moving direction of the photosensitive drum 10. The roller in the upstream side is considered to be a first developing roller 9*h* and the roller in the downstream side is to be a second developing roller 9*i*. These first and second developing rollers 9*h* and 9*i* include a developing sleeve that is rotatable in a counterclockwise direction in the drawing by a driving section (not shown) and a magnetic roller fixed in the developing sleeve as the main portion. This developing sleeve is made of non-magnetic body such as aluminum or stainless steel. The magnetic roller includes a plastic magnet molded by mixing a ferrite magnet or a rubber magnet, and further nylon powder and ferrite powder, having a configuration in which a plurality of magnetic poles are arranged along a circumferential direction.

In the developing container 9*a*, the developer is scooped up by a centrifugal force generated at a rotation of the paddle wheel 9*g* and then expelled toward the first developing roller 9*h*. A part of the expelled developer is supplied directly to the first developing roller 9*h* and carried on a surface of the first developing roller 9*h*. Another part of the remaining developer to be expelled rebounds from the second developing roller 9*i* and then is carried on the surface of the first developing roller 9*h* by way of a magnetic force in the side of the first developing roller 9*h*. To supply the developer to the first developing roller 9*h* also from the side of the second developing roller 9*i*, it is desired to increase a relative rotation speed of the paddle wheel 9*g* in order to increase the amount of developer rebounding from the second developing roller 9*i* so as to increase the centrifugal force in advance.

The developer carried on the surface of the first developing roller 9*h* moves on the roller surface with a rotation of the developing sleeve, and after the layer thickness is restricted by a doctor blade 9*j*, it reaches a first developing area D1 in which the first developing roller 9*h* is opposite to the photosensitive drum 10, so that a latent image on the photosensitive drum 10 is made visible with toner. After that, when the developer, which has passed the first developing area D1, moves to a position where the magnetic force in the side of the first developing roller 9*h* has a lower effect, it is transmitted toward a second developing area D2 between the second developing roller 9*i* and the photosensitive drum 10 as indicated by a dashed line in the drawing with a rotation in the side of the second developing roller 9*i* and a magnetic force from the magnetic roller. Then, the developer drops to the bottom of the developing container 9*a* in a position where the second developing roller 9*i* has no effect and it is stirred again by the paddle wheel 9*g*.

On the other hand, developer scraped off by the first developing roller 9*h* due to restriction of the layer thickness with the above doctor blade 9*j* is guided by a separator 9*k* toward a delivery screw 9*l* located at the other end of an extension of the separator 9*k* and is then dropped on the stirring roller 9*f* by the delivery screw 91. Therefore, at the other end of the extension of the separator 9*k*, there is a slit for dropping the developer, being formed in a position opposite to the stirring roller 9*f*.

The magnetic rollers arranged in the first and second developing rollers 9*h* and 9*i* have an arrangement of magnetic poles which can be used to form a repulsion magnetic field generated by the identical poles between the nearest portions of the first developing roller 9*h* and the second developing roller 9*i*, so that the transfer direction of the developer is forcibly set to a direction in which the developer starts for the developing roller 9*i*. With this arrangement, the developer is transferred to the second developing roller 9*i* by way of the magnetic pole in the side of the second developing roller 9*i*.

Near the stirring roller 9*f* in the developing container 9*a*, there is arranged a toner density sensor as a toner density detecting device 9*m* for detecting a mixing ratio of toner and carrier. This toner density sensor 9*m* employs for example a method in which a toner density is detected based on a content of the toner in the developer by using changes of inductance on a coil arranged in the developer.

Figure 6:
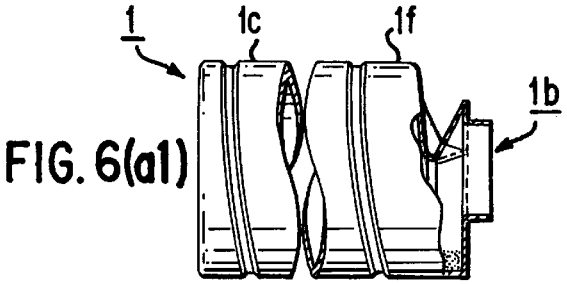
FIGS. 6$a_1$–6$d_2$ are drawings for illustrating how toner is discharged from a toner container when attached to the toner supplying device and operated, where sub-diagrams (a1), (b1), (c1) and (d1) being elevational views of the toner container and sub-diagrams (a2), (b2), (c2) and (d2) being corresponding right-side views of the toner container.
Figure 6:
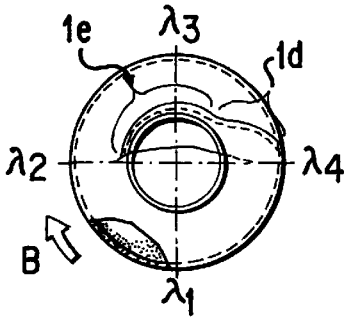
Figure 6:
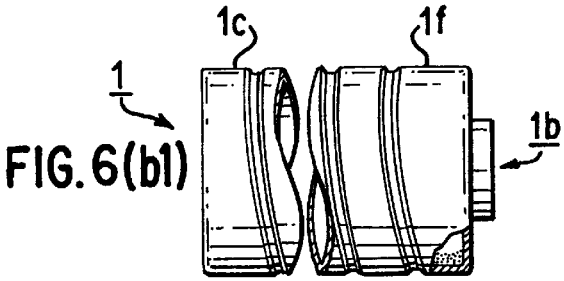
Figure 6:
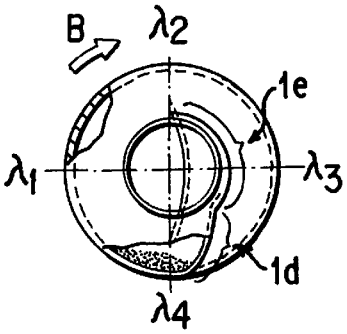
Figure 6:
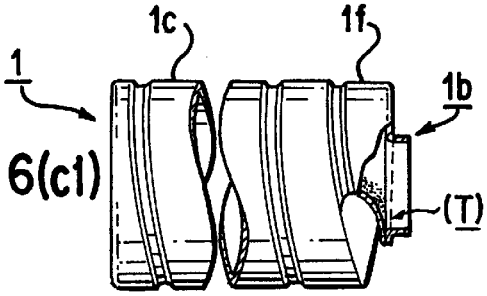
Figure 6:
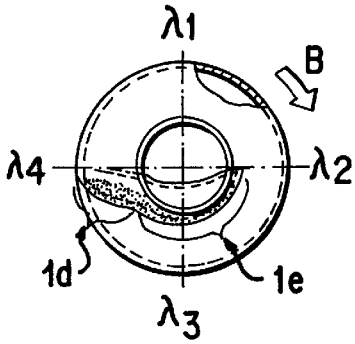
Figure 6:
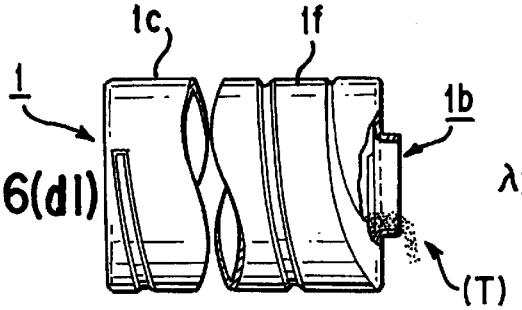
Figure 6:
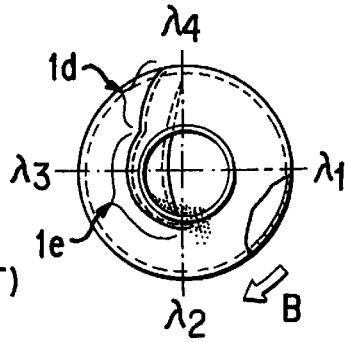

FIG. 6 illustrates how toner is discharged from the toner container 1. Sub-diagrams (a1), (b1), (c1) and (d1) are elevational views of the toner container 1 and sub-diagrams (a2), (b2), (c2) and (d2) are corresponding right-side views of the toner container 1. The sub-diagrams (b1)(b2) show views rotated from the sub-diagram (a1)(a2) by 90 degrees, the sub-diagrams (c)(c2) show views rotated from the sub-diagrams (b1)(b2) by 90 degrees, and the sub-diagrams (d1)(d2) show views rotated from the sub-diagrams (c1)(c2) by 90 degrees, respectively.

As shown, the toner container 1 is formed with an opening portion 1*b* for discharging toner therethrough at an end of a cylindrical container body 1*c* so as to have a smaller diameter than a diameter of the cylindrical body 1*c*. Further, with a part of the inner surface of a shoulder portion of an end surface on which the opening portion 1*b* of the toner container 1 is formed being pushed out from the inner surface of the shoulder up to an edge of the opening portion 1*b*, a projected portion 1*d* for raising toner is formed.

Specifically, the sub-diagrams (a2), (b2), (c2) and (d2) show how toner is guided by the projected portion 1*d* of the toner container 1 and an opening projected portion 1*e*. An arrow B in each sub-diagram indicates a direction in which the toner container 1 rotates. In the sub-diagrams (a1) and (a2), each part of the maximum diameter in the shoulder is located vertically downward and toner is guided to the lower part of the circumferential wall in the maximum-diameter part of a head portion of the toner container 1 by a guiding groove 1*f*. In the state shown in the sub-diagrams (b1) and (b2) after a rotation by 90 degrees from the above state in a direction indicated by the arrow B, a borderline area between the maximum-diameter part of the shoulder portion and the above projected portion 1*d* are located vertically downward and a part of the toner guided by the above guiding groove 1*f* is put on the projected portion 1*d*. During a further rotation by 90 degrees from this state to the state shown in the sub-diagrams (c1) and (c2) in a direction indicated by the arrow B, the projected portion 1*d* raises the toner up to an edge of the opening portion 1*b* as if it were a spoon. Before or after the state shown in the sub-diagrams (d1) and (d2) after a further rotation by 90 degrees in a direction indicated by the arrow B, the above toner on the projected portion 1*d* is partially transferred to the opening projected portion 1*e* and then discharged from the opening portion 1*b* due to an incline of the opening projected portion 1*e*. In this point, the projected portion 1*d* itself is recessed like a scooping part of a spoon as apparently shown in the sub-diagram (c2) in this shown example. By using a toner container having this shape near the opening portion 1*b*, it is prevented to discharge and drop a lump of toner and to scatter toner powder dust in the toner deposit portion 4 at the bottom of the toner bank 0. Thus, the toner is gradually discharged from the toner container 1 through the opening portion 1*b*. In addition, it is possible to use up the toner contained in the toner container 1 to the end almost completely without leaving some of the toner. Furthermore, extra toner is removed by the rotation of the toner container 1 and only a spoonful of toner is scooped up to the opening portion 1*b*, and therefore toner is discharged stably from the opening portion 1*b*.

Next, an exemplary mechanism for opening or closing the opening portion 1*b* at an end of the toner container 1 with the cap 7 is described with reference to FIGS. 7, 8, 9 and 10.

Figure 7:
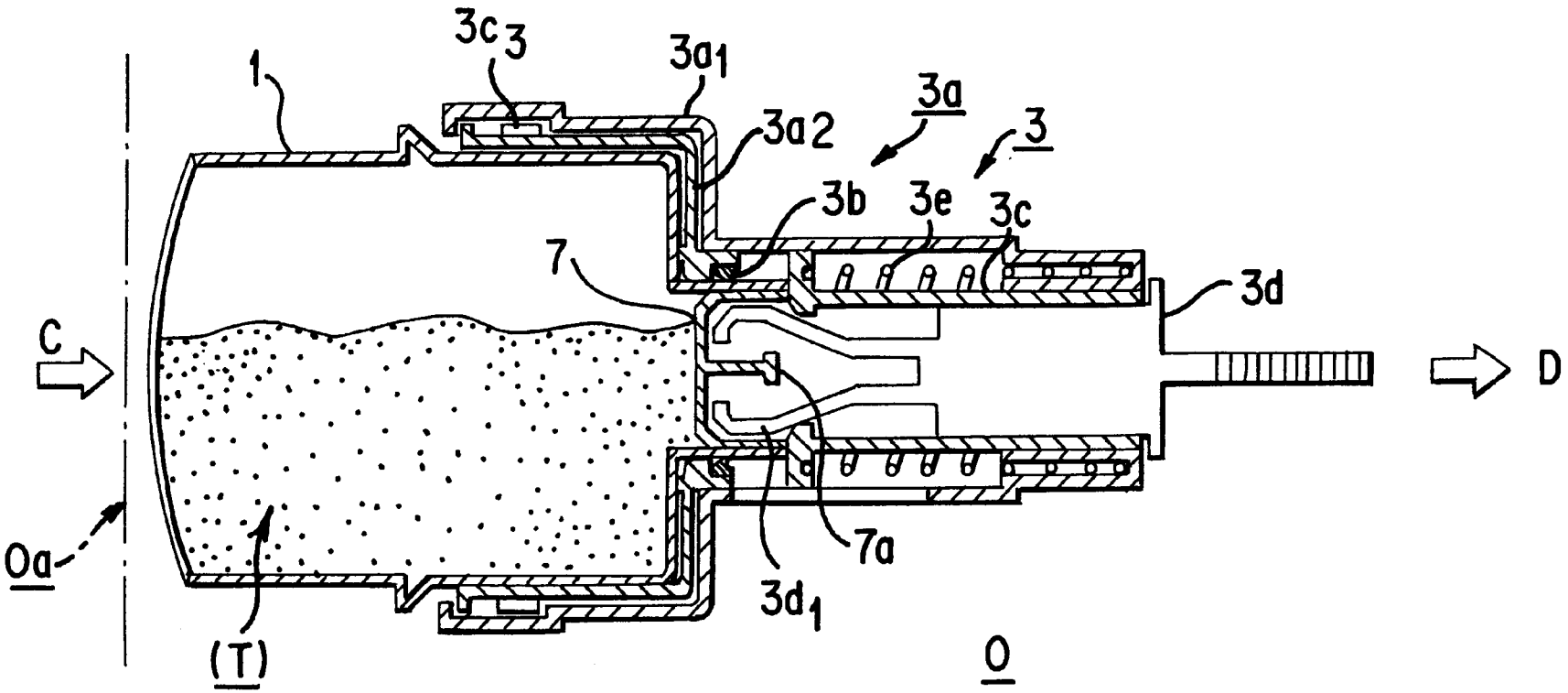
FIGS. 7, 8, 9 and 10 are schematic drawings illustrating an exemplary mechanism of the toner supplying device for opening or closing with a cap an opening portion of a toner container attached to the toner supplying device, where
Figure 8:
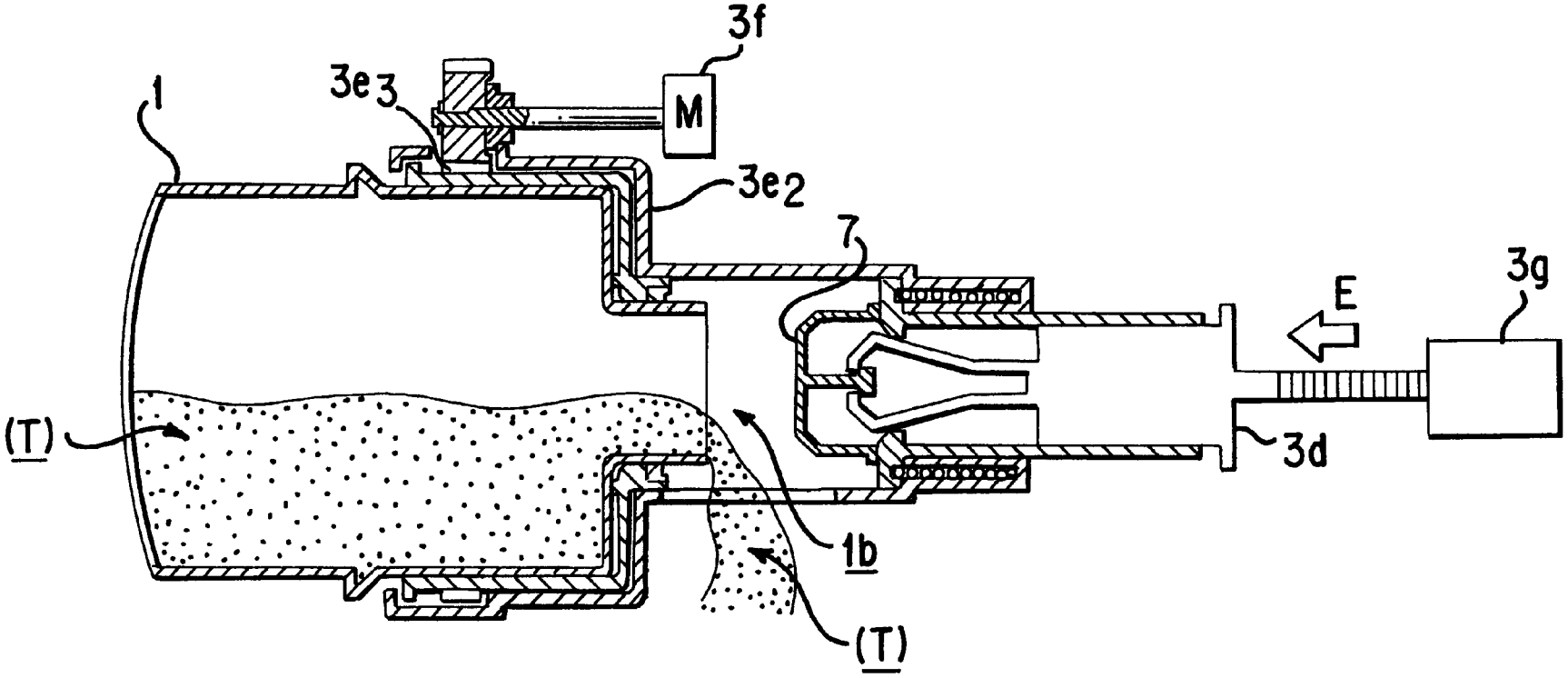

FIG. 7 shows the toner container 1 being set in a holder portion 3*a* of the toner container holder 3 of the toner bank 0 and the opening portion 1*b* being closed with the cap 7. FIG. 8 shows the cap 7 being taken off so as to open the opening portion 1*b*. In the holder portion 3*a* composing the holder 3*a*1, there is provided a rotatably-supported inner holder 3*a*2, which is rotated by a gear drive (not shown) via a driving gear 3*c*3. The toner container 1 has recess and projecting portions (not shown) so that it can rotate synchronously with this inner holder 3*a*2. In the inner holder 3*a*2, as shown in FIG. 7, a seal 3*b* is arranged so as to prevent toner from being scattered from a gap between the toner container 1 and a supporting section of the inner holder 3*a*2. In the holder 3*a*1, a slider 3*c* and a chuck 3*d* are supported so as to slide freely, respectively.

The slider 3*c* is pressed by a spring 3*e* in a direction that urges the cap 7 toward the toner container 1. When the chuck 3*d* is shifted in a direction indicated by an arrow D from this state, as shown in FIG. 7, a grab portion 7*a* of the cap 7 is held by a click 3*d*1 of the chuck 3*d* and then the cap 7 is drawn out of the toner container 1, whereby the opening portion 1*b* is opened.

In FIG. 8, when the driving gear 3*c*3 is rotated by a gear of the rotation driving device 3*f* in this state, the inner holder 3*a*2 rotates and the toner container 1 rotates synchronously with this rotation, whereby toner (T) in the toner container 1 is discharged from the opening portion 1*b*. If the toner (T) remaining in the toner container 1 becomes less than a predetermined amount as determined by the toner near-end determining device 6, after a predetermined period of time which is sufficiently long for using up the remaining toner of the toner container 1, the opening portion 1*b* of the toner container 1 is closed by the cap 7 by shifting the chuck 3*d* with a moving device 3*g* in a direction indicated by the arrow E in FIG. 8.

Figure 9:
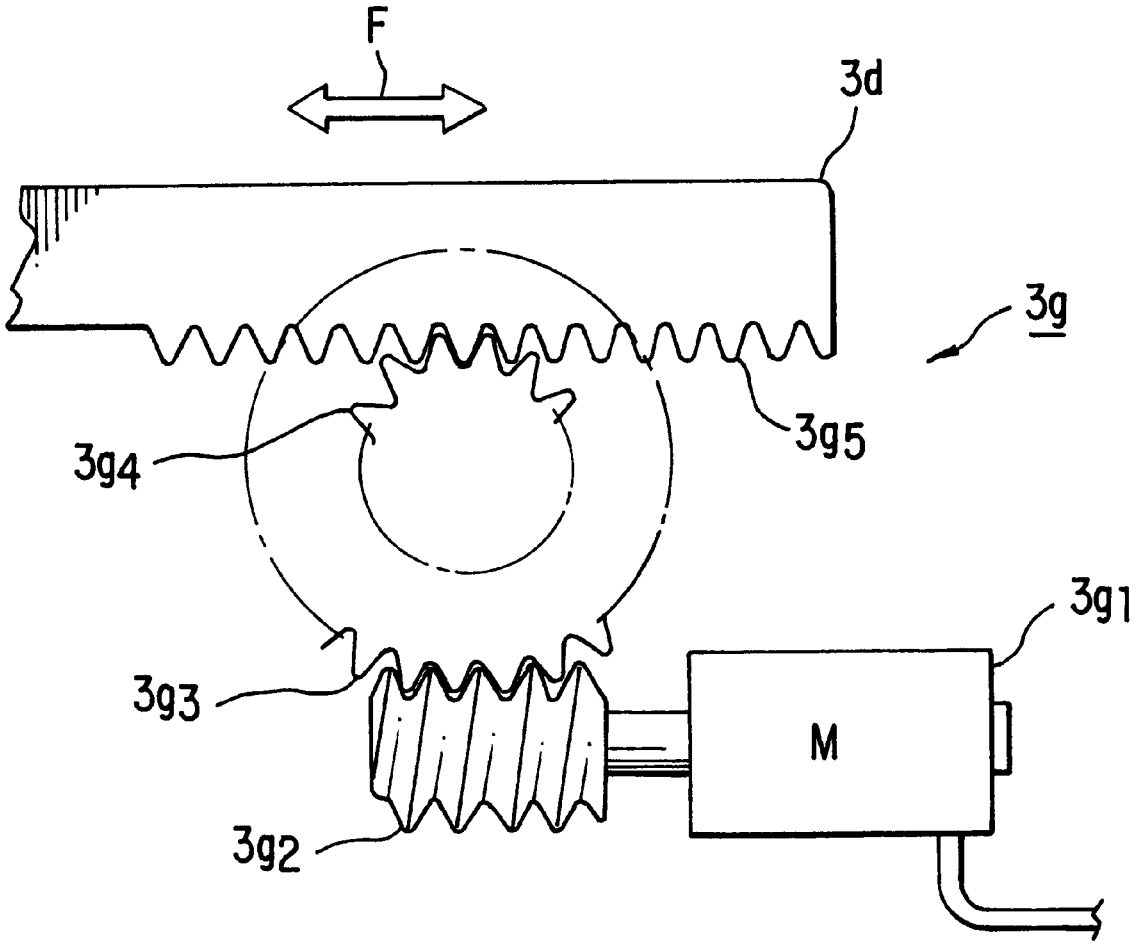

The moving device 3*g* is shown in FIG. 9. As shown in FIG. 9, the moving device 3*g* includes a driving motor 3*g*1, a worm gear 3*g*2, a helical gear 3*g*3, a pinion 3*g*4, and a rack 3*g*5. The chuck 3*d* is moved in a horizontal direction as indicated by an arrow F in FIG. 9 with a rotation of the driving motor 3*g*1 in a clockwise direction or a counter-clockwise direction, whereby the cap 7 can be put on or taken off the opening portion 1*b* of the toner container 1. When the cap 7 is put on the opening portion 1*b* of the toner container 1, a stopper, like that shown in FIG. 10, is used to prevent the toner container 1 from being moved.

Figure 10:
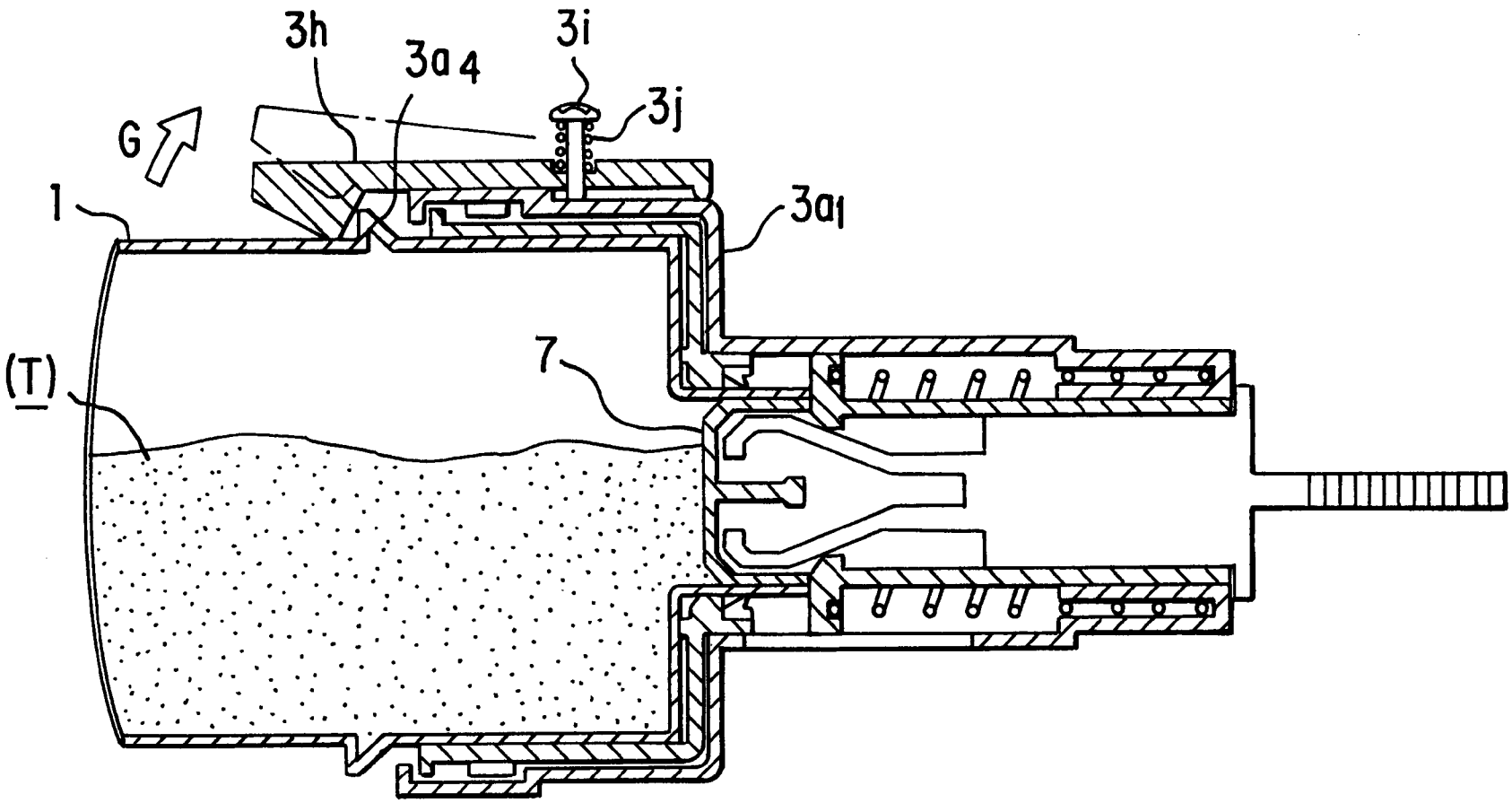

In FIG. 10, a stopper 3*h* is supported by a stepped screw 3*i* and a spring 3*j* so as to be fixed to the holder 3*a*1, with its click portion being engaged with a projection 3*a*4 arranged on an outer peripheral surface of the toner container 1. The stopper 3*h* is pressed by the spring 3*j* so as not to be raised up to the position indicated by a two-dotted and dashed line in FIG. 10 by a force of closing the cap 7. Accordingly, the cap 7 can be put on the opening portion 1*b* of the toner container 1 securely. In addition, when exchanging the toner container 1, the toner container 1 can be easily removed from the stopper 3*h*, so that it can be easily exchanged, by pulling out the toner container 1 more strongly or by withdrawing the stopper 3*h* manually or with an added lever or the like to the position indicated by the two-dotted and dashed line in FIG. 10.

Now, examples of an operation of determining that the toner contained in a toner container attached to the toner supplying device 0 is running low is hereinafter described with reference to flowcharts shown in FIGS. 11 and 12.

Figure 11:
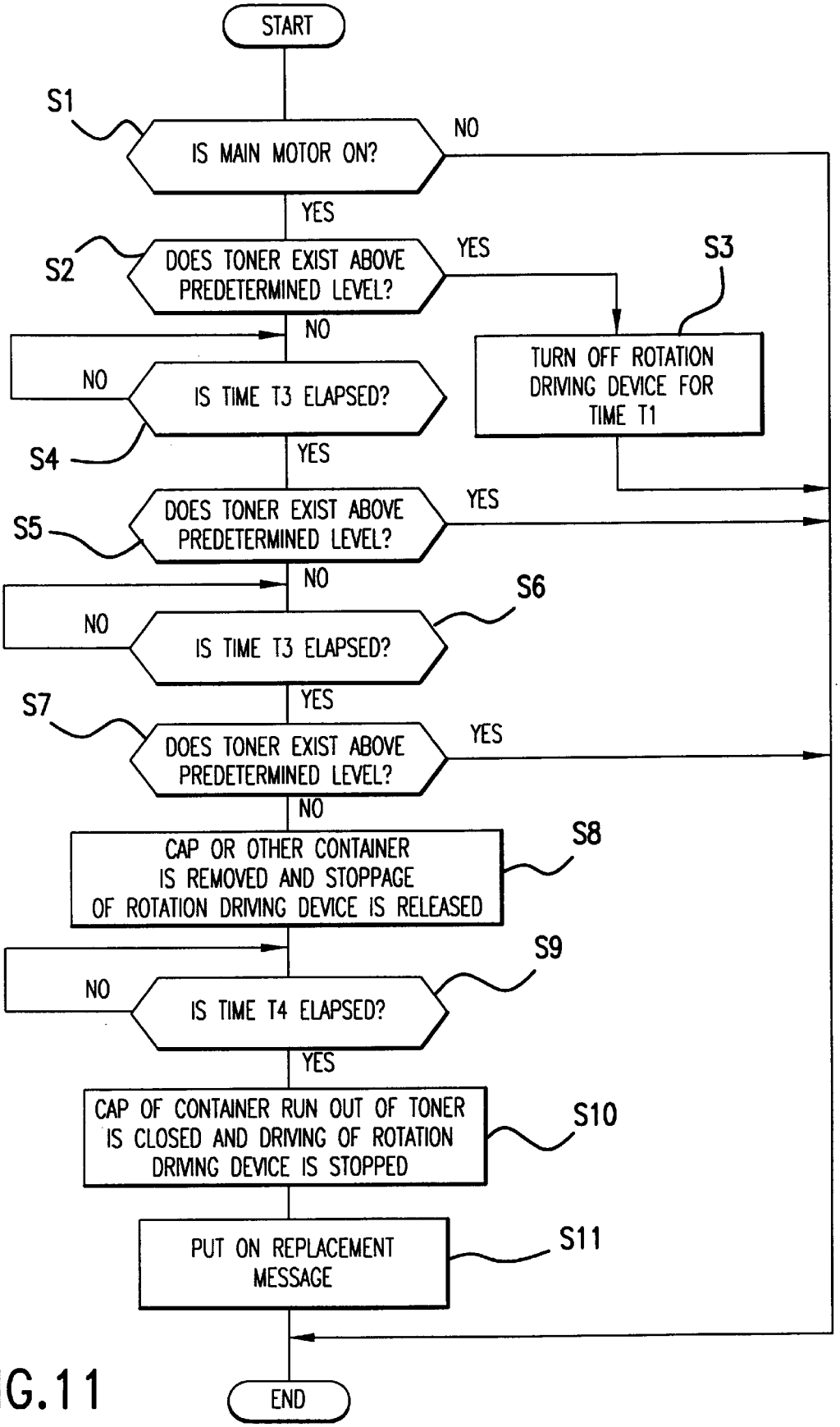
FIG. 11 is a flowchart showing an example of an operation for determining that a toner container attached to the toner supplying device and discharging toner therefrom is running out of toner.

In FIG. 11, in step 1 (S1), the controller 6*b* determines if the power of the main motor is on, that is, if the toner container 1*a*1 held by the toner container holder 3 is being rotated and the toner contained in the toner container 1*a*1 is being discharged from the opening portion 1*b* to be deposited in the toner deposit section 4 and then to be conveyed to the developing device 9 by the toner delivery device 5. If the main motor is on, the sensor 6*a*1 determines if toner exists above a predetermined level (height) in the toner deposit section 4 (S2). If the answer is yes, the rotation driving device 3*f* for rotating the toner container 1*a*1 is turned off for a time T1 so as to stop discharging the toner in the toner deposit section 4 (S3). If the answer is no, that is, if the level of toner is not above the predetermined level in the toner deposit section 4, the driving device 3*f* is continued to be driven to rotate the toner container 1*a*1 and step 4 (S4) determines if a prescribed time T2 is elapsed. If the time T2 is elapsed, then, existence of the toner above the predetermined height is checked again by the sensor 6*a*1 (S5). If the toner level is not above the predetermined level, the driving device 3*f* is continued to be driven to rotate the toner container 1*a*1 and it is checked again if a predetermined time T3 is elapsed in step 6 (S6). If the time T3 is elapsed, then, existence of the toner is checked again by the sensor 6*a*1 (S7). If the answer to the step 7 (S7) is no, that is, if the toner level is not above the predetermined level, it is determined that the toner contained in the toner container 1*a*1 is used up. Then, the cap 7 of the toner container 1*a*2 or 1*a*3 is removed and the stoppage of the driving of the driving device 3*f* for the toner container 1*a*2 or 1*a*3 is released and the driving device 3*f* is started to be driven so as to rotate the toner container 1*a*2 or 1*a*3 (S8). Then, in step 9 (S9), it is checked if a predetermined time T4 is elapsed. If the time T4 is elapsed, the opening portion 1*b* of the toner container 1*a*1 is closed by the cap 7 and the driving of the rotation driving device 3*f* for the toner container 1*a*1 is stopped (S10). The process ends after generating a replacing message for the toner container 1*a*1 instep 11 (S11).

Figure 12:
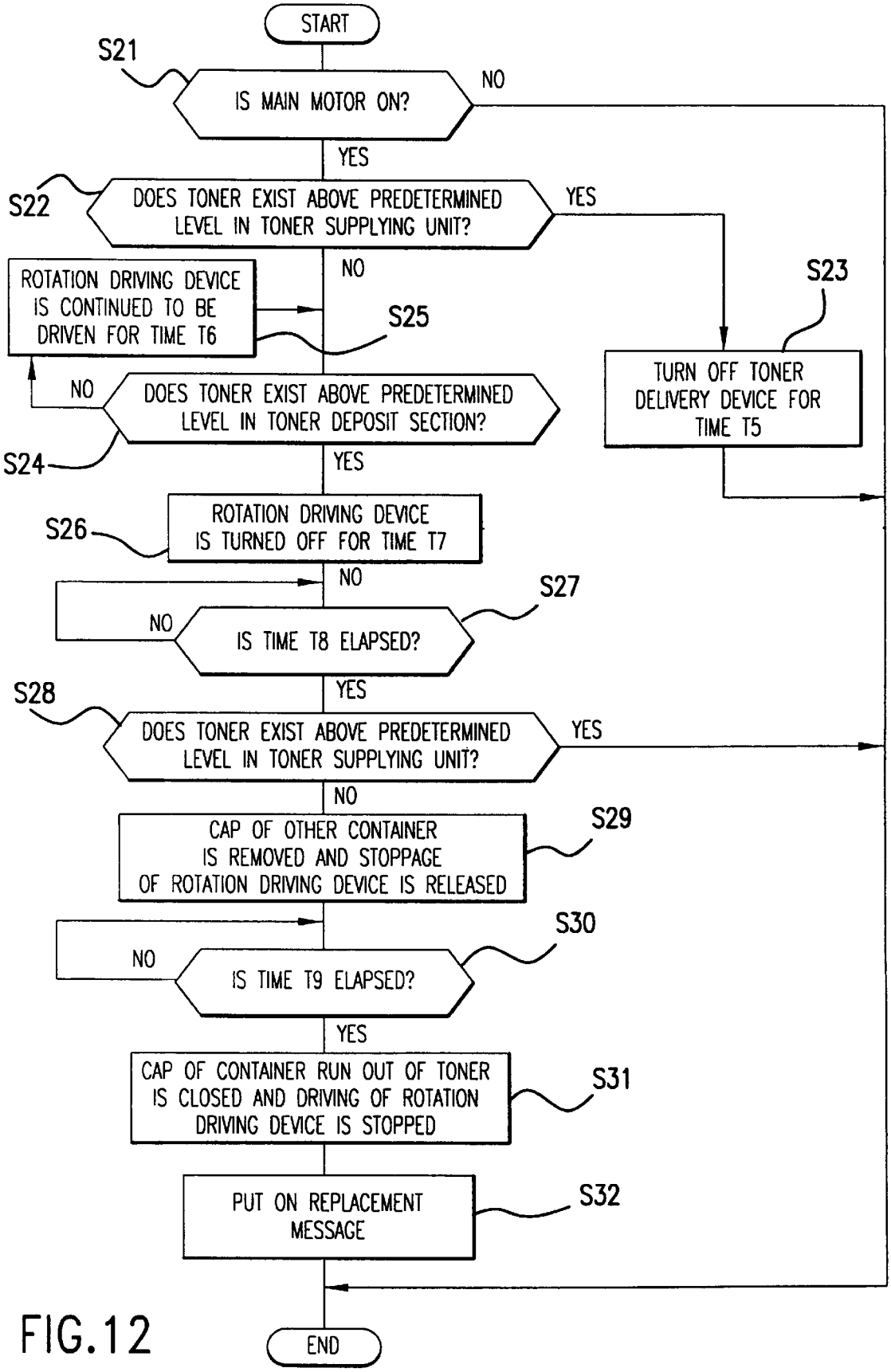
FIG. 12 is a flowchart showing another example of the operation for determining that a toner container attached to the toner supplying device and discharging toner therefrom is running out of toner.

FIG. 12 is a flowchart showing another example of determining that the toner contained in a toner container is running low. In step 21 (S21), the controller 6*b* determines if the power of the main motor is on, that is, if the toner container 1*a*1 held by the toner container holder 3 is being rotated and the toner contained in the toner container 1*a*1 is being discharged from the opening portion 1*b* to be deposited in the toner deposit section 4 and then to be conveyed to the developing device 9 by the toner delivery device 5. If the power is on, the sensor 6*a*2 provided at the toner supplying section 9*b* determines if the toner level exists above a predetermined level in the toner supplying section 9*b* (S22). If the sensor 6*a*2 determines that the toner level is above the predetermined level in the toner supplying section 9*b* in step S22, conveying of the toner by the toner delivery device 5 is turned off for a time T5 (S23). If the sensor 6*a*2 does not detect that the toner level is above the predetermined level of the toner supplying section 9*b*, that is, if the height of the accumulated toner in the toner supply section 9*b* is lower than the predetermined height, then, existence of the toner above the predetermined level in the toner deposit section 4 is checked by the sensor 6*a*1 (S24). If the toner does not exist above the predetermined level, that is, if the height of the accumulated toner in the toner deposit section 4 is below the predetermined level, the rotation driving device 3*f* is continued to be driven for a time T6 to rotate the toner container 1*a*1 to discharge the toner to supply the toner to the toner deposit section 4 (S25). If the toner does exist above the predetermined level, that is, the height of the accumulated toner in the toner deposit section 4 is above the predetermined level, the rotation driving device 3*f* is turned off for a time T7 (S26). Then, it is checked if a time T8 is elapsed (S27), and the sensor 6*a*2 detects existence of the toner again (S28). If the sensor 6*a*2 does not detect the toner, that is, if the height of the accumulated toner in the toner supplying section 9*b* is still lower the predetermined level, it is determined that the toner in the toner container 1*a*1 is running low. The cap 7 of the toner container 1*a*2 or 1*a*3 is removed and the stoppage of the driving of the rotation driving device 3*f* for the toner container 1*a*2 or 1*a*3 is released so as to be driven to rotate the toner container 1*a*2 or 1*a*3 (S29). Then, in step 30 (S30), it is checked if a time T9 is elapsed. If the time T9 has elapsed, the opening portion 1*b* of the toner container 1*a*1 is closed by the cap 7 and the driving of the rotation driving device 3*f* for the toner container 1*a*1 is stopped (S31). The process ends after presenting a replacing message for the toner container 1*a*1 in step 32 (S32).

Figure 13:
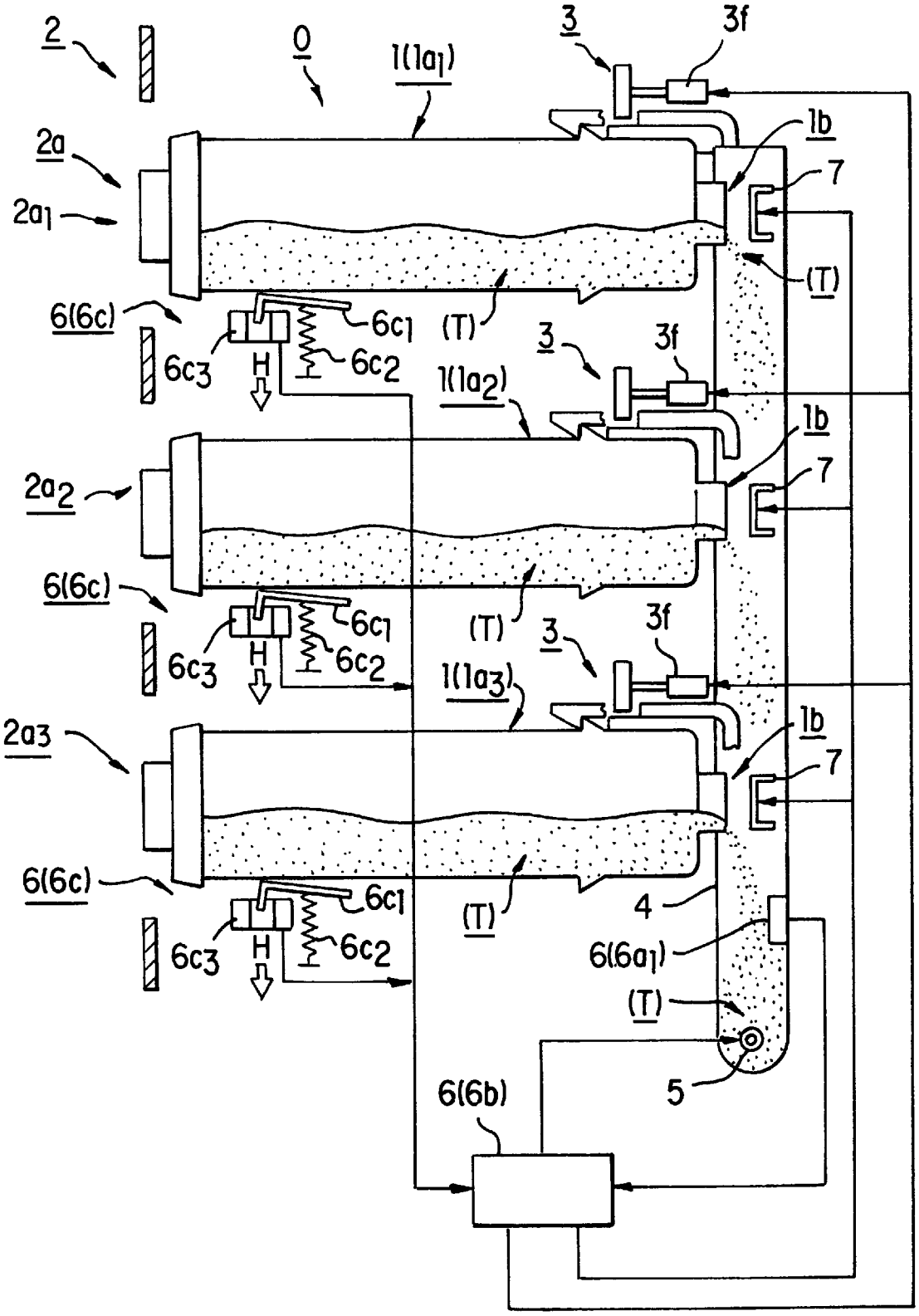
FIGS. 13 and 14 are drawings illustrating another example of a toner near-end determining device for determining that the toner contained in a toner container attached to the toner supplying device is running out of toner.
Figure 14:
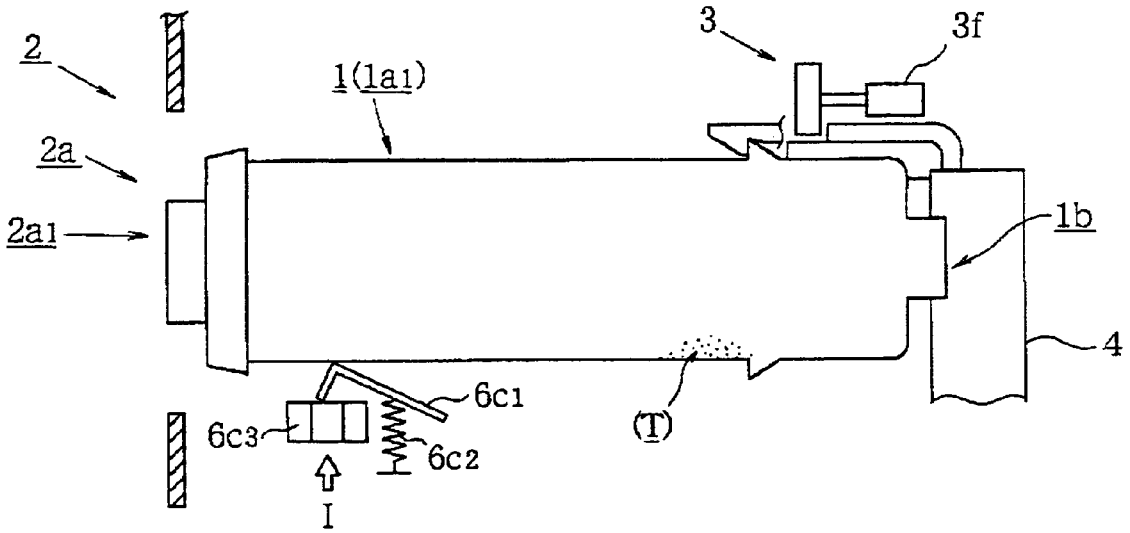

FIGS. 13 and 14 are drawings illustrating another example of a toner near-end determining device for determining that the toner contained in a toner container is running low.

In FIGS. 13 and 14, a weight sensor 6*c* of the toner near-end determining device 6 includes a filler 6*c*1, a spring 6*c*2, and a detect part 6*c*3. The weight sensor 6*c* is inserted through the toner container insertion inlets 2*a*1, 2*a*2, and 2*a*3 of the toner bank 0 and is disposed below the insertion inlets 2*a*1, 2*a*2 and 2*a*3, respectively. The toner containers 1*a*1, 1*a*2, and 1*a*3 press the filler 6*c*1 in a direction indicated by an arrow H while resisting against the elastic force of the spring 6*c*2 so that the filler 6*c*1 is inserted in the detect part 6*c*3. Once the toner container 1*a*1 becomes light after discharging toner, the spring 6*c*2 contracts so as to force the bent portion of the filler 6*c*1 upward to thereby release the filler 6*c*1 from the detect part 6*c*3 (FIG. 14). Thus, when the weight sensor 6*c* detects that the weight of the toner container 1*a*1 becomes lighter than a predetermined weight, it is determined that the toner contained in the toner container 1*a*1 is used up.

Figure 15:
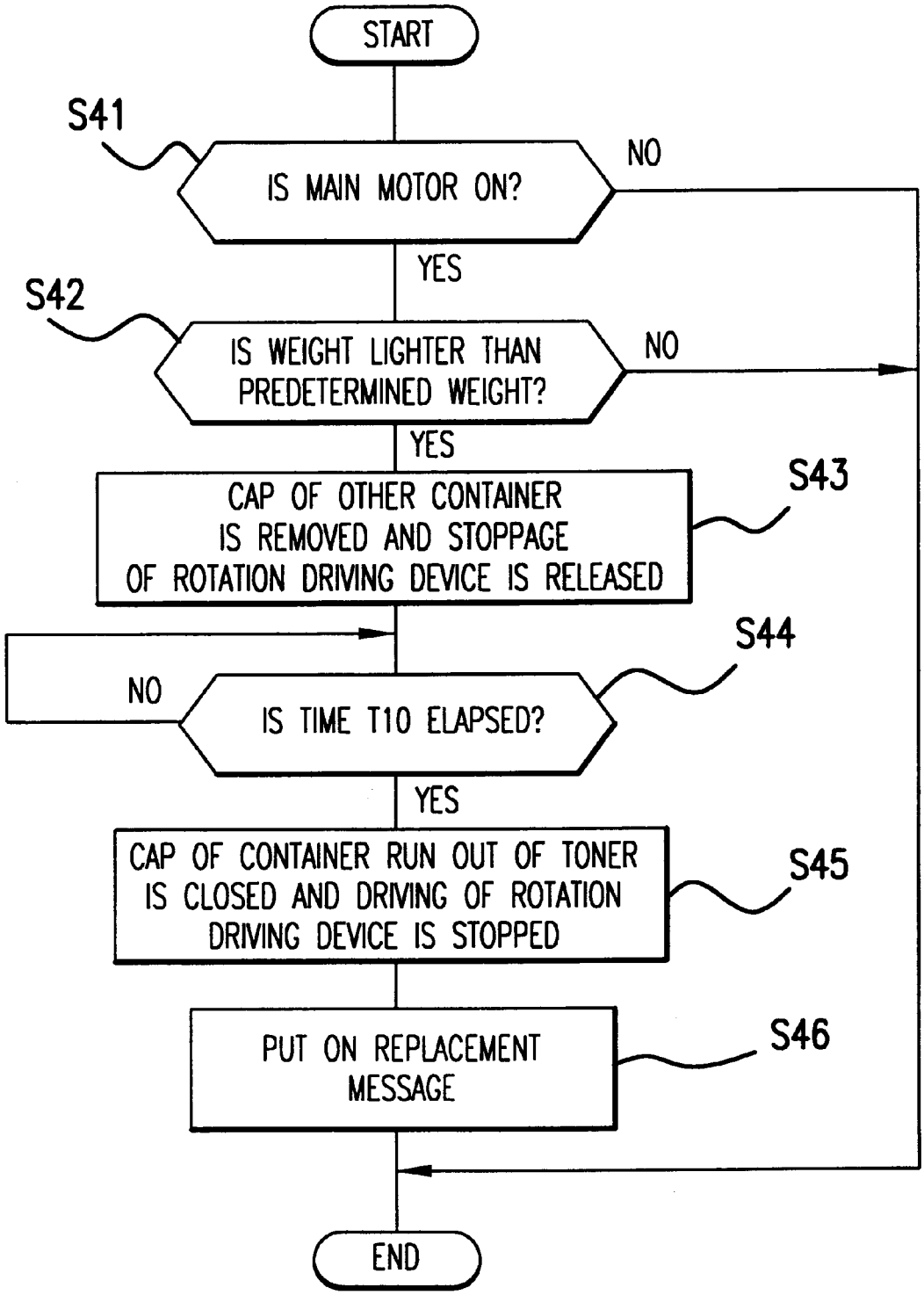
FIG. 15 is a flowchart illustrating an operation for determining that the toner contained in a toner container is running out with the toner near-end determining device shown in FIGS. 13 and 14.

FIG. 15 is a flowchart illustrating an operation of determining that the toner contained in a toner container is running out with the toner near-end determining device as configured above. In FIG. 15, the controller 6*b* checks if the power of the main motor is on (S41). The weight sensor 6*c* then checks if the weight of the toner container 1*a*1 is lighter than a predetermined weight (S42). If the weight is lighter than the predetermined weight, it is determined that the toner in the toner container 1*a*1 is used up, and the cap 7 is removed from the opening portion 1*b* of the toner container 1*a*2 or 1*a*3 and the stoppage of the driving of the rotation driving device 3*f* for the toner container 1*a*2 or 1*a*3 is released so as to rotate the toner container 1*a*2 or 1*a*3 (S43). Then, it is checked if a time T10 has elapsed (S44). If the time T10 has elapsed, the opening portion 1*b* of the toner container 1*a*1 is closed by the cap 7 and the driving of the rotation driving device 3*f* is stopped (S45). A replacement message for the toner container 1*a*1 is put on (S46) to end the process.

Now, an exemplary mechanism to discharge a toner container from a toner container holder of a toner supplying device according to the present invention is hereinafter described.

Figure 16:
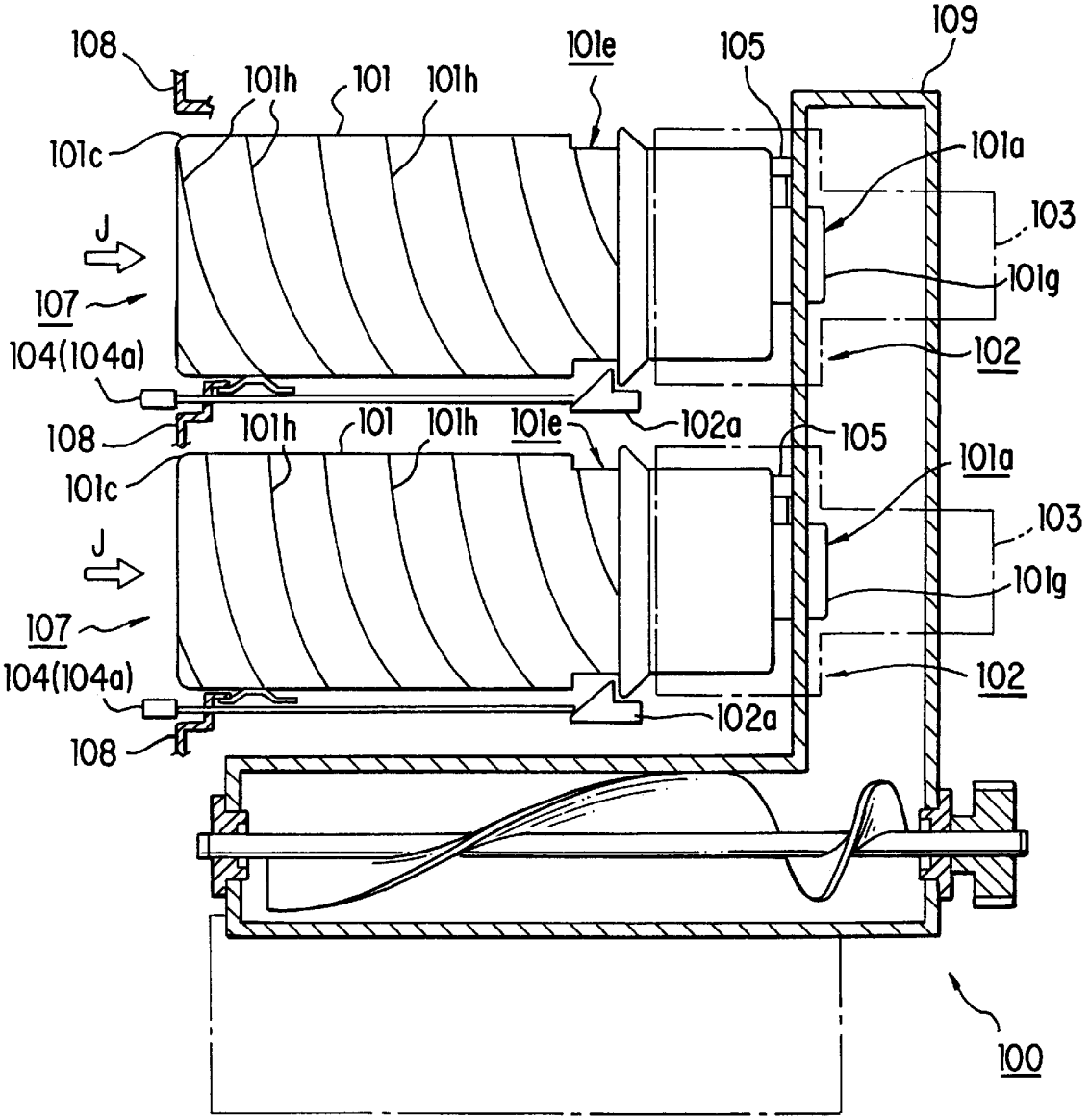
FIG. 16 is a schematic drawing of another example of a toner supplying device according to the present invention.
Figure 17:
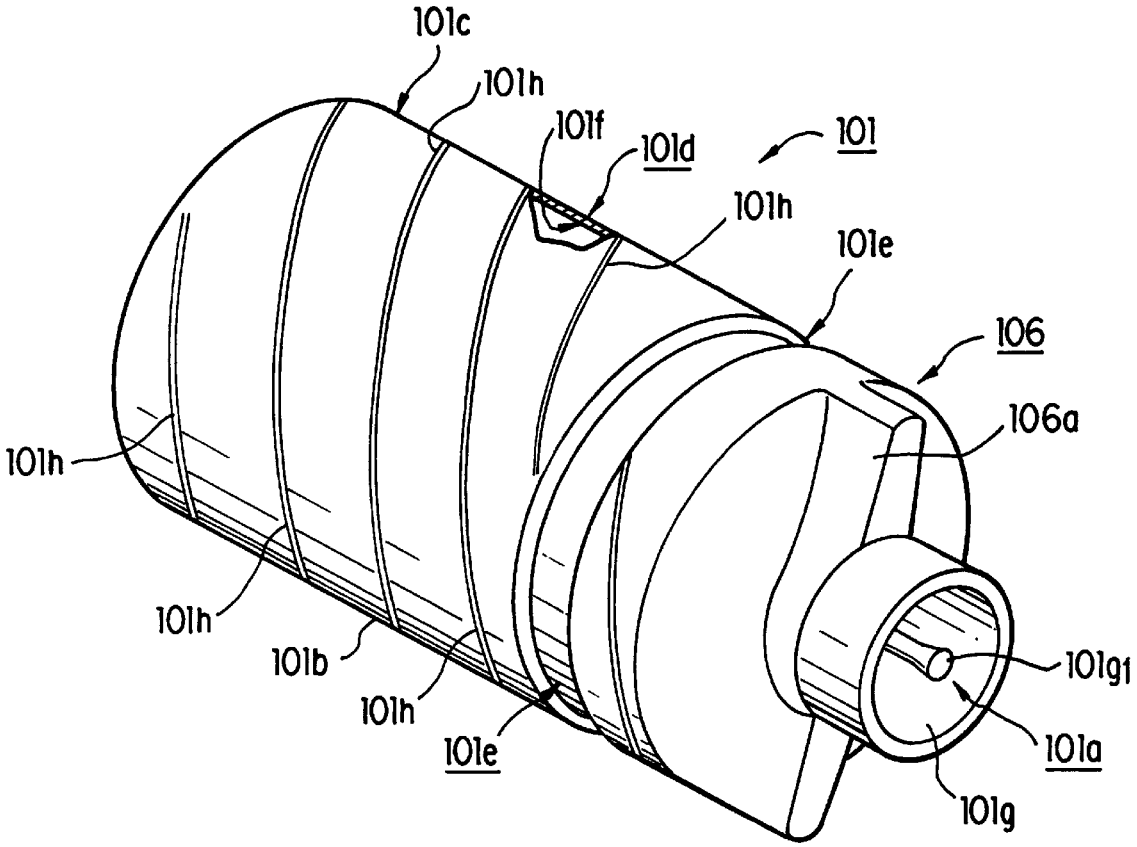
FIG. 17 is a schematic drawing illustrating an example of a toner container used in the toner supplying device of FIG. 16.

FIG. 16 is a schematic drawing of another example of a toner supplying device according to the present invention and FIG. 17 is a schematic drawing illustrating an example of a toner container used in the toner supplying device of FIG. 16.

In FIGS. 16 and 17, a toner container 101 is inserted into a toner container insertion inlet 107 of a toner supplying device 100 with an opening portion 101*a* thereof leading in a direction indicated by an arrow J. Once the toner container 101 reaches a predetermined position inside of a housing case 108 of the toner supplying device 100, a stopper 102*a* of a toner container holder 102 of the toner supplying device 100 engages with a recessed portion 101*e* at the outer circumferential surface of the toner container 101 and thereby the toner container 101 is held so as not to be removed from the toner supplying device 100. Thus, the toner container 101 is held with the opening portion 101*a* for discharging the toner therethrough being positioned at a predetermined position inside the toner supplying device 100.

An open/close device 103 is a device used for opening and closing, by a cap 101*g*, the opening portion 101*a* of the toner container 101 being held by the toner container holder 102.

Near the toner container insertion inlet 107 is provided a release lever 104*a* of a release device 104, protruding toward outside of the housing case 108. The release device 104 releases the toner container 101 from being held by the toner container holder 102 by pushing the release lever 104*a* in a direction indicated by the arrow J in FIG. 16. Once the toner container 101 is released from being held by the toner container holder 102, the toner container 101 is outwardly discharged from the housing case 108 by way of a discharging device 105 to a position where it can be easily recognized that the toner container 101 is released from the toner container holder 102 and where a bottom portion 101*c* of the toner container 101 can be easily grasped by an operator's hand so as to be removed from the toner supplying device 100. Therefore, even if the release lever 104*a* of the release device 104 is let go, the toner container 101 will not return to being held by the toner container holder 102 again. Further, the toner container 101 can be easily removed from the toner supplying device 100 through the toner container insertion inlet 107 by grasping the toner container 101 at the bottom portion 101*c* thereof, which is sufficiently far out of the housing case 108.

As illustrated in FIG. 17, the toner container 101 in this example is formed with a spiral fin-like shaped guide groove 101*h* on the outer circumferential surface 101*d* protruding inward of the toner container 101 from the internal circumferential surface 101*f* thereof. When the toner container 101 configured as above is installed in the toner supplying device 100 with the opening portion 101*a* being attached to a toner falling path forming member 109 through which a toner falling path is formed and is rotated around an axis thereof, the toner contained in the toner container 101 is guided and moved toward the opening portion 101*a* by the guide groove 101*h*.

Figure 18:
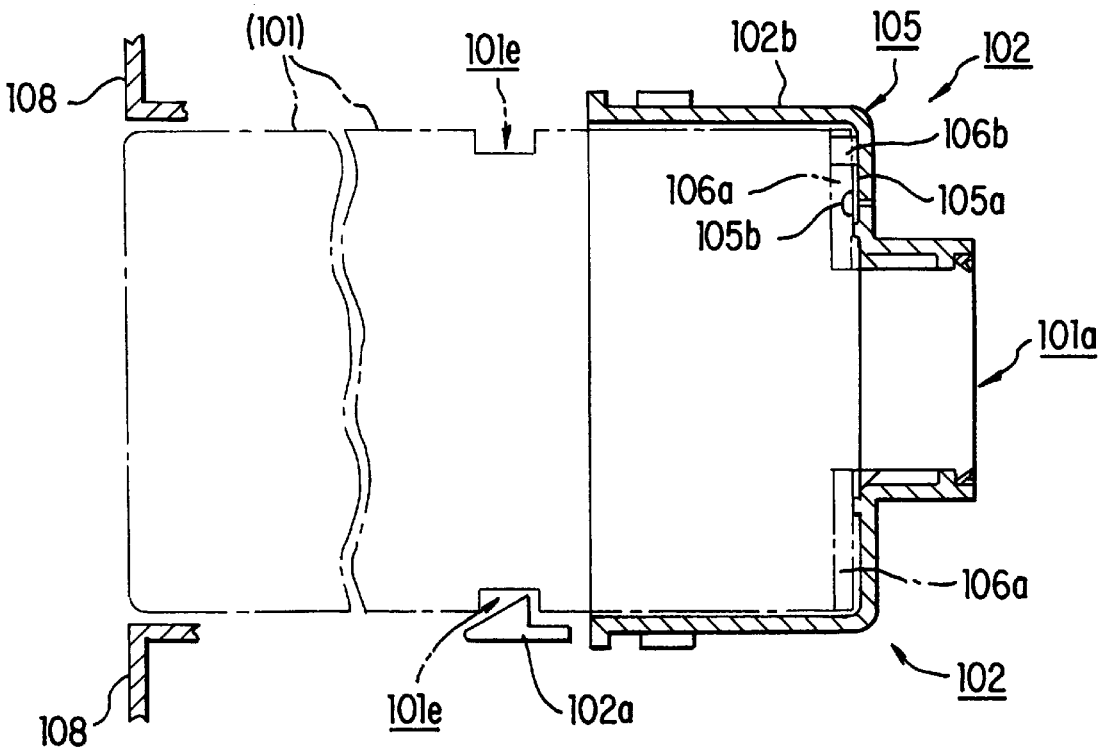
FIG. 18 is a sectional schematic drawing illustrating an example of a toner container holder of the toner supplying device of FIG. 16.
Figure 19:
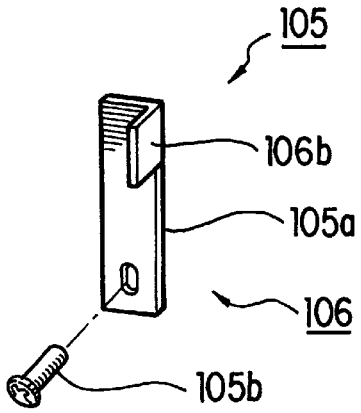
FIG. 19 is an oblique schematic drawing illustrating an example of a toner container discharging device according to the present invention.

FIG. 18 is a sectional schematic drawing illustrating an example of the toner container holder 102 and FIG. 19 is an oblique schematic drawing illustrating an example of the toner container discharging device 105 of the toner supplying device 100 according to the present invention.

The toner container discharging device 105 is made of an elastic member such as metal or plastic and includes a plate-like shaped engaging part 105*a* having a driving part 106*b* protruding in a direction orthogonal to the plate-like shaped engaging part 105*a* at an end part of the engaging part 105*a*. The engaging part 105*a* engages with a driven part 106*a* of a driving force transmitting part 106 of the toner container 101 and functions as a support member to support the driving part 106*b* to rotate the toner container 101. At an internal surface of one end of the holder 102*b*, the engaging part 105*a* is fixed by a screw 105*b*. The engaging part 105*a* applies a rotation or swing driving force to the toner container 101 when the toner container 101 is held by the holder 102*b* so as to discharge the toner contained in the toner container 101 through the opening portion 101*a*. As illustrated in FIG. 18, the holder 102*b* is configured so as to cover the outer surface of a head part of the toner container 101, i.e., a cylindrical portion forming the opening portion 101*a* and a cylindrical part extending therefrom with a larger diameter.

Figure 20:
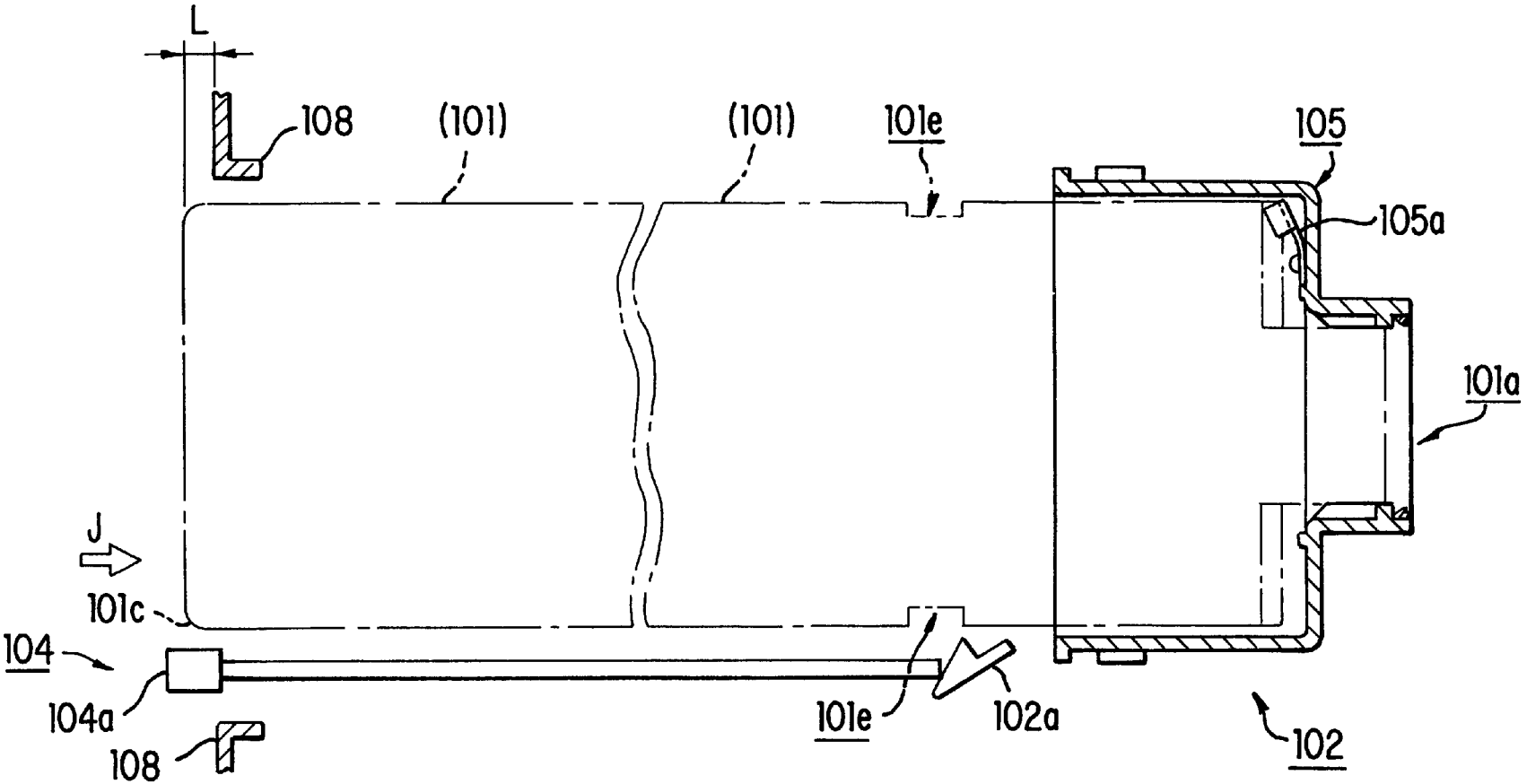
FIG. 20 is a schematic drawing for explaining an operation of the toner container discharging device.

FIG. 20 is a schematic drawing for explaining an operation of the toner container discharging device 105. In the drawing, when a state of the toner container 101 being held by the holder 102*b* is released by pushing the release lever 104*a* of the release device 104 in a direction indicated by an arrow J, the toner container 101 is outwardly discharged from the housing case 108 such that the bottom part 101*c* is in a position a distance (L) from the outer surface of the housing case 108, the distance (L) being sufficiently long such that and it can be easily recognized that the toner container 101 is discharged from the toner container holder 102 and the bottom part 101*c* can be easily grasped by hand. Thus, the user can easily recognize that the toner container 101 is detached from the toner container holder 102 when released from the held state. Because the release device 105 is elastic, even though the length of the gap (d1) is short as in the related art, the toner container 101 is discharged by being pushed by the release device 105 to the position where it can be easily recognized such that the toner container is released and the toner container 101 can be easily grasped by hand.

Figure 21:
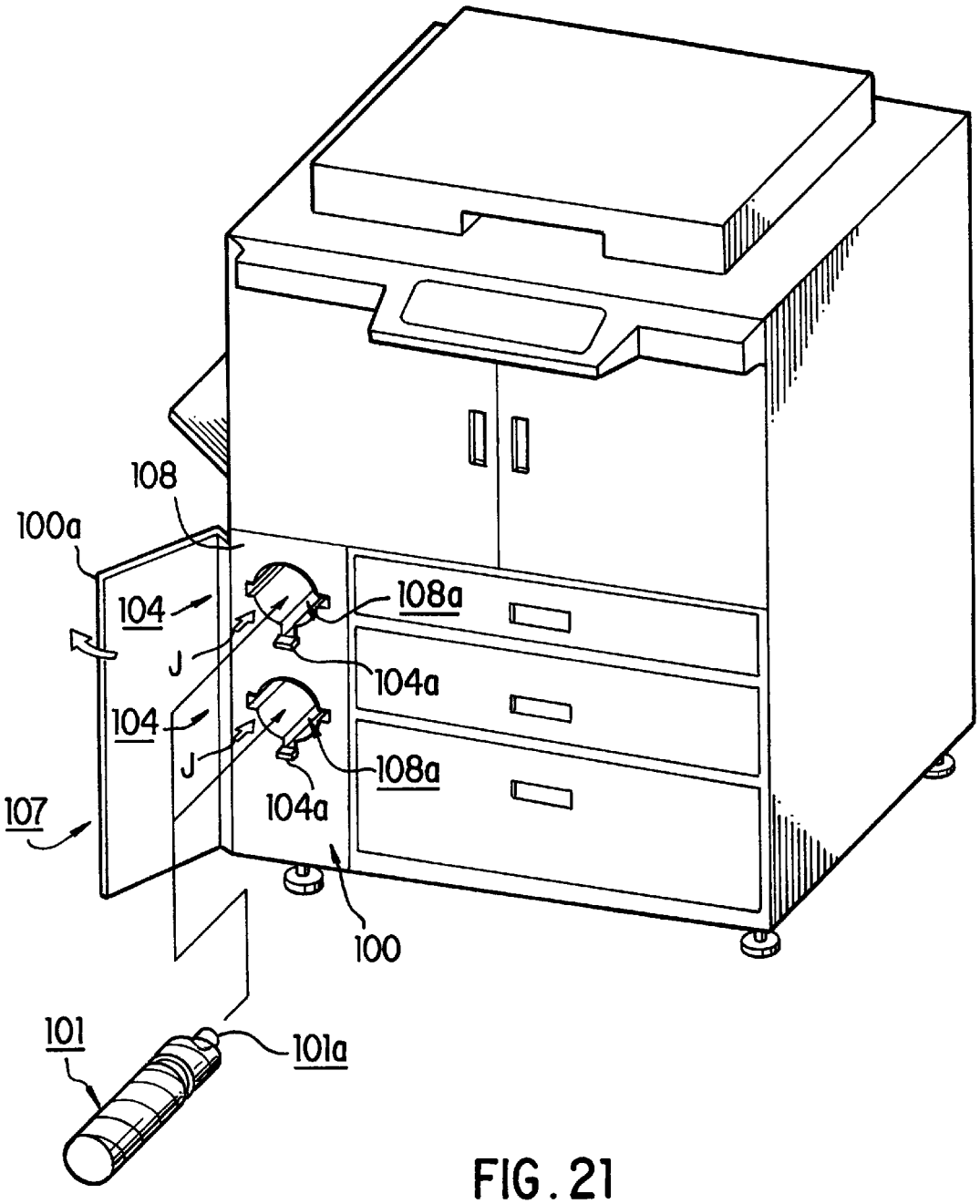
FIG. 21 is a front view of an image forming apparatus illustrating that when a front cover is opened to expose the toner supplying device of FIG. 16 arranged at a left lower side of the image forming apparatus.
Figure 22:
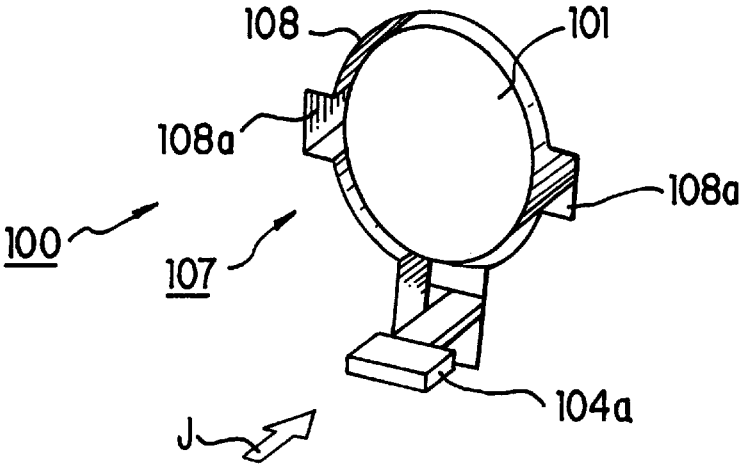
FIG. 22 is a schematic drawing illustrating a toner container insertion inlet of the toner supplying device from a front view.
Figure 23:
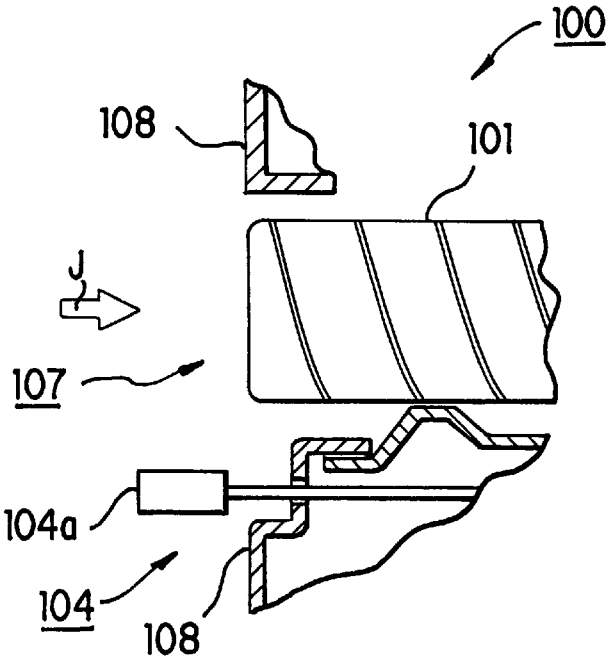
FIG. 23 is a cross view of the toner container insertion inlet.

FIG. 21 is a front view of an image forming apparatus illustrating that a front cover 100*a* is opened so as to expose the toner supplying device 100 arranged at a left lower side of the image forming apparatus. FIG. 22 is a schematic drawing illustrating the toner container insertion inlet 107 from the front and FIG. 23 is a cross sectional view of the insertion inlet 107. As illustrated in FIG. 21, two toner containers 101 are arranged vertically, one over top of the other. When replacing the toner container 101, the release lever 104*a* of the release device 104 is pushed in the direction indicated by an arrow J. Then, the toner container 101 is discharged by the toner container discharging device (not shown) toward the outside of the housing case 108, such that a part of the toner container 101 comes out of the housing case 108 to a position where the toner container 101 can be easily grasped through notched portions 108*a*. After the toner container 101 is removed from the toner supplying device 100 as above, a new toner container 101 is inserted into the toner supplying device 100 with the opening portion 101*a* leading through the toner container insertion inlet 107. Once the toner container 101 reaches a predetermined position, the toner container 101 is set so as not to be taken out.

Figure 24:
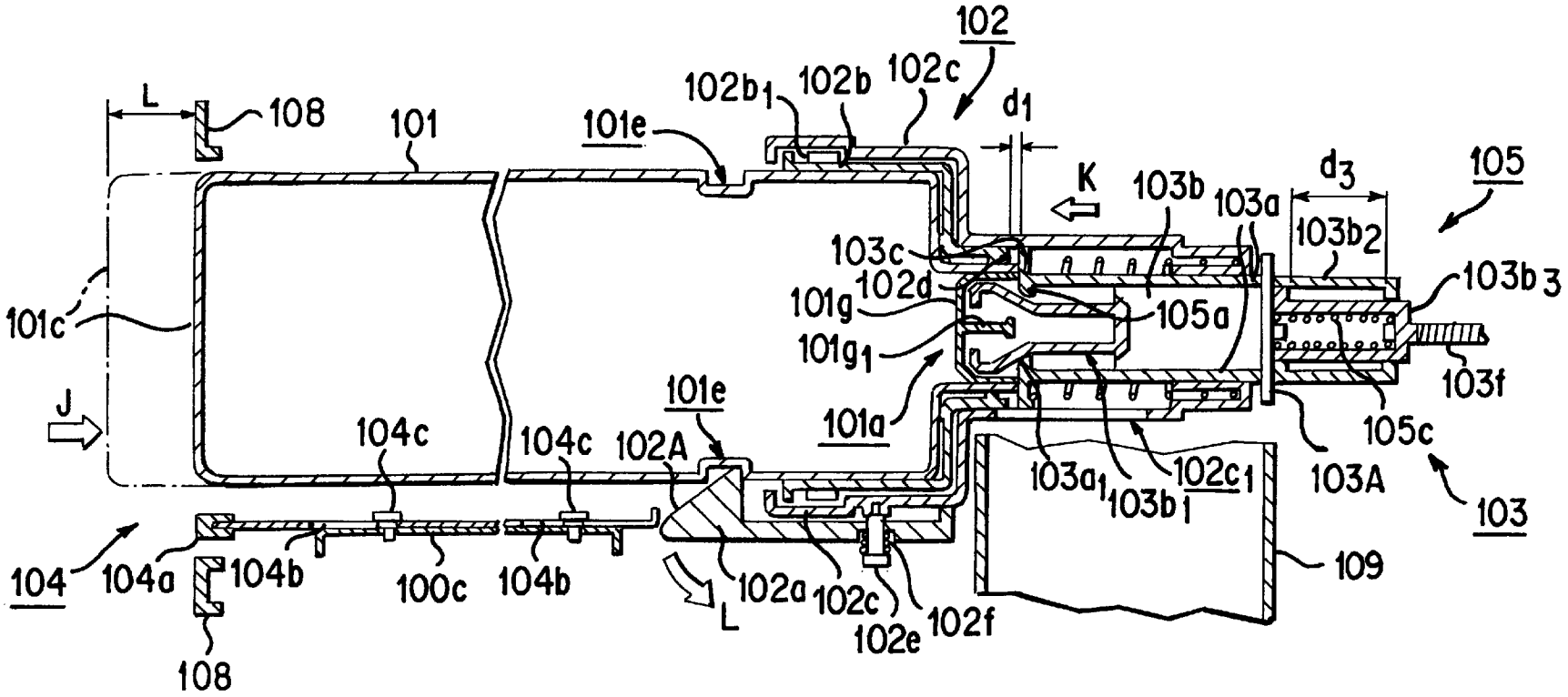
FIG. 24 is a schematic drawing showing a main part of the toner supplying device of FIG. 16.
Figure 25:
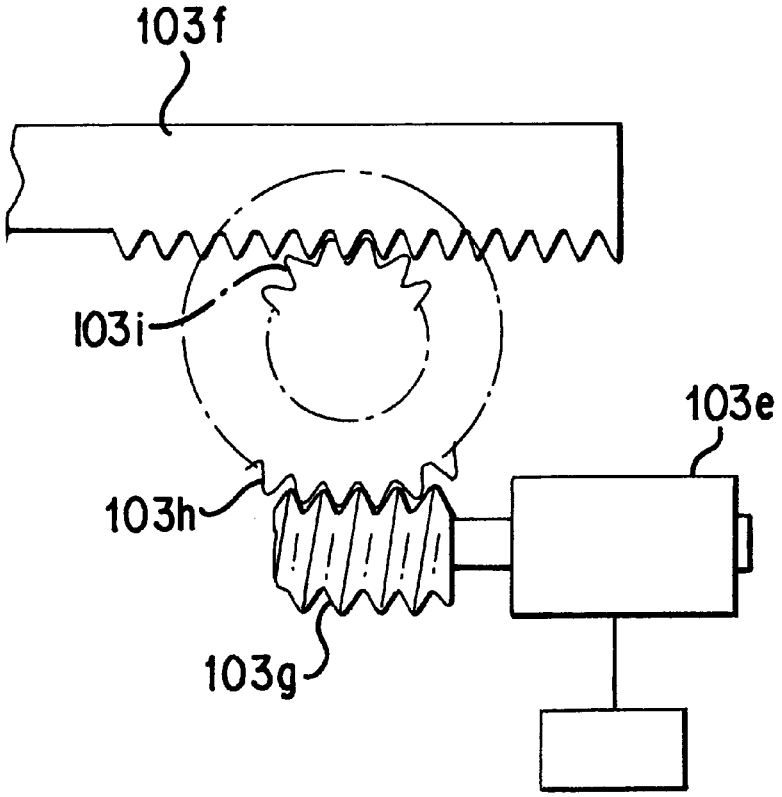
FIG. 25 is a schematic drawing showing a mechanism to reciprocally move a chuck of an open/close device of the toner supplying device of FIG. 16 for opening/closing an opening portion of a toner container with a cap.
Figure 26:
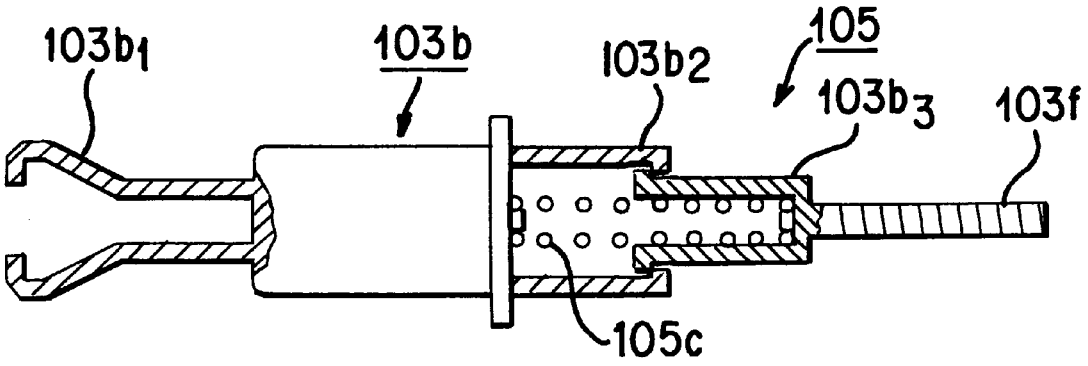
FIG. 26 is a schematic drawing showing another example of the toner container discharging device according to the present invention.

FIG. 24 is a schematic drawing showing a main part of the toner supplying device 100 of FIG. 16, FIG. 25 is a schematic drawing showing a device to reciprocally move a chuck of the open/close device 103 of the toner supplying device 100, and FIG. 26 is a schematic drawing showing another example of the toner container discharging device 105, according to the present invention.

In FIG. 24, the opening portion 101*a* of the toner container 101 is set in the side of the toner dropping path member 109, and in the toner dropping path member 109, there is provided the toner container holder 102 which can be engaged with the opening portion 101*a* of the toner container 101 to hold it. The holder 102 has a holder case 102*c*, which comprises a member having a stepped cylindrical cross section and has a toner discharging aperture 102*c*1 in a part of the lower circumferential surface. The toner discharging aperture 102*c*1 communicates with the toner dropping path member 109. In the holder case 102*c*, an inner holder 102*b* having a gear 102*b*1 on an outer peripheral surface thereof is arranged rotatably relative to the holder case 102*c*. On the inner surface of the inner holder 102*b*, there is arranged an engaging member (not shown), which can be engaged with an engaging portion (not shown) of the toner container 101, which is formed at an end portion of the toner container 101 at the side of the opening portion 101*a* and which is used for rotating the toner container 101. With the gear 102*b*1 of the inner holder 102*b* engaged, a driving gear (not shown) is driven to be rotated by a driving motor (not shown) so as to form a toner container rotating device. For the inner holder 102*b*, there is provided a sealing member 102*d* for preventing a leak of toner (T), being put in contact with an outer peripheral surface of the opening portion 101*a* of the toner container 101.

In FIG. 24, in the holder 102, there is provided a slider 103*a* and a chuck 103*b* forming an open/close device 103 for putting the cap 101*g* on or off the opening portion 101*a* of the toner container 101. The slider 103*a* is supported to be slidable along an axial direction of the holder 102 therein, and it is generally biased to move toward the side of the opening portion 101*a* of the toner container 101 (toward left in FIG. 24) by a spring 103*c* arranged inside the holder 102. The slider 103*a* has a small-diameter portion 103*a*1 formed on its internal surface for contracting a diameter of the chuck 103*b* when pulling out the cap 101*g*. Opening/closing operation of the open/close device 103 is controlled by this small-diameter portion 103*a*1. The spring 103*c* presses the slider 103*a* so that the slider 103*a* is not moved to the direction opposite to the direction K. The chuck 103*b* has a click 103*b*1 which is opposable to a grab portion 101*g*1 formed on the cap 101*g* of the toner container 101 at its tip, and a base of the click 103*b*1 is formed in a drum shape to be configured as a sliding portion which is put in contact with an inner peripheral surface of the slider 103*a*. The click 103*b*1 is made of a flexible member which is divided into a plurality of portions in a circumferential direction, and it is mechanically biased to extend the diameter.

A rack 103*f* is formed at an external end of the sliding portion, with which a pinion gear 103*i* is engaged so as to be linked with a worm gear 103*g* attached to an output axis of the driving motor 103*e* through a worm wheel 103*h* as shown in FIG. 25. The driving motor 103*e* is a driving device for the chuck 103*b* and the slider 103*a* forming the open/close device 103, and it is set to a rotation amount which enables putting on or off the cap 101*g* attached to the opening portion 101*a* of the toner container 101. The driving motor 103*e* may function also as the device to rotate or move the toner container 101.

On an outer peripheral surface of the holder case 102*c*, as shown in FIG. 24, there is provided a stopper 102*a* for preventing the toner container 101 from coming off when putting the cap 101*g* on the opening portion 101*a* of the toner container 101 which has been set, while the toner container 101 is being rotated, or when the cap 101*g* is off. The stopper 102*a* is a member which can be pivoted with a stepped screw 102*e* which is fixed to the holder case 102*c* being inserted in the middle of the longer direction, and an end portion of it in the longitudinal direction from the position of the stepped screw 102*e* is put in contact with the outer peripheral surface of the holder case 102*c* and the other end portion of it, forming a hooking portion, is opposite to a fastening concave portion 101*e* which is formed on the outer peripheral surface of the toner container 101. Around an outer circumferential surface of the stepped screw 102*e*, a spring 102*f* for pressing the stopper 102*a* against the holder case 102*c* is arranged, and the other end portion of the stopper 102*a* is engaged with the fastening concave portion 101*e* of the toner container 101. A tapered part 102A having a sharp angle is formed at an end part of the stopper 102*a* at the side facing the concave part 101*e* of the toner container 101.

The release lever 104*a* is an operating member for releasing engagement between the stopper 102*a* and the concave portion 101*e* of the toner container 101. The lever 104*a* has one or more oblong holes 104*b* and a head rivet 104*c* is passed through the oblong hole 104*b* so as to be fixed to a fixed wall 100*c*, whereby the lever 104*a* can slide along the fixed wall 100*c*. By pressing the release lever 104*a* of the release device 104 in a direction indicated by the arrow J, the stopper 102*a* of the holder 102 is rotated in a direction indicated by an arrow L and thereby the held state of the toner container 101 is released. Then, the slider 103*a* of the open/close device 103 for opening and closing the opening portion 101*a* with the cap 101*g* is pressed toward the direction indicated by an arrow K by the spring 103*c*, and the toner container 101 is outwardly discharged by the engaging part 105*a* (forming a part of the slider 103*a*) of the discharging device 105, which is functioning as the open/close device 103 also, toward the housing case 108 by a length (L). The length (L) is a length that is sufficiently long for enabling recognition of the toner container 101 being in the released state and also for enabling easy grasping of the toner container 101 by an operator's hand.

The toner container discharging device 105, which functions as the open/close device 103 as well, includes a spring 105*c* inside of the chuck 103*b*, and the chuck 103*b* is divided into a left part 103b2 forming an outer circumferential surface of the chuck 103b and a right part 103b3 forming an inner circumferential surface of the chuck 103b (FIG. 26). Therefore, even if the toner container 101 is discharged toward outside of the housing case 108 with the gap d1 being made wider and the cap 101g closing the opening portion 101a, because the positional relation between the slider 103a and the chuck 103b does not change, the click 103b1 will never be closed when the toner container 101 is outwardly discharged. More specifically, in FIG. 24, when the chuck 103b starts to be moved toward the left hand side in the drawing, a guard 103A integrated with the chuck 103b presses a right side edge of the slider 103a, and the chuck 103b and the slider 103a move together toward the left in the drawing. Namely, the chuck 103b and the slider 103a move together toward the left before the slider 103a alone is moved toward the left by a pressing force of the spring 103c upon releasing of the stopper 102a. Accordingly, closing of the click 103b1 of the chuck 103b caused as a result of relative movement of the chuck 103b and the slider 103a will never occur, because a strength of the springs 103c and 105c is set to accomplish the above operation.

The distance (L) is determined by a pressing force of the spring 105c when the chuck 103b and the slider 103a are moved together toward the left. Therefore, the gap d1 is determined such that the distance (L) is sufficiently long for enabling recognition of the toner container 101 being in the released state and also for enabling easy grasping of the toner container 101 by hand can be obtained with the spring 105c having a predetermined strength. The gap d1 can be enlarged up to a length corresponding to a gap d3 at the maximum, provided that d1<d3. As long as the gap d1 is less than the gap d3, the toner container 101 can be discharged without any problem and further there will not occur that friction is generated between the recessed portion 101e and the stopper 102a of the holder 102 when the toner container 101 is rotated to discharge toner.

Figure 27:
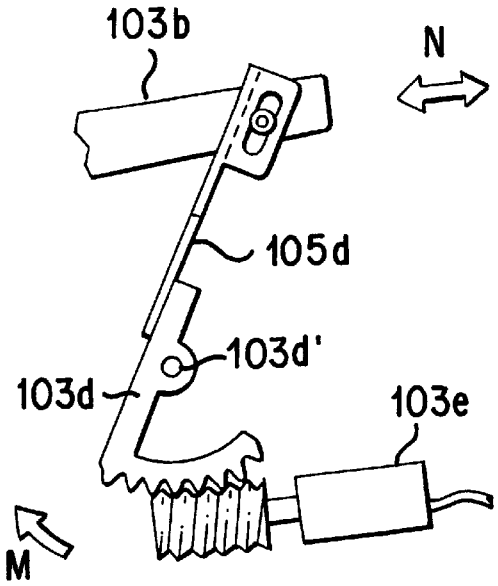
FIG. 27 is a schematic drawing illustrating another mechanism to reciprocally move a chuck of the open/close device according to the present invention.

FIG. 27 is a schematic drawing illustrating another mechanism to reciprocally move the chuck 103b. A drive member 103d that rotates around an axis 103d' is rotated in a direction indicated by an arrow M with the driving motor 103e and the chuck 103b is moved in a direction indicated by an arrow N via an elastic member 105d. With this mechanism also, the slider 103a and the chuck 103b are moved together without changing the relative positional relation between them and the slider 103a pushes the toner container 101. Therefore, the toner container 101 can be outwardly discharged toward the housing case 108 without the click 103b1 of the chuck 103 being closed even with the gap d1 being made wider and the cap 101g being put on the opening portion 101a of the toner container 101.

Figure 28:
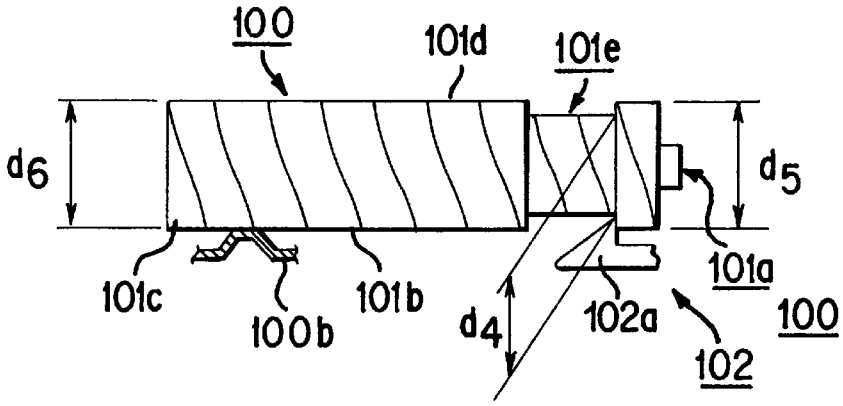
FIG. 28 is a schematic drawing illustrating another example of a toner container for the toner supplying device of FIG. 16.

FIG. 28 is a schematic drawing illustrating another example of the toner container 101 for the toner supplying device 100 of FIG. 16. As shown in the drawing, the toner container 101 includes a recessed part 101e having a smaller diameter d4 than the outer circumferential surface 101d of the toner container body 101b being supported at a predetermined position, and the recessed part 101e is engaged with the stopper 102a of the stopper 102 of the toner supplying device 100. Because there is no protrusion part on the outer circumferential surface of the toner container 101, when attaching the toner container 101 to or detaching the container 101 from the toner supplying device 100, the toner container 101 does not interfere with a recessed or protruded member of the toner supplying device 100, such as for example, a guide 100b supporting the bottom part 101c of the toner container 101 and can be smoothly inserted into the toner supplying device 100 to be attached thereto. Further, by making a diameter d6 of the circumferential surface 101d of the bottom part 101c to the maximum diameter (d6= d5>d4), a protruding part of the guide 100b becomes unnecessary and an insertion path for inserting the toner container 101 into the insertion inlet 107 become straight, such that attaching/detaching operability of the toner container 101 is further enhanced.

Figure 29:
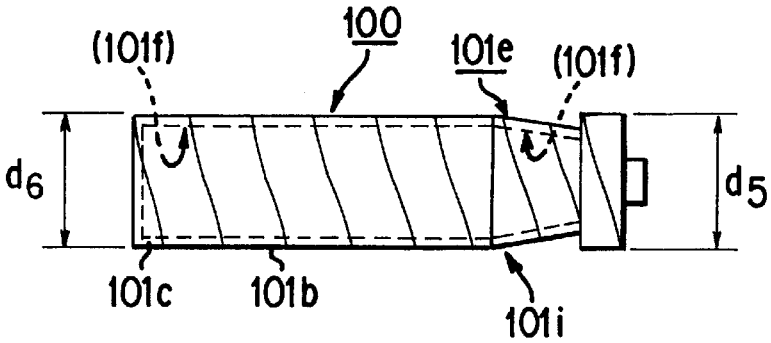
FIG. 29 is a schematic drawing illustrating another toner container for the toner supplying device of FIG. 16.

FIG. 29 is a schematic drawing showing another example of the toner container 101 for the toner supplying 100 of FIG. 16. The toner container body 101b is so made to have a smooth slope part 101i extending from the internal circumferential surface 101f of the bottom part 101c to the internal circumferential surface 101f of the recessed portion 101e of the toner container 101. Therefore, when the toner container 101 is rotated or moved for discharging toner, smooth conveyance of the toner from left to right in the drawing is accomplished by the above configuration.

Now, examples of a toner container for a toner supplying device in which handling operability is enhanced not only in attaching to and detaching from the toner supplying device, but also in transportation according to the present invention are hereinafter described.

Figure 30:
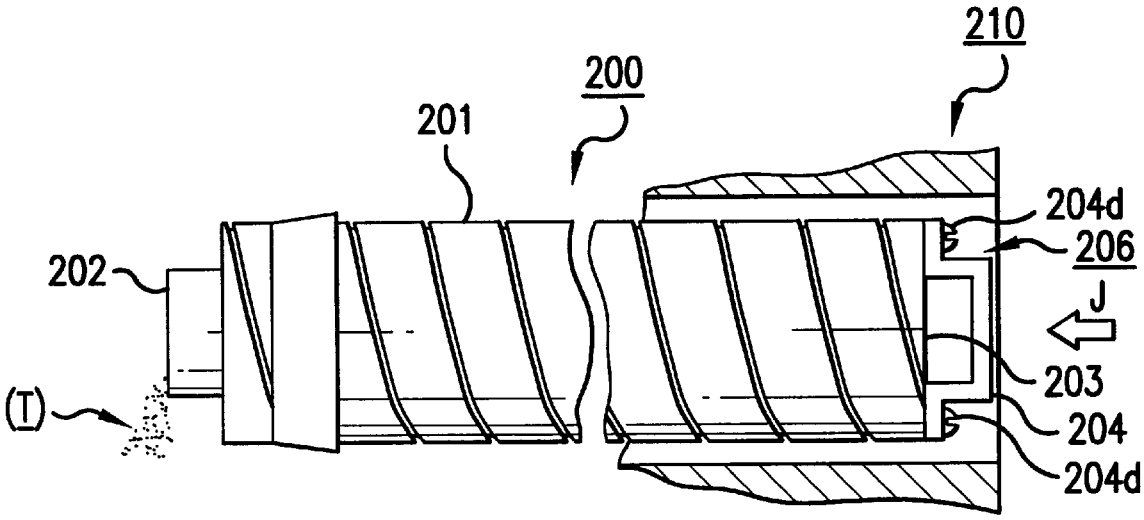
FIGS. 30 and 31 are front and right side views showing an example of a toner container for a toner supplying device according to an embodiment of the present invention.
Figure 31:
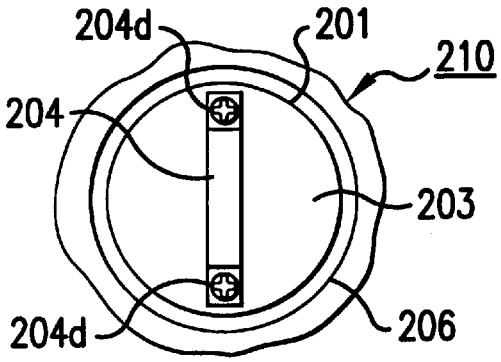

FIGS. 30 and 31 are front and right side views showing a mounted state of a toner container for a toner supplying device according to an embodiment of the present invention. A toner container 200 is inserted from a direction of an arrow J into a toner container inserting inlet 206 provided on the front of a toner bank 210. Toner (T) stored inside of a cylindrical toner container body 201 of the toner container 200 is discharged from an opening 202 provided axially at one end of the toner container body 201. The other end (wall) 203 of the toner container body 201, opposite to the opening 202, is closed, and a handhold 204 is fixed to the other end part 203 with screws 204d. The handhold 204 may be molded out of resin as one unit with the other end part 203 of the toner container body 201 without screws 204d for the purpose of reducing the cost.

According to the toner container of this embodiment, the operator can hold the handhold 204 for ease of attaching and detaching operations to the toner bank 210 even when the toner container body 201 attached to and detached from the toner bank 210 becomes large and hence heavy due to an increased amount of toner stored in the toner container body 201. Also, the handhold 204 inhibits the toner container body 201 from being set longitudinally, i.e., in a vertical or standing position, and hence prevents offset of toner stored in the toner container body 201 so as to discharge the toner smoothly from the opening 202 when attached to the toner bank 210 and operated. This makes it possible to provide such a toner container 200 that it can be attached to or detached from the toner bank 210 easily and securely, transported properly, and further, prevented from suffering offset of toner stored therein.

Figure 32:
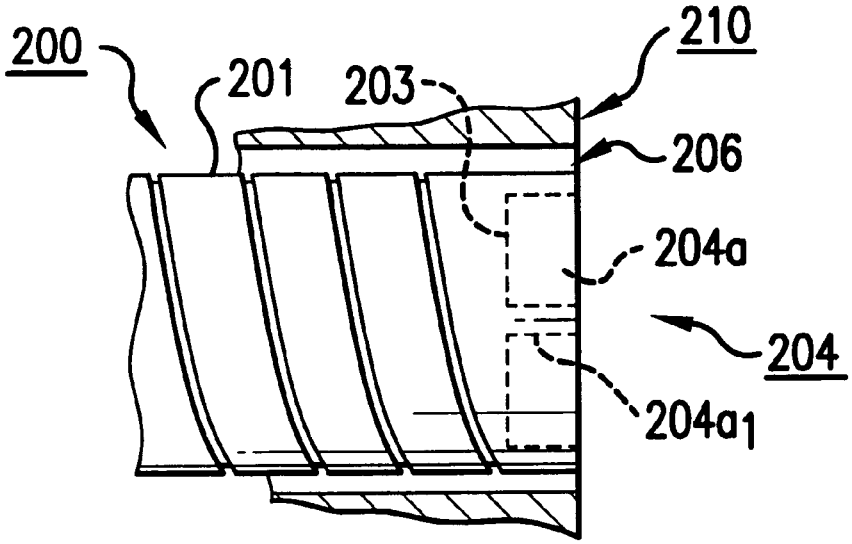
FIGS. 32 and 33 are front and right side views showing the main part of a toner container for a toner supplying device according to another embodiment of the present invention.
Figure 33:
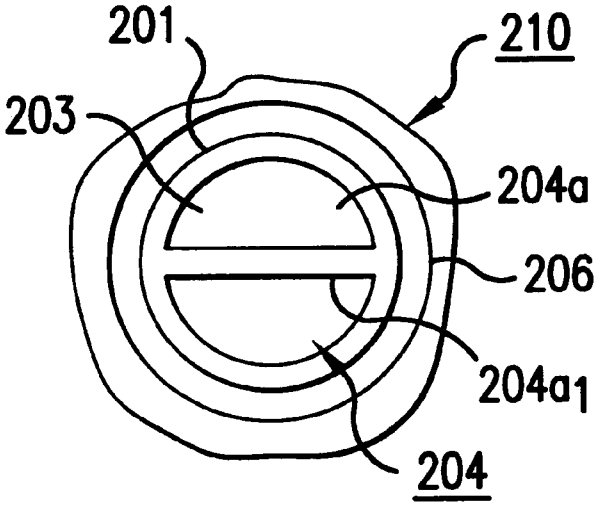

FIGS. 32 and 33 are front and right side views showing a mounted state of the main part of a toner container for a toner supplying device according to another embodiment of the present invention. In this embodiment, a circularly recessed part 204a and a rib 204a1 placed across the center of the recessed part 204a are provided as the handhold 204 at the other end part 203 of the toner container 200. According to such a handhold 204, the operator can grasp or hold the recessed part 204a and the rib 204a1 provided inside of the recessed part 204a upon attaching and detaching operations to the toner bank 210. This makes it possible to provide such a toner container 200 that can be attached to or detached from the toner bank 210 more easily and securely, and transported properly. Also, the toner container 200 is of compact structure and provides ease of storage without any projection, for use in a case where the toner filled therein has high fluidity and bulk density, and there is no difficulty in setting the toner container longitudinally.

Figure 34:
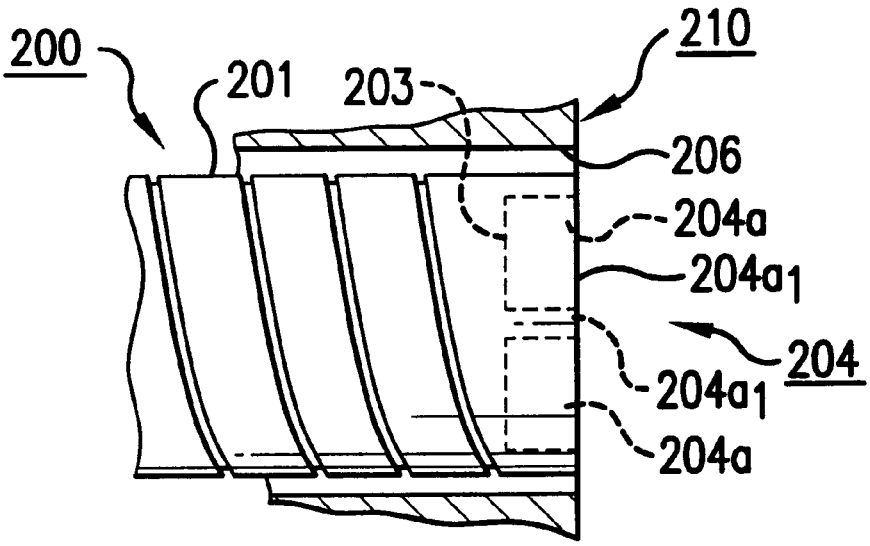
FIGS. 34 and 35 are front and right side views showing the main part of a toner container according to another embodiment of the present invention.
Figure 35:
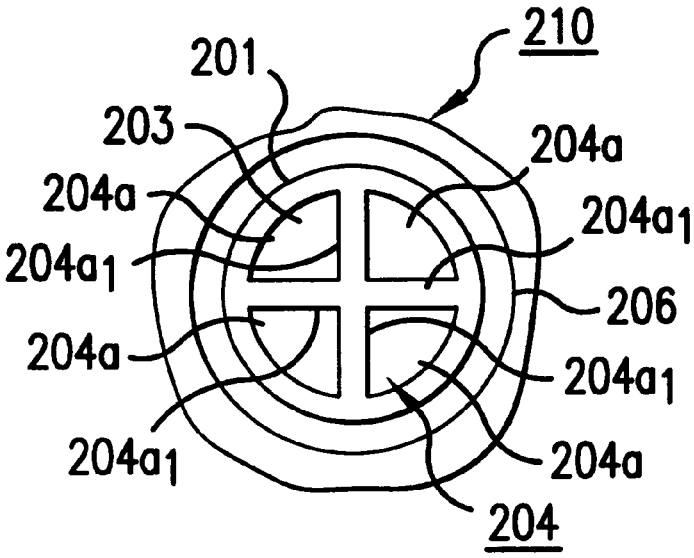

FIGS. 34 and 35 are front and right side views showing a mounted state of the main part of a toner container according to other embodiment of the present invention. In this embodiment, the handhold 204 is constructed such that two ribs 204*a*1 crossing each other are provided inside of a circularly recessed part 204*a* formed at the other end part 203 of the toner container 200. According to the embodiment, the operator can grasp or hold the recessed part 204*a* of the handhold 204 and the plural crossing ribs 204*a*1 provided inside of the recessed part 204*a* upon attaching and detaching operations to the toner bank 210. This makes it possible to further improve attaching and detaching operability to the toner bank 210 to ensure easy and secure operations, and also provide such a toner container 200 that it can be transported properly and stored easily and durably because of absence of the projection.

Figure 36:
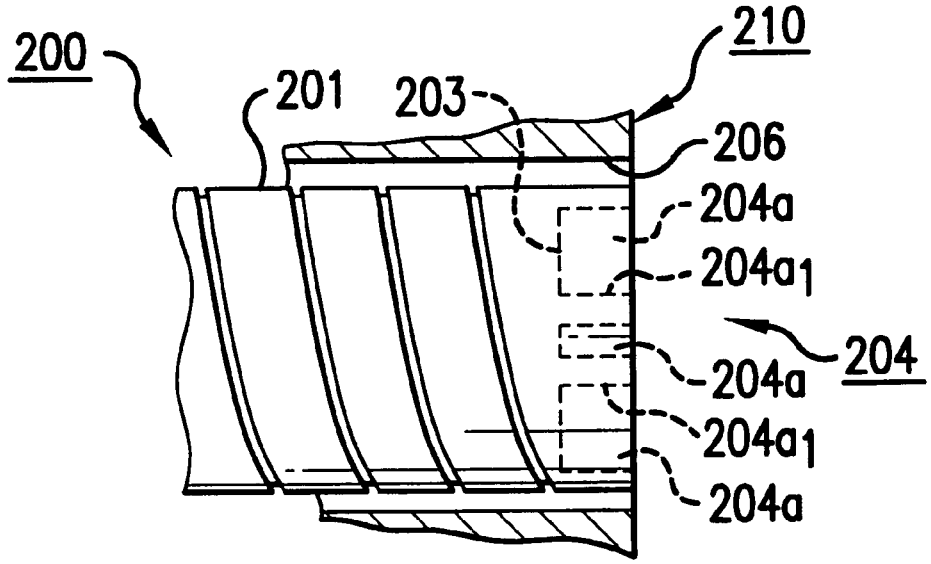
FIGS. 36 and 37 are front and right side views showing the main part of a toner container according to another embodiment of the present invention.
Figure 37:
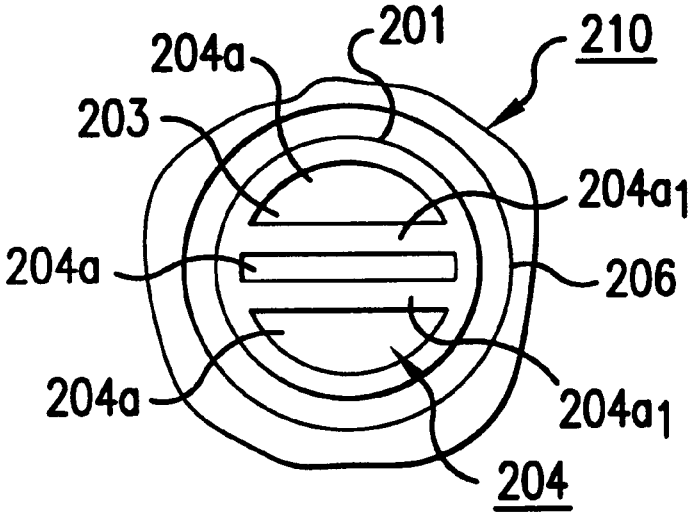

FIGS. 36 and 37 are front and right side views showing a mounted state of the main part of a toner container according to another embodiment of the present invention. The handhold 204 of this embodiment is constructed such that two parallel ribs 204*a*1 are provided inside of a recessed part 204*a* formed at the other end part 203 of the toner container 200. According to this embodiment, the operator can grasp or hold the recessed part 204*a* of the handhold 204 and the plural parallel ribs 204*a*1 provided inside of the recessed part 204*a* upon attaching and detaching operations to the toner bank 210.

Figure 38:
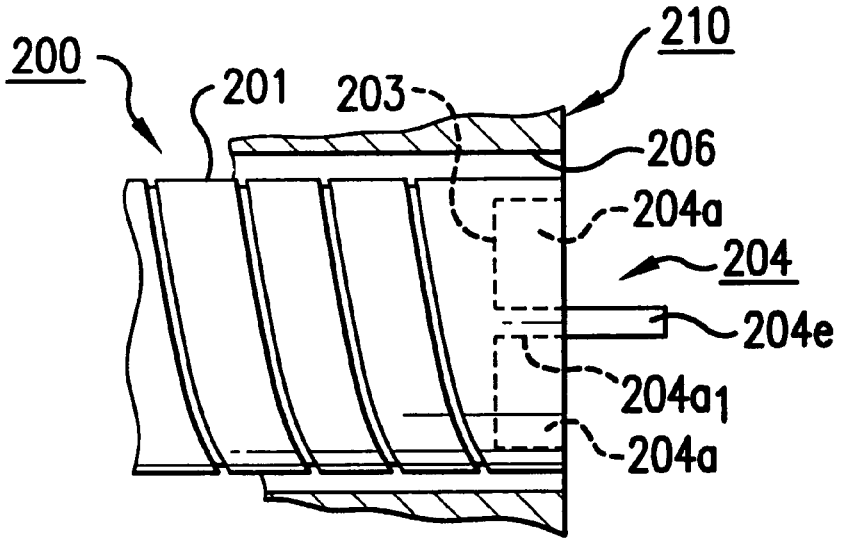
FIGS. 38 and 39 are front and right side views showing the main part of a toner container according to another embodiment of the present invention.
Figure 39:
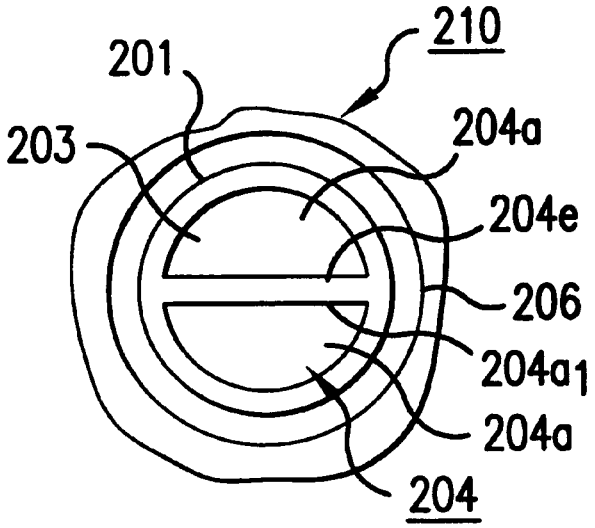

FIGS. 38 and 39 are front and right side views showing a mounted state of a toner container according to another embodiment. The handhold 204 of this embodiment is constructed of a recessed part 204*a* provided at the other end part 203 of the toner container 200 and a projected strip like rib 204*a*1 provided inside of the recessed part 204*a*. Integrated with the rib 204*a*1, is a longitudinal setting prevention part 204*e* projecting from the other end part 203 of the container 200. Accordingly, the operator can grasp or hold the recessed part 204*a* and the rib 204*a*1 provided inside of the recessed part 204*a* upon attaching and detaching operations to the toner bank 210. The longitudinal setting prevention part 204*e* inhibits the toner container body 201 from being set longitudinally, i.e., vertically or in a standing position.

Figure 40:
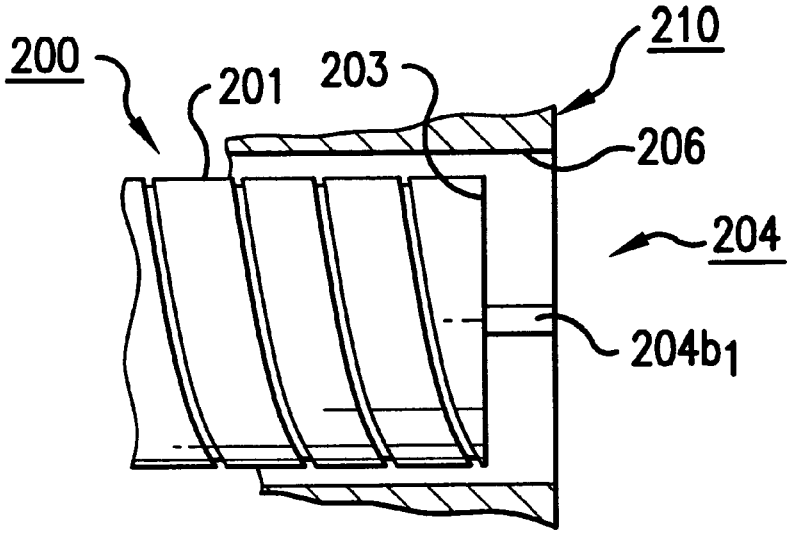
FIGS. 40 and 41 are front and right side views showing the main part of a toner container according to another embodiment of the present invention.
Figure 41:
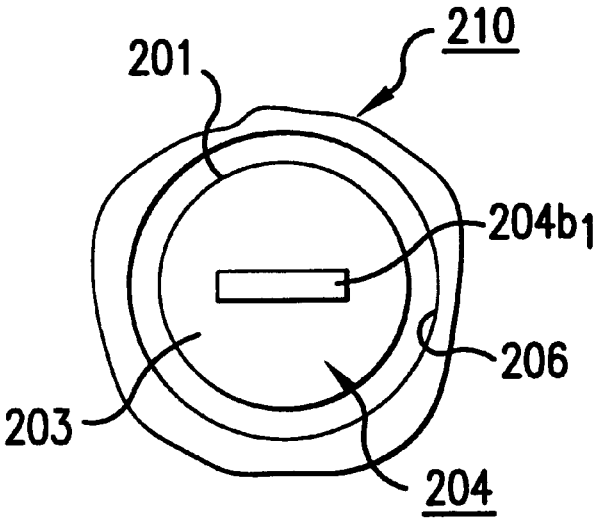

FIGS. 40 and 41 are front and right side views showing a mounted state of a toner container according to another embodiment. The handhold 204 of this embodiment is a rib 204*b*1 as a projected part 204*b* projecting above the center of the flat outside surface of the other end part 203 of the toner container 200. Accordingly, the operator can grasp or hold the rib 204*b* 1 of the projected part 204*b* as the handhold 204 upon attaching and detaching operations to the toner bank 210. The rib 204*b*1 of the projected part 204*b* inhibits the toner container body 201 from being set longitudinally, i.e., vertically or in a standing position.

Figure 42:
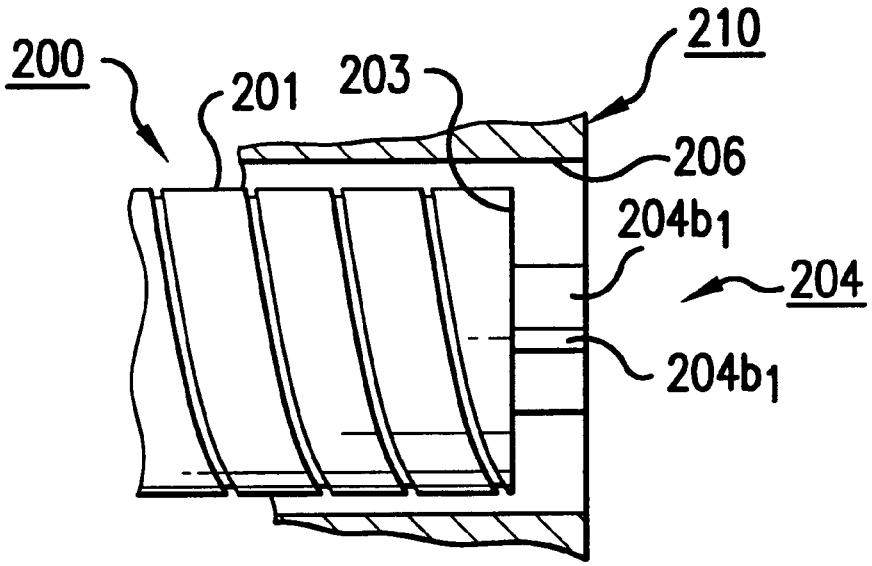
FIGS. 42 and 43 are front and right side views showing the main part of a toner container according to another embodiment of the present invention.
Figure 43:
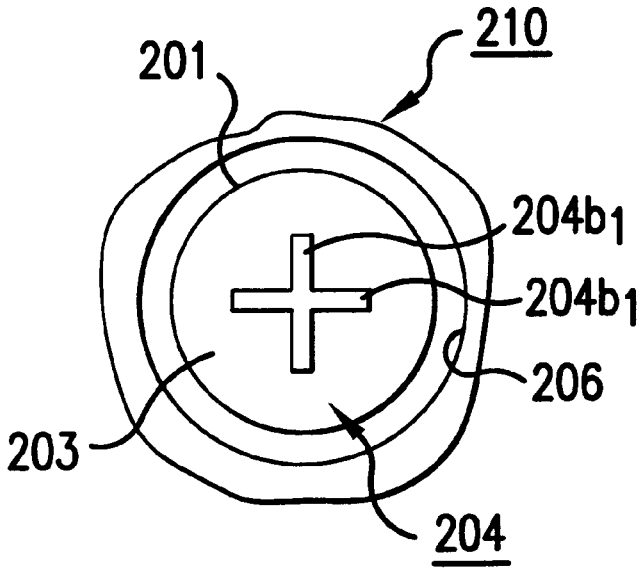

FIGS. 42 and 43 are front and right side views showing a mounted state of a toner container according to another embodiment. The handhold 204 of this embodiment is constructed of two ribs 204*b*1 crossing each other and projecting above the center of the outside surface (flat surface) of the other end part 203 of the toner container 200. Accordingly, the operator can grasp or hold the plural crossing ribs 204*b*1 of the projected part 204*b* as the handhold 204 upon attaching and detaching operations to the toner bank 210. The ribs 204*b*1 inhibits the toner container body 201 from being set longitudinally, i.e., vertically or in a standing position.

Figure 44:
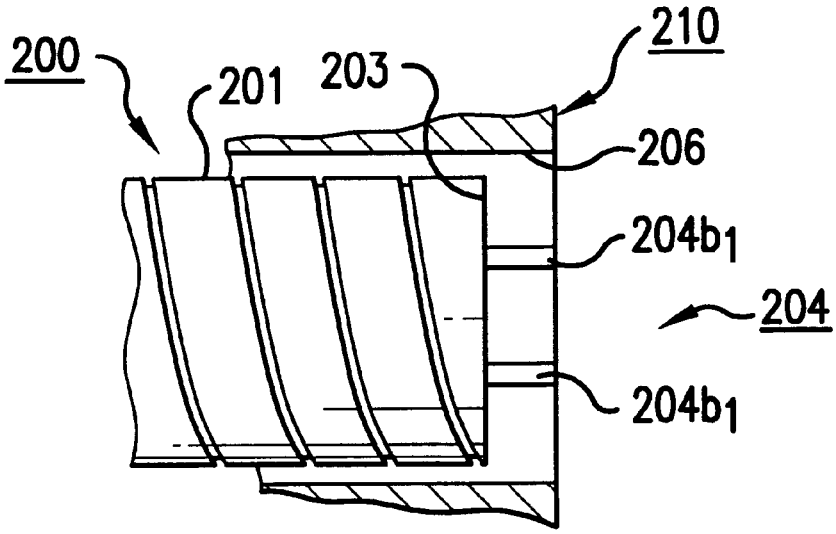
FIGS. 44 and 45 are front and right side views showing the main part of a toner container according to another embodiment of the present invention.
Figure 45:
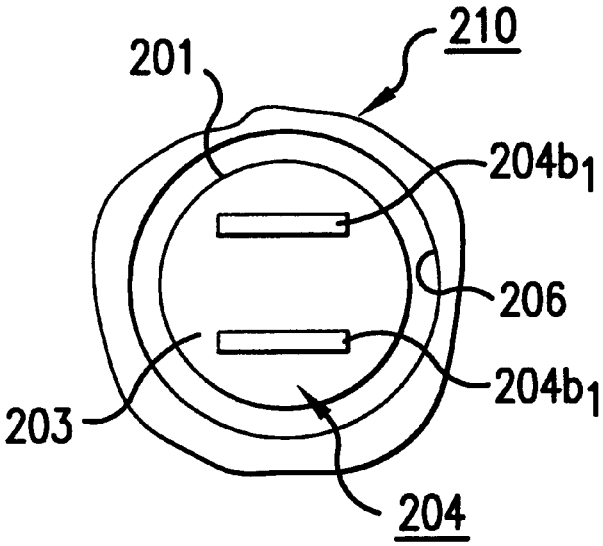

FIGS. 44 and 45 are front and right side views showing a mounted state of a toner container according to another embodiment. The handhold 204 of this embodiment is constructed of two strip-like parallel ribs 204*b*1 projecting above the center of the flat outside surface of the other end part 203 of the toner container 200. Accordingly, the operator can grasp or hold the ribs 204*b*1 upon attaching and detaching operations to the toner bank 210. The ribs 204*b*1 projecting from the flat surface 203 inhibits the toner container body 201 from being set longitudinally, i.e., vertically or in a standing position.

Figure 46:
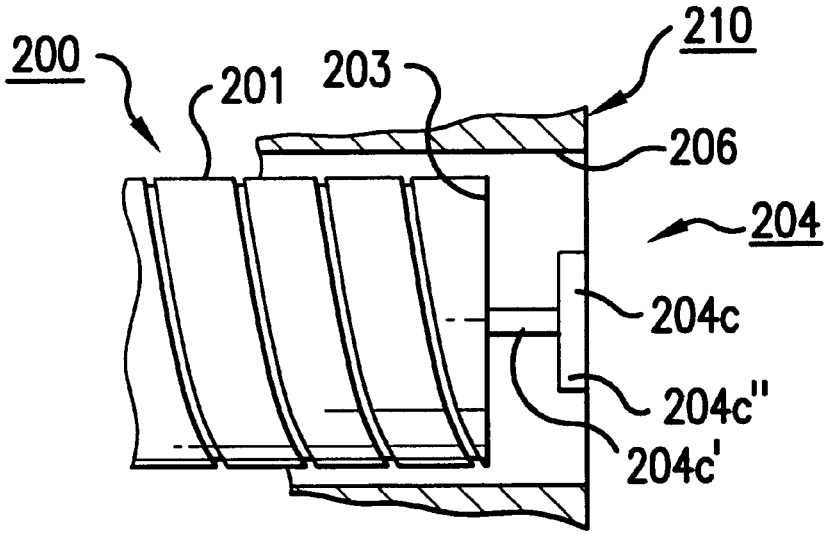
FIGS. 46 and 47 are front and right side views showing the main part of a toner container according to another embodiment of the present invention.
Figure 47:
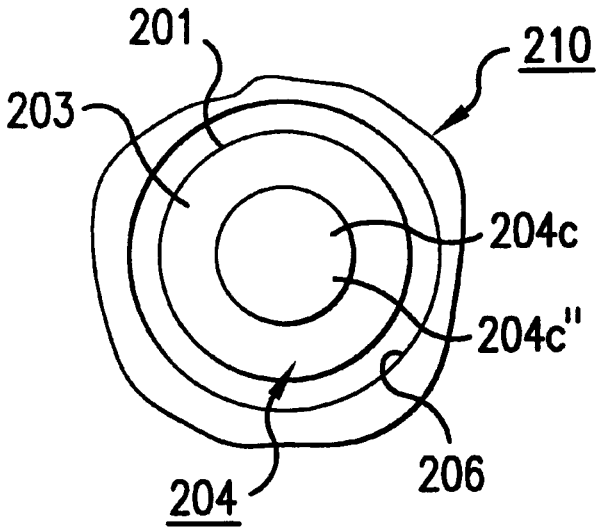

FIGS. 46 and 47 are front and right side views showing a mounted state of a toner container according to another embodiment. The handhold 204 of this embodiment is a knob 204*c* projecting above the center of the flat outside surface of the other end part 203 of the toner container 200. The knob 204*c* is composed of a rod-like projection 204*c*' and a disk-like part 204*c*". Accordingly, the operator can grasp or hold the knob 204*c* of the handhold 204 upon attaching and detaching operations to the toner bank 210.

Figure 50:
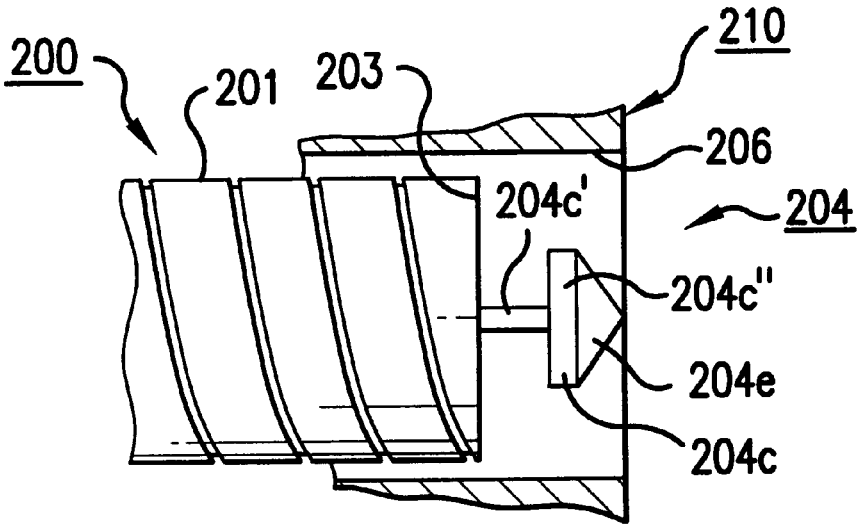
FIGS. 50 and 51 are front and right side views showing a toner container according to another embodiment of the present invention.
Figure 51:
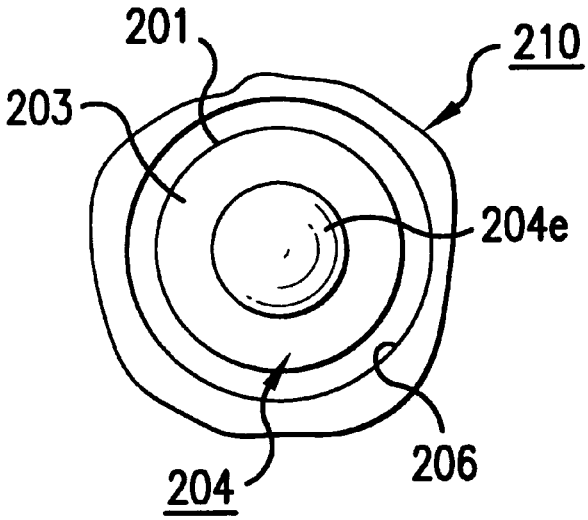

FIGS. 50 and 51 are front and right side views showing a mounted state of a toner container according to another embodiment. The handhold 204 of this embodiment is constructed of a knob 204*c* projecting above the center of the flat outside surface of the other end part 203 of the toner container 200, and a projected (cone-like) longitudinal setting prevention part 204*e* provided on a disk-like part 204*c*" of the knob. Accordingly, the operator can grasp or hold the knob 204*c* of the handhold 204 upon attaching and detaching operations to the toner bank 210. The projected (cone-like) longitudinal setting prevention part 204*e* inhibits the toner container body 201 from being set longitudinally, i.e., vertically or in a standing position.

Figure 48:
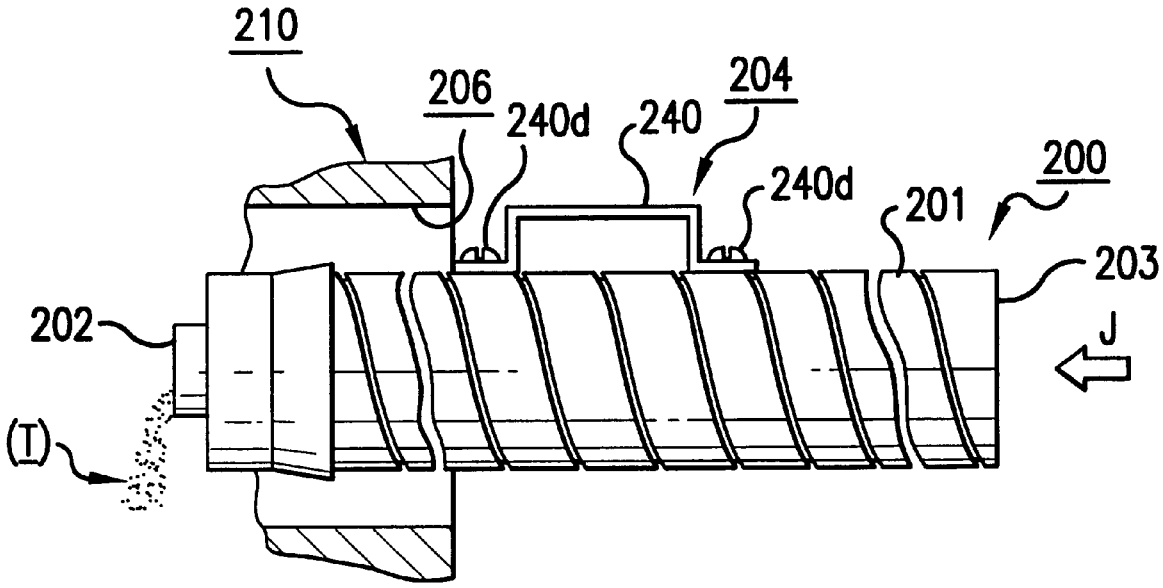
FIGS. 48 and 49 are front and right side views showing the main part of a toner container according to another embodiment of the present invention.
Figure 49:
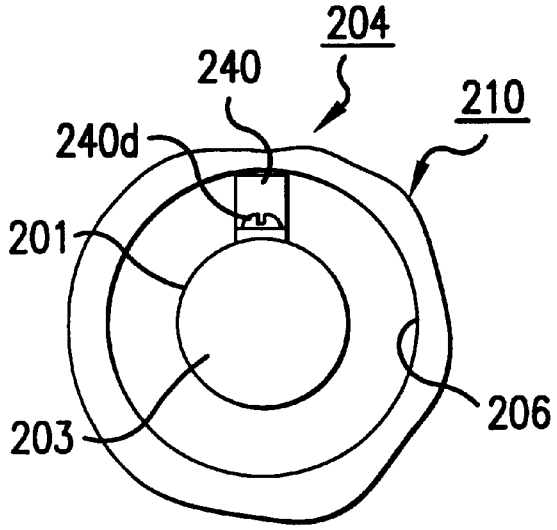

FIGS. 48 and 49 are front and right side views of a toner container according to another embodiment, illustrating as mounted into a toner bank. The toner container 200 is inserted in the toner bank 210, which can detachably mount plural toner containers, from the toner container inserting inlet 206 provided on the front of the toner bank 210. Toner (T) stored inside of a cylindrical toner container body 201 is discharged from an opening 202 provided axially at one end of the toner container body 201.

The other end (wall) 203 of the toner container body 201, opposite to the opening 202, is closed, and a handhold 204 is provided on the outer surface of the toner container body 201. The handhold 204 of this embodiment is fastened with screws on the outer surface of the toner container body 201. The handhold 204 may be molded out of resin as one unit with the toner container body 201 without screws for the purpose of reducing the cost.

According to the toner container of this embodiment, the operator can hold the handhold 204 for ease of attaching and detaching operations to the toner bank 210 even when the toner container body 201 attached to and detached from the toner bank 210 becomes large and hence heavy due to an increased amount of toner stored in the toner container body 201.

Figure 52:
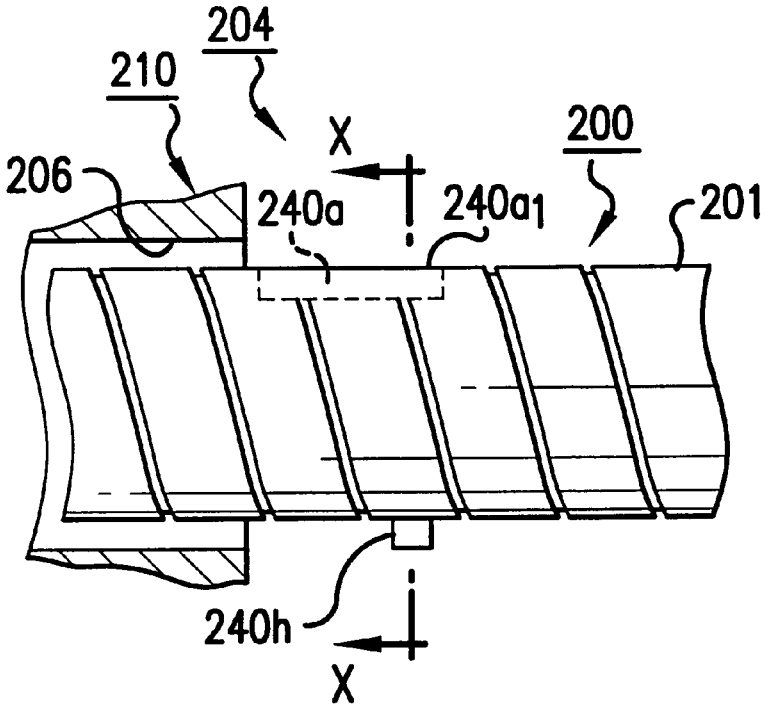
FIGS. 52 and 53 are front and cross-sectional views of a toner container according to another embodiment of the present invention.
Figure 53:
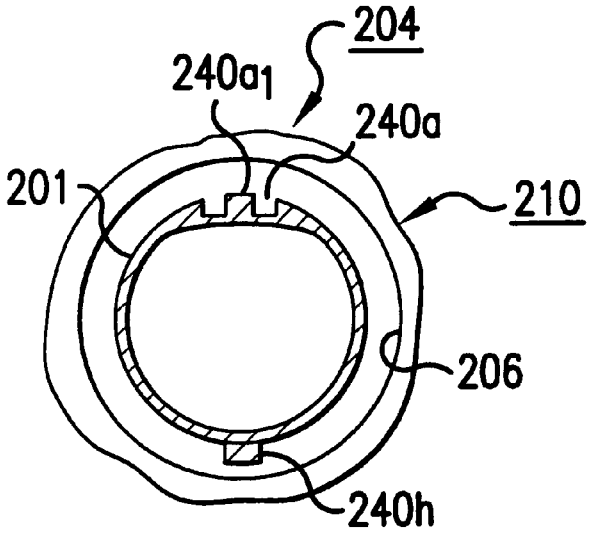

FIGS. 52 and 53 are front and X—X sectional views of a toner container according to another embodiment. The handhold 204 of this embodiment is constructed of a recessed part 240*a* provided on the outer surface of the toner container body 201 of the toner container 200 and a projected strip-like rib 240*a*1 provided inside of the recessed part 240*a*. Accordingly, the operator can grasp or hold the recessed part 240*a* of the handhold 204 and the rib 240*a*1 provided inside of the recessed part 240*a* upon attaching and detaching operations to the toner bank 210. This makes it possible to provide such a toner container 200 without any projection that it can further improve attaching and detaching operability to the toner bank 210 to ensure easy and secure operations, and its transportability.

A rolling prevention part 240*h* of projection type can also be provided on the outer side of the toner container body 201 of the toner container 200 so as to prevent the toner container 200 from rolling even when left on a plane or a slightly inclined plane.

Figure 54:
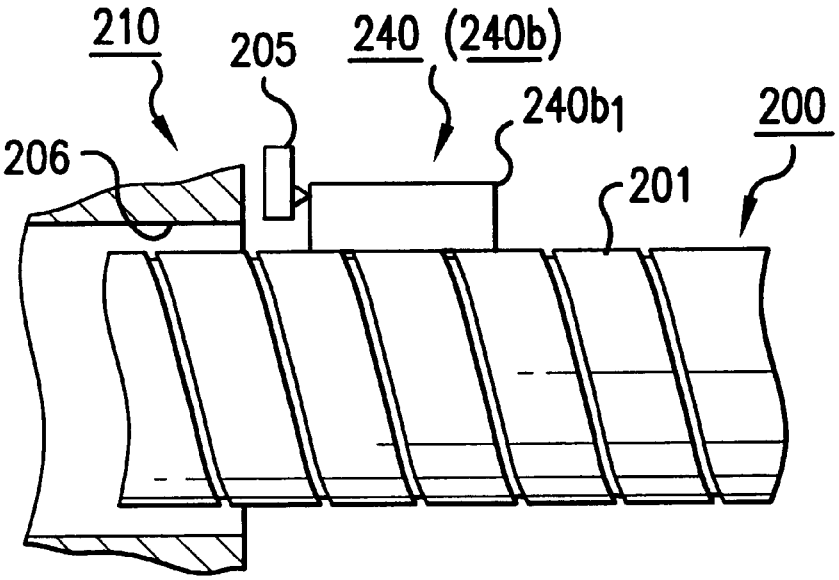
FIGS. 54 and 55 are front and right side views showing the main part of a toner container according to another embodiment of the present invention.
Figure 55:
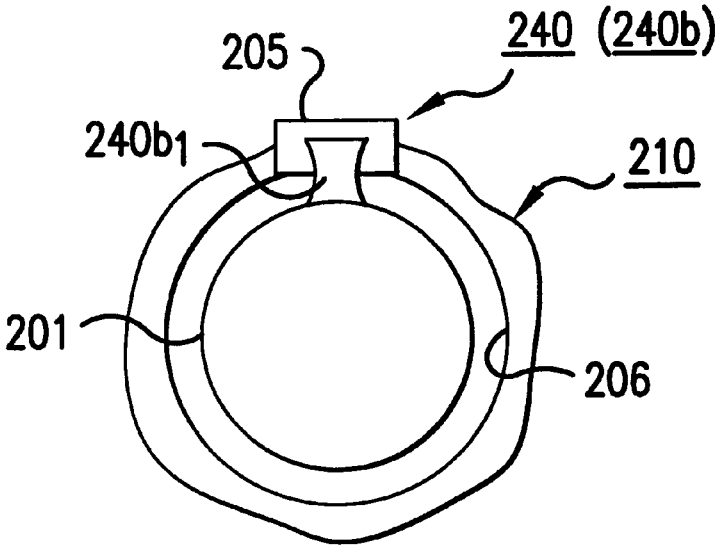

FIGS. 54 and 55 are front and side views of a toner container according to another embodiment. The handhold 240 of this embodiment is a rib 240*b*1 as a projected part 240*b* provided on the outer surface of the toner container body 201 of the toner container 200. In this case, further, a detection device 205, or a reflection type photosensor, for accumulating the number of rotations of the toner container body 201 is arranged on the toner bank side so that the rib 240*b*1 will be detected. When the rib 240*b*1 is rotated, light projected from a light emitting element in the detection device 205 is reflected by the rib 240*b*1 and incident on a light receiving element. Thus, the detection device 205 obtains information on the rotation of the toner container body 201. The input information is then input to a control unit, not shown. Accordingly, the operator can grasp or hold the rib 240*b*1 of the projected part 240*b* upon attaching and detaching operations to the toner bank 210. Also, the rib 240*b*1 inhibits rolling of the toner container 200. It is therefore possible to provide such a toner container 200 that it can be attached to and detached from the toner bank 210 easily and securely, transported properly, prevented from rolling even when left on a plane or a slightly inclined plane. Further, the number of rotations of the toner container 200 can be accurately detected with a low-cost mechanism on a part of the toner bank 210.

Also, the handhold 240 projecting from the outer side inhibits the toner container body 201 from rolling, and this makes it possible to provide such a toner container 200 that it can be attached to or detached from the toner bank 210 easily and securely, transported properly, and further prevented from rolling even when left on a plane or a slightly inclined plane.

Figure 56:
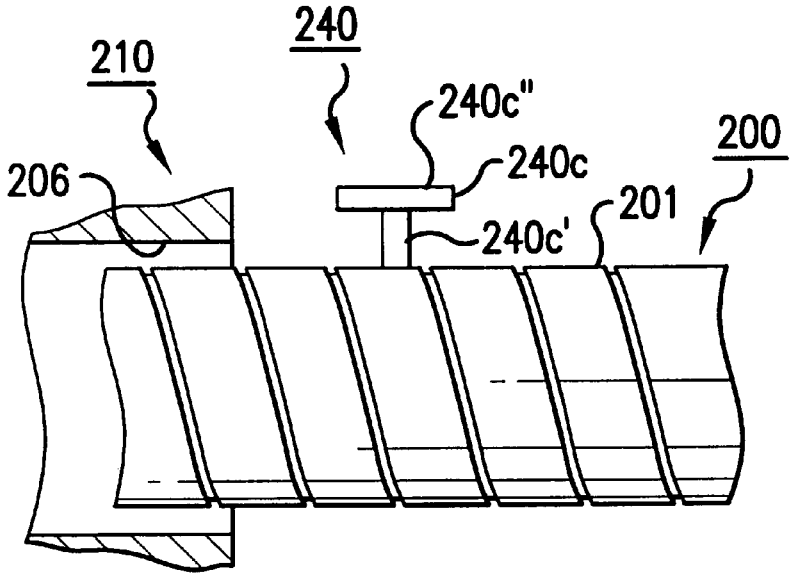
FIGS. 56 and 57 are front and right side views showing the main part of a toner container according to another embodiment of the present invention.
Figure 57:
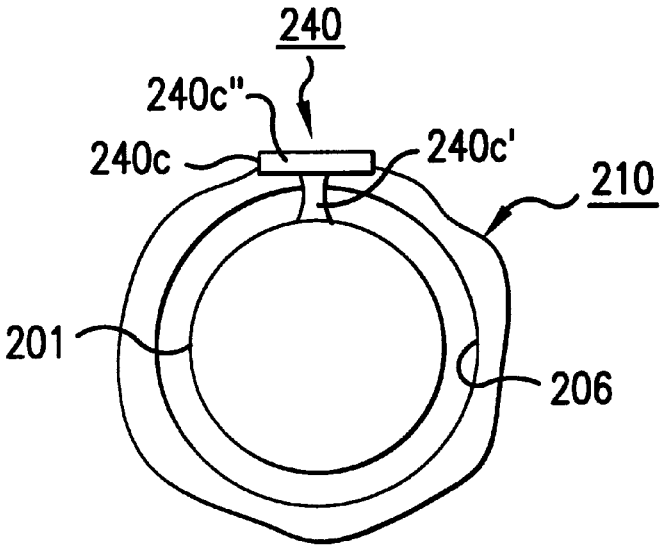

FIGS. 56 and 57 are front and side views of a toner container according to another embodiment. The handhold 240 of this embodiment is a knob 240*c* provided on the outer side of the toner container body 201 of the toner container 200. The knob 204*c* is composed of a rod-like part 204*c*' and a disk-like part 204*c*". Accordingly, the operator can grasp or hold the knob 204*c* of the handhold 240 upon attaching and detaching operations to the toner bank 210. Also, the knob 204*c* inhibits rolling of the toner container 200. It is therefore possible to provide such a toner container 200 that can be attached to and detached from the toner bank 210 easily and securely, transported properly, and further prevented from rolling even when left on a plane or a slightly inclined plane.

Figure 58:
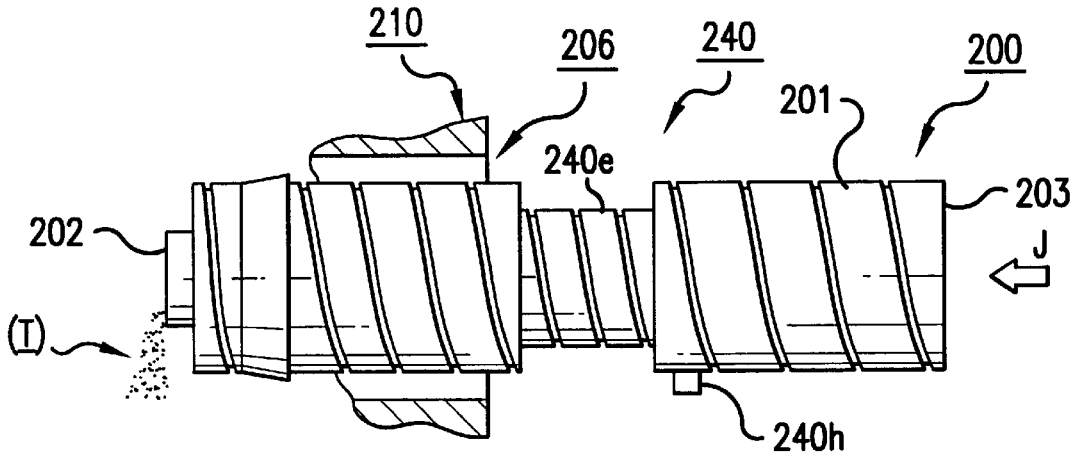
FIG. 58 is a side view and partial cross sectional of a toner container according to other embodiment of the present invention.

FIG. 58 is a view for explaining the construction of a toner container according to another embodiment of the present invention. The toner container 200 is inserted into the toner bank 210, which can detachably mount plural toner containers thereon, from the toner container inserting inlet 206 provided on the front of the toner bank 210. Toner (T) stored inside of a cylindrical toner container body 201 is discharged from an opening 202 provided axially at one end of the toner container body 201. The handhold 240 of this embodiment is a small diameter part 240*e* provided in the axial middle of the outer surface of the toner container body 201. The small diameter part 240*e* is set to such a predetermined diameter that the operator can hold by hand. The toner container body 201 has a step between the large diameter circumference and the circumference of the small diameter part 240*e*. The step is substantially perpendicular to the large diameter circumference and the circumference of the small diameter part 240*e*. Accordingly, the operator can grasp or hold the small diameter part 240*e* of the handhold 240 upon attaching and detaching operations to the toner bank 210. It is therefore possible to provide such a toner container 200 that it can be attached to and detached from the toner bank 210 easily and securely, transported properly, and of low-cost simple structure because of no need for a projection or new parts.

One or more rolling prevention parts 240*h* of projection type can also be provided on the outer side of the toner container body 201 of the toner container 200 so as to prevent the toner container 200 from rolling even when left on a plane or a slightly inclined plane.

Figure 59:
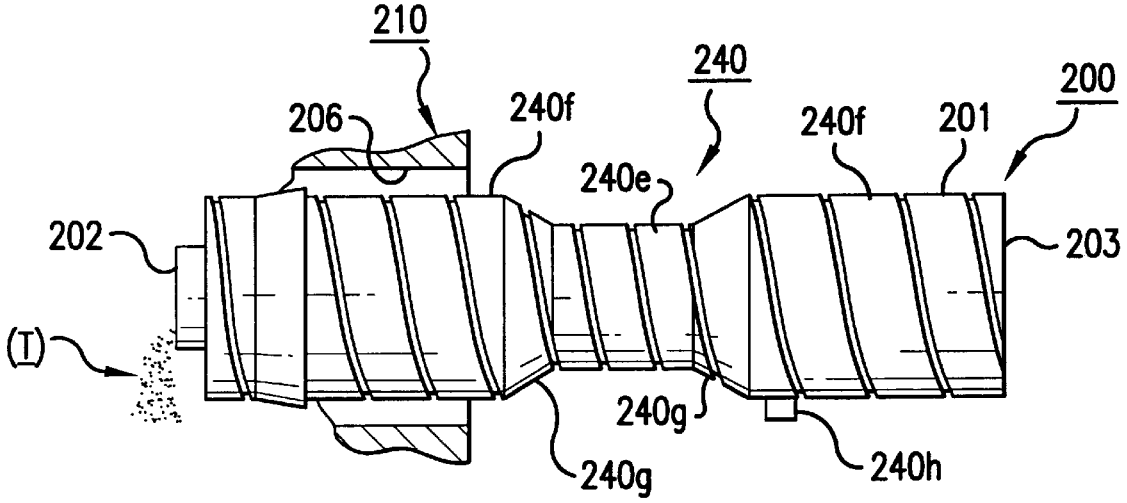
FIG. 59 is a side and partial cross sectional view of a toner container according to other embodiment of the present invention.
Figure 60:
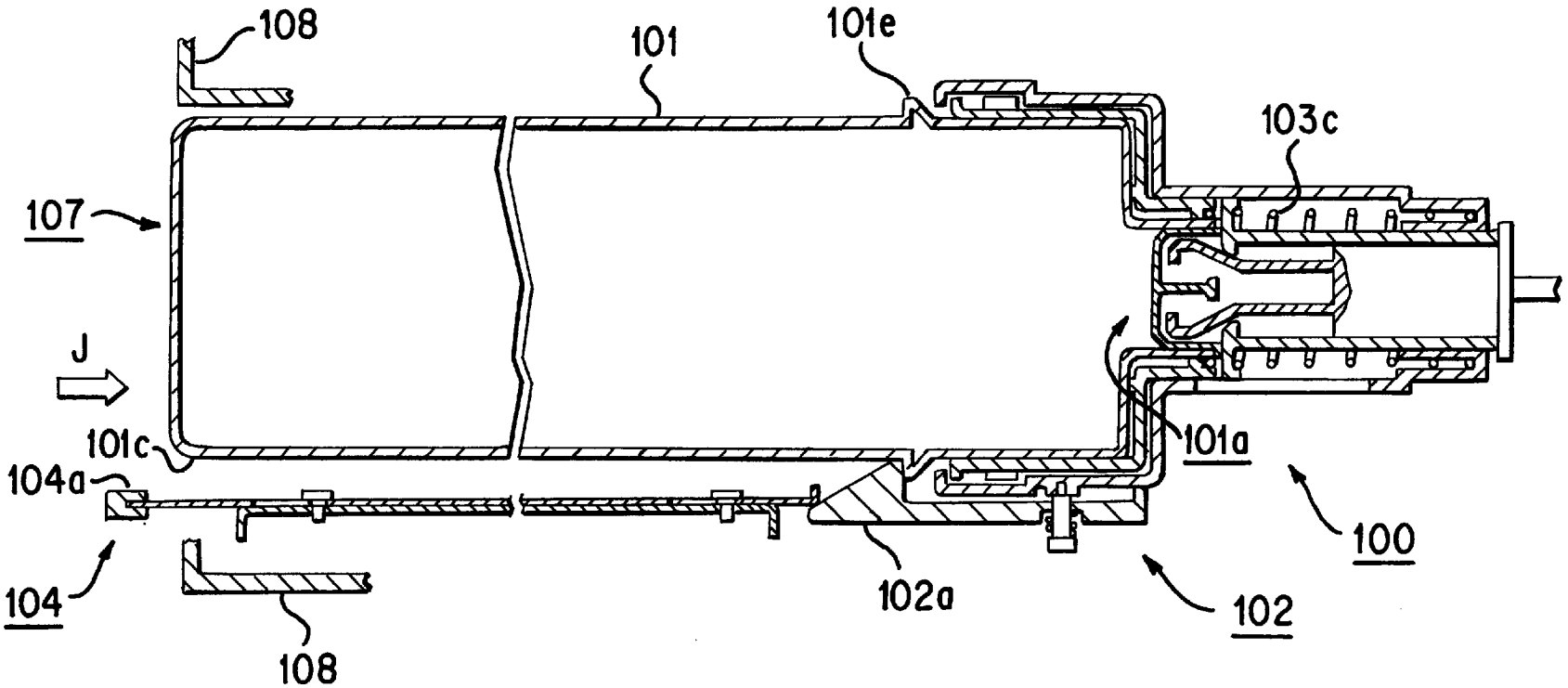
FIG. 60 PRIOR ART
FIG. 60 is a schematic drawing of a toner container attaching/detaching part of a related art toner supplying device.
Figure 61:
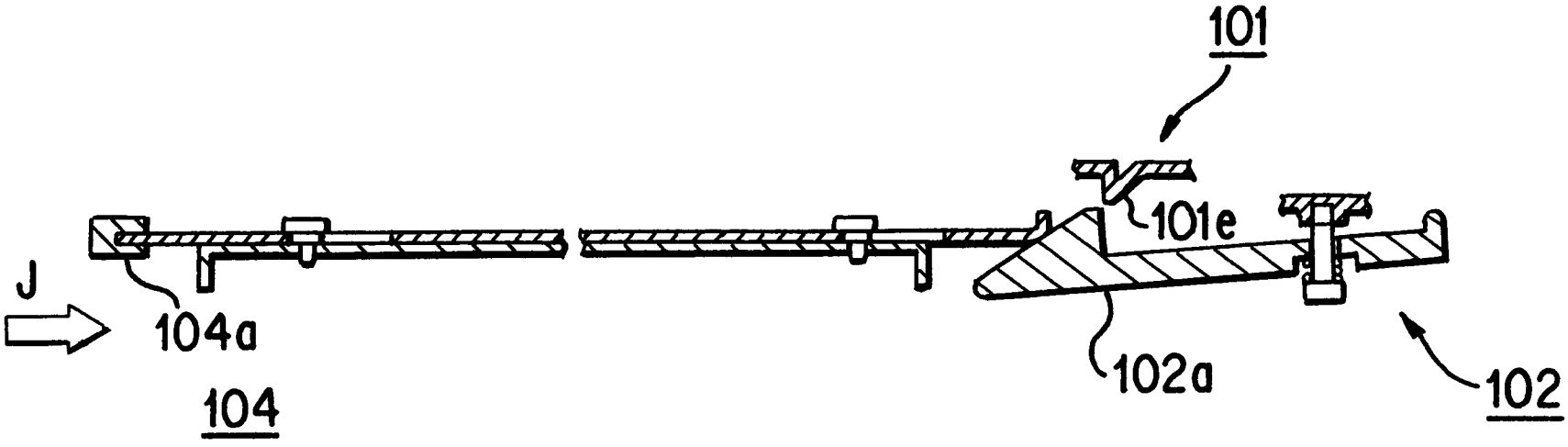
FIG. 61 PRIOR ART
FIG. 61 is a schematic drawing of a device of the related art toner supplying device for releasing a toner container from a state of being held by a toner container holder.
Figure 62:
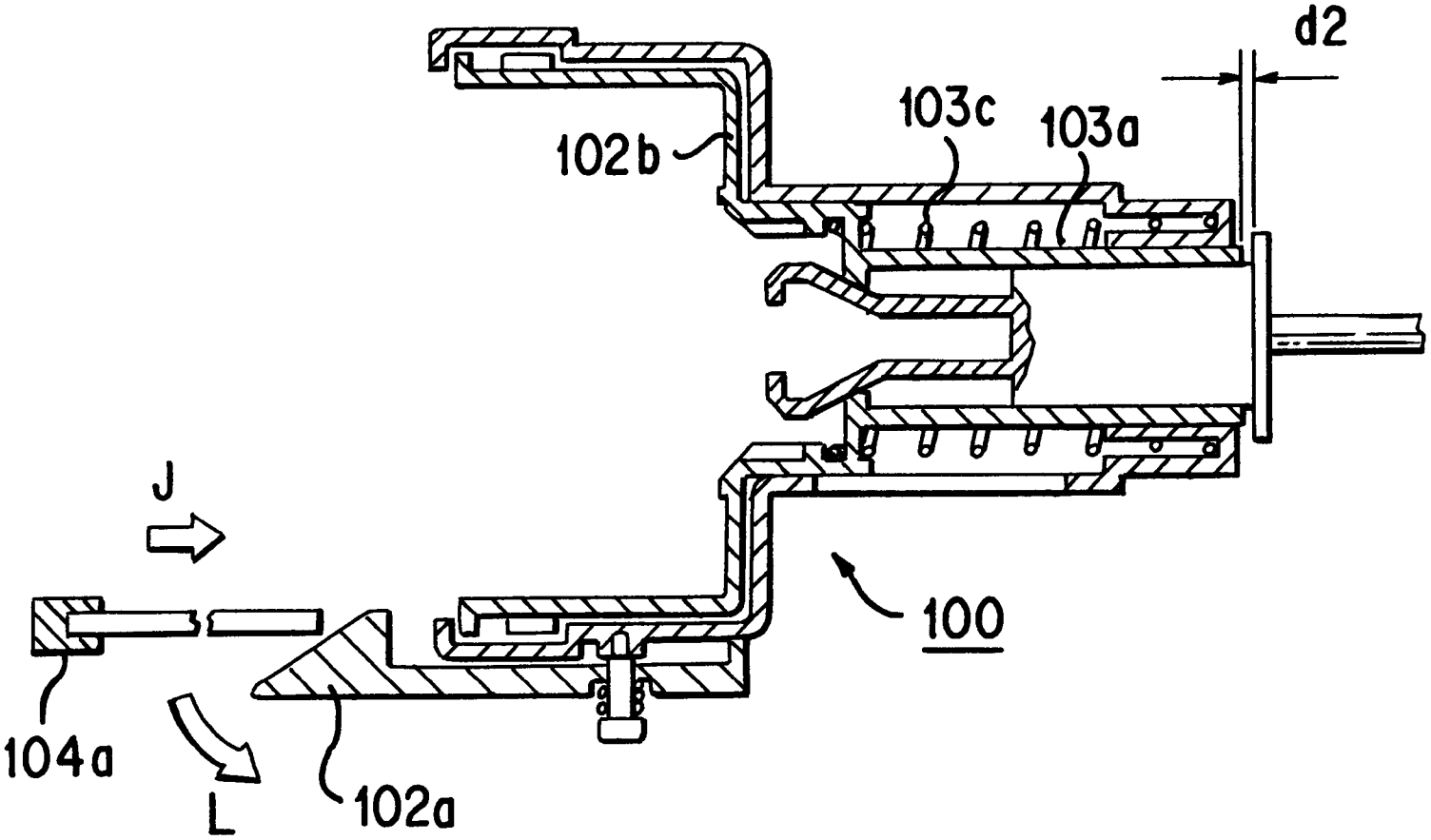
FIG. 62 PRIOR ART
FIG. 62 is a schematic drawing of a toner container that is removed from the toner container holder in the related toner supplying device by pushing a release lever of the device shown in FIG. 61 so as to open a stopper of the toner container holder.
Figure 63:
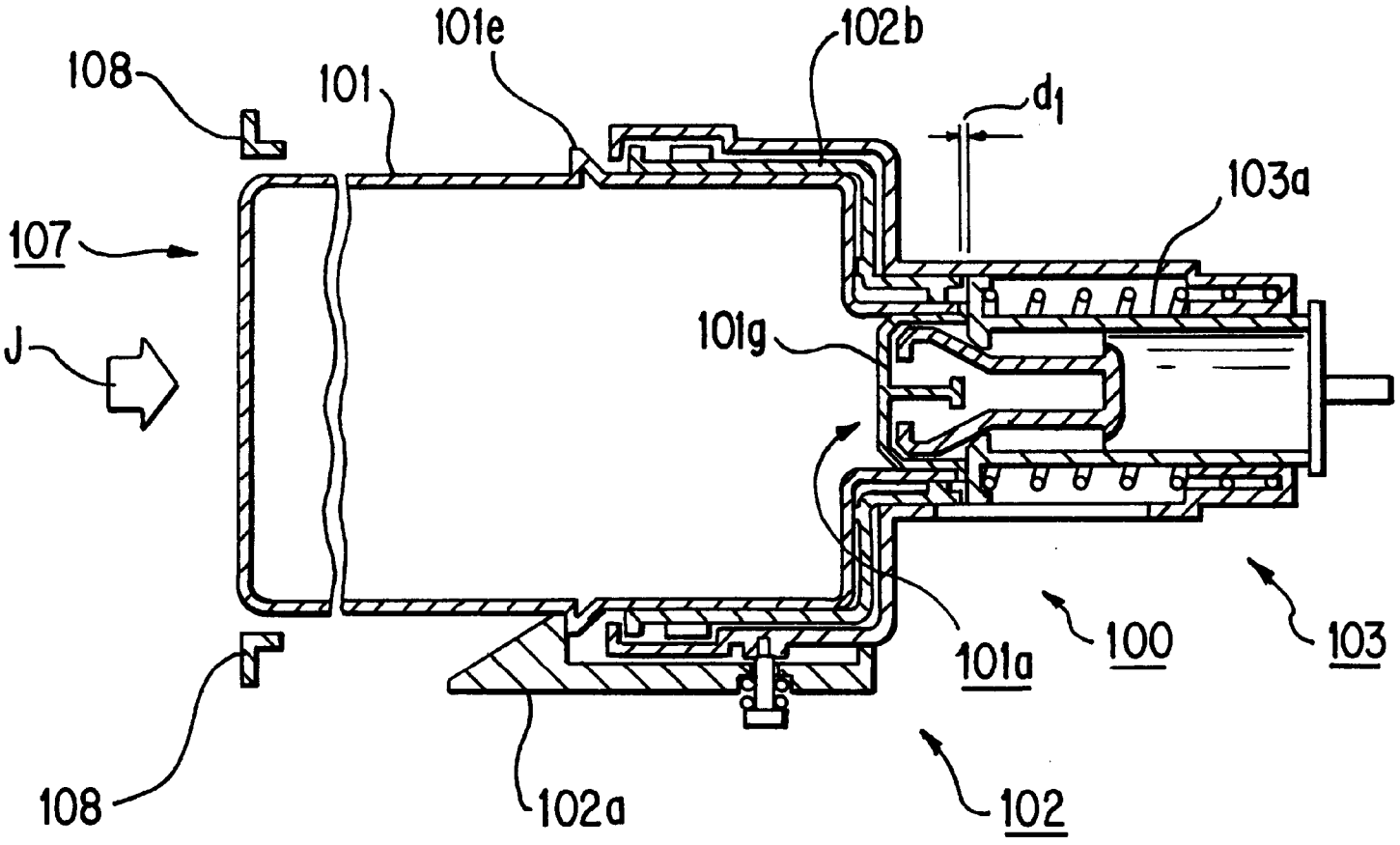
FIG. 63 PRIOR ART
FIG. 63 is a schematic drawing of a toner container that is inserted into a toner container insertion inlet and the stopper of the toner container holder engages with an engaging protrusion of the toner container in the related toner supplying device.
Figure 64:
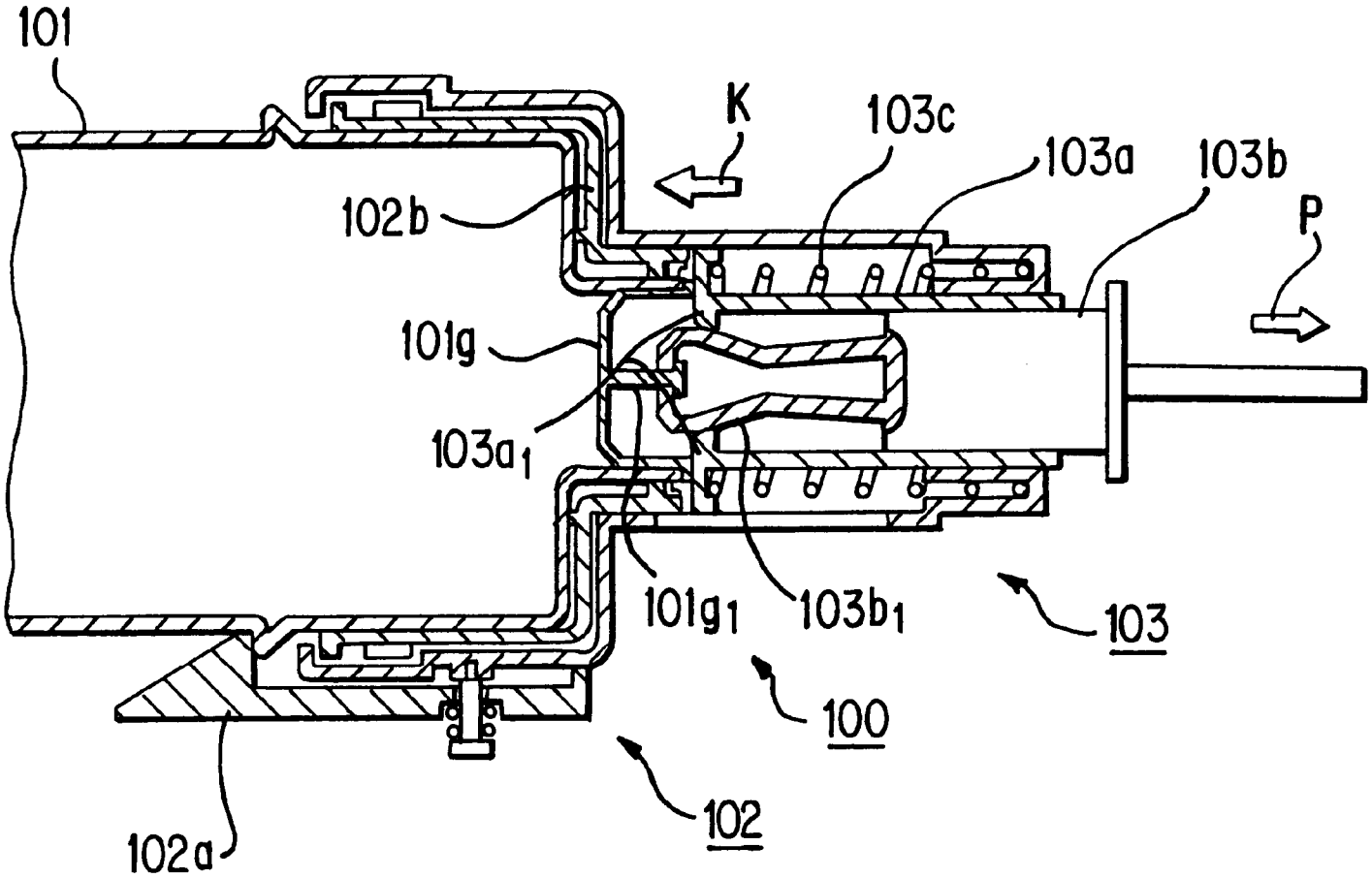
FIG. 64 PRIOR ART
FIGS. 64–69 are sectional drawings illustrating an operation of an open/close device of the related toner supplying device for opening/closing an opening portion of a toner container with a cap.
Figure 65:
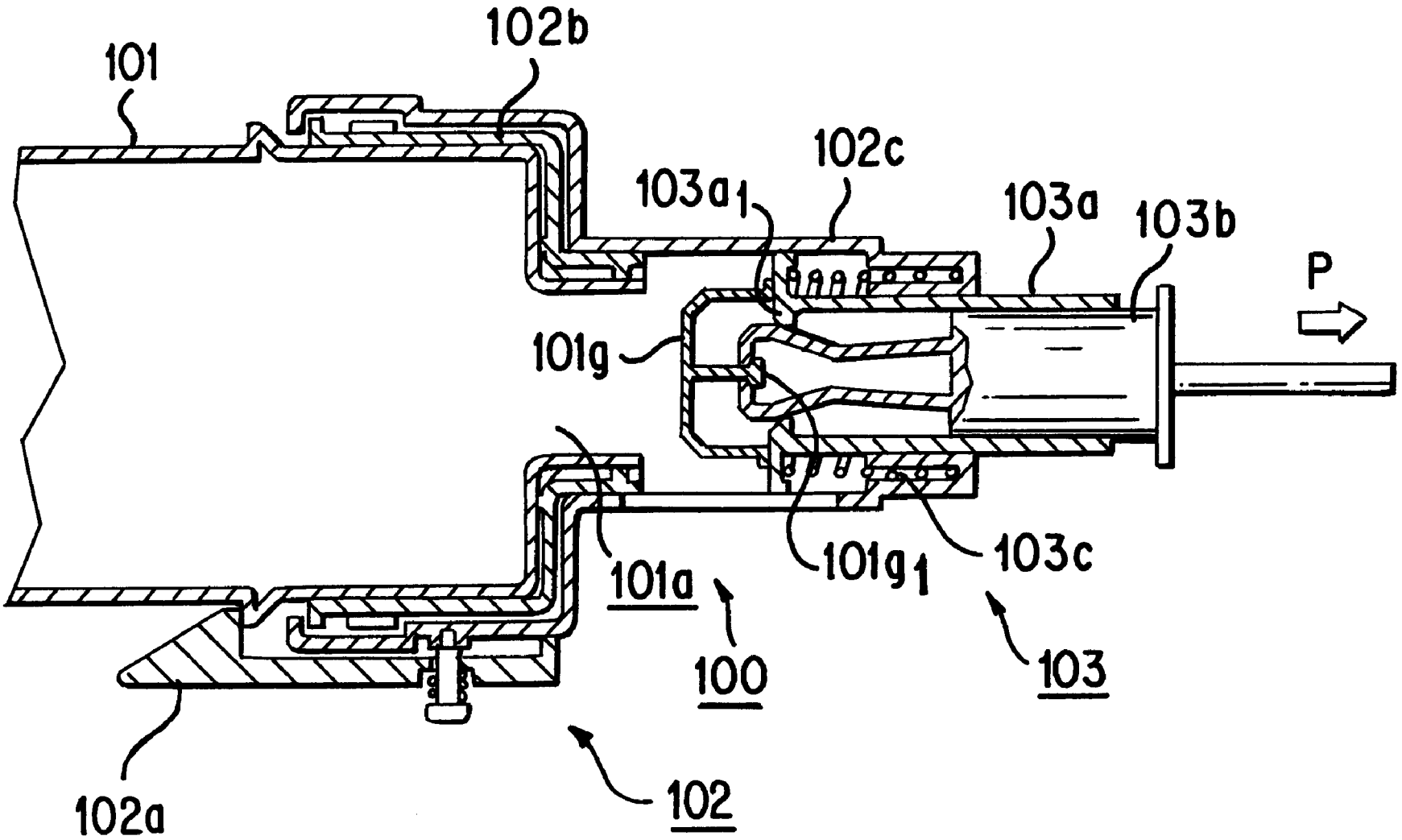
FIG. 65 PRIOR ART
Figure 66:
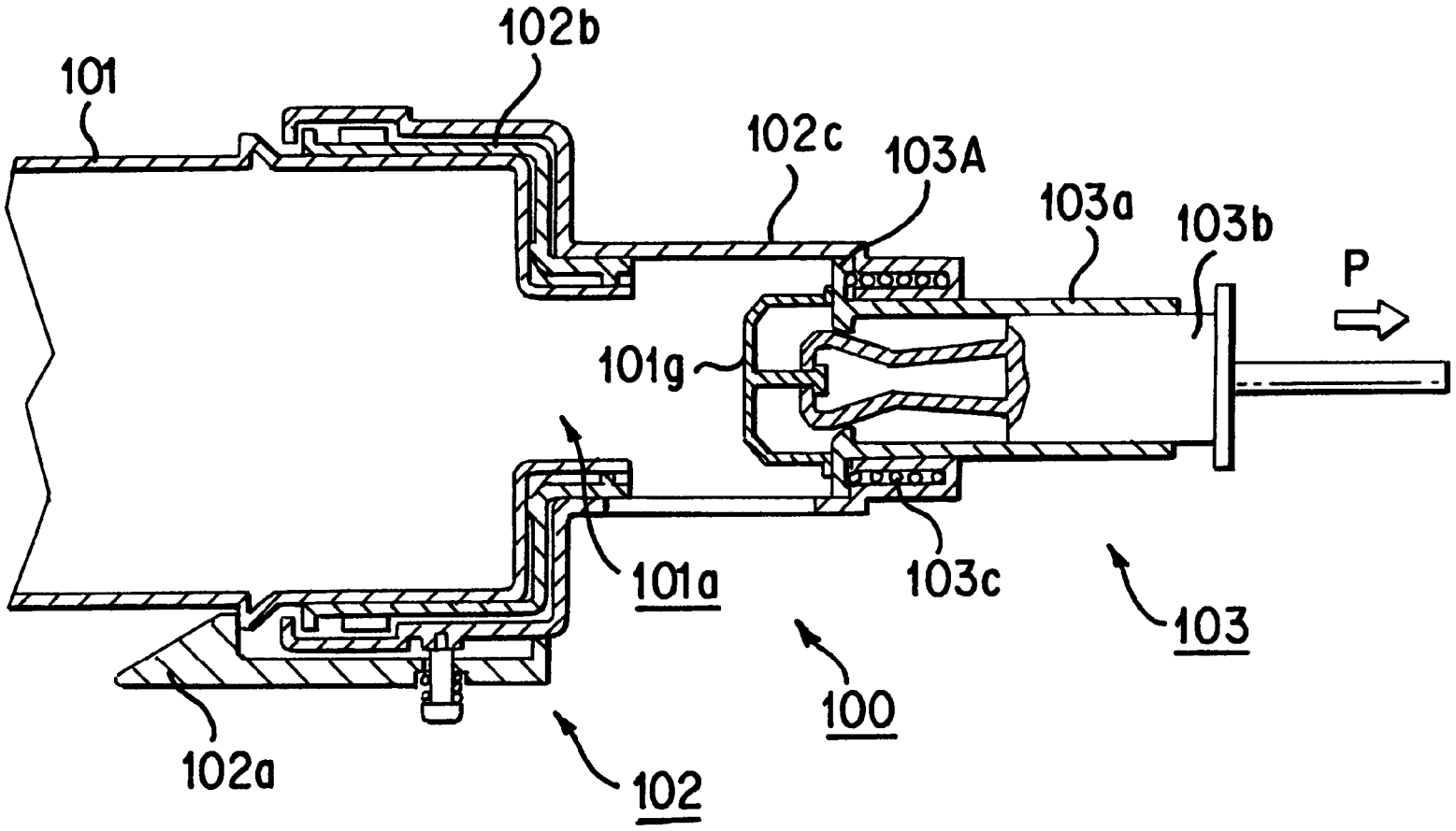
FIG. 66 PRIOR ART
Figure 67:
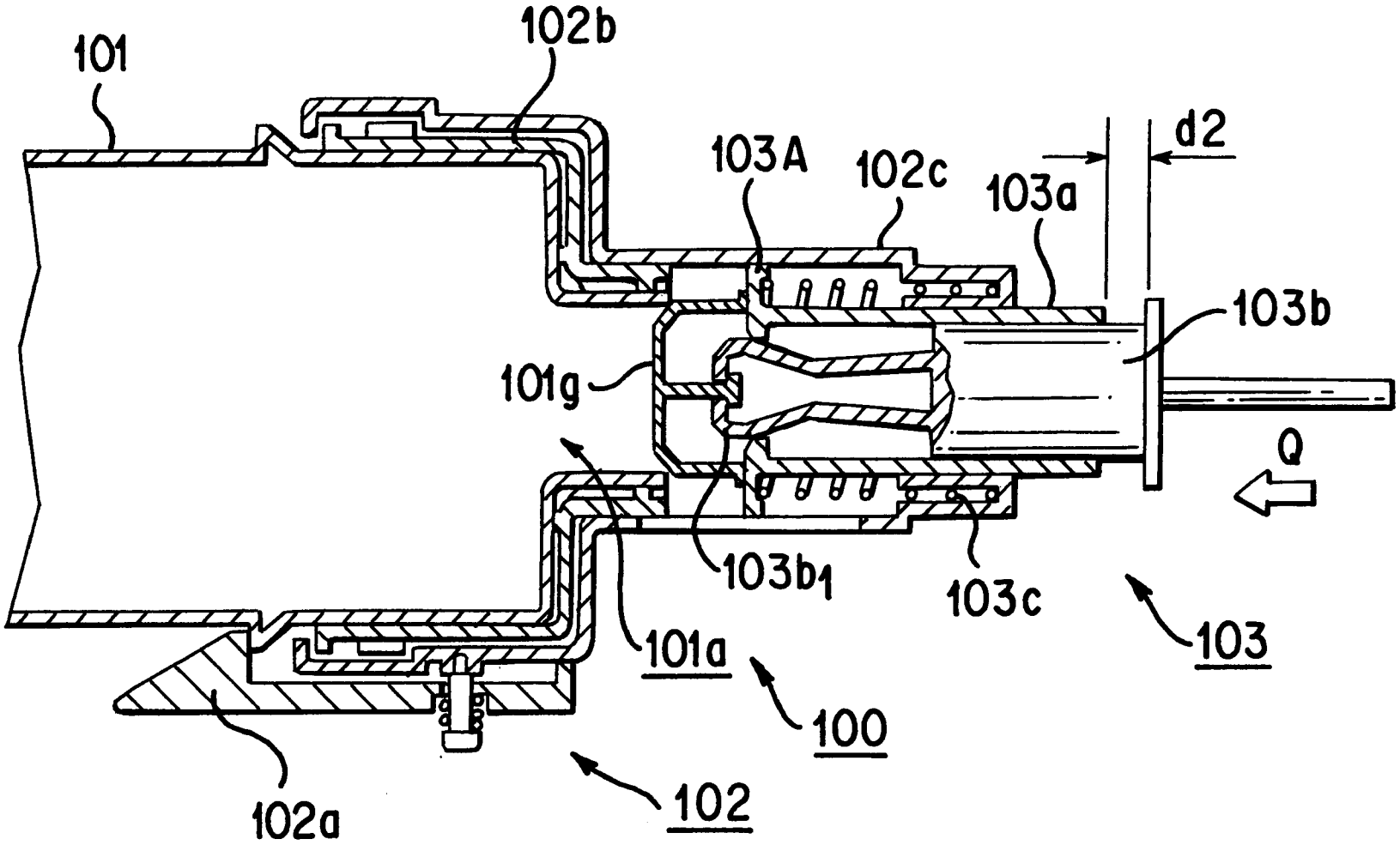
FIG. 67 PRIOR ART
Figure 68:
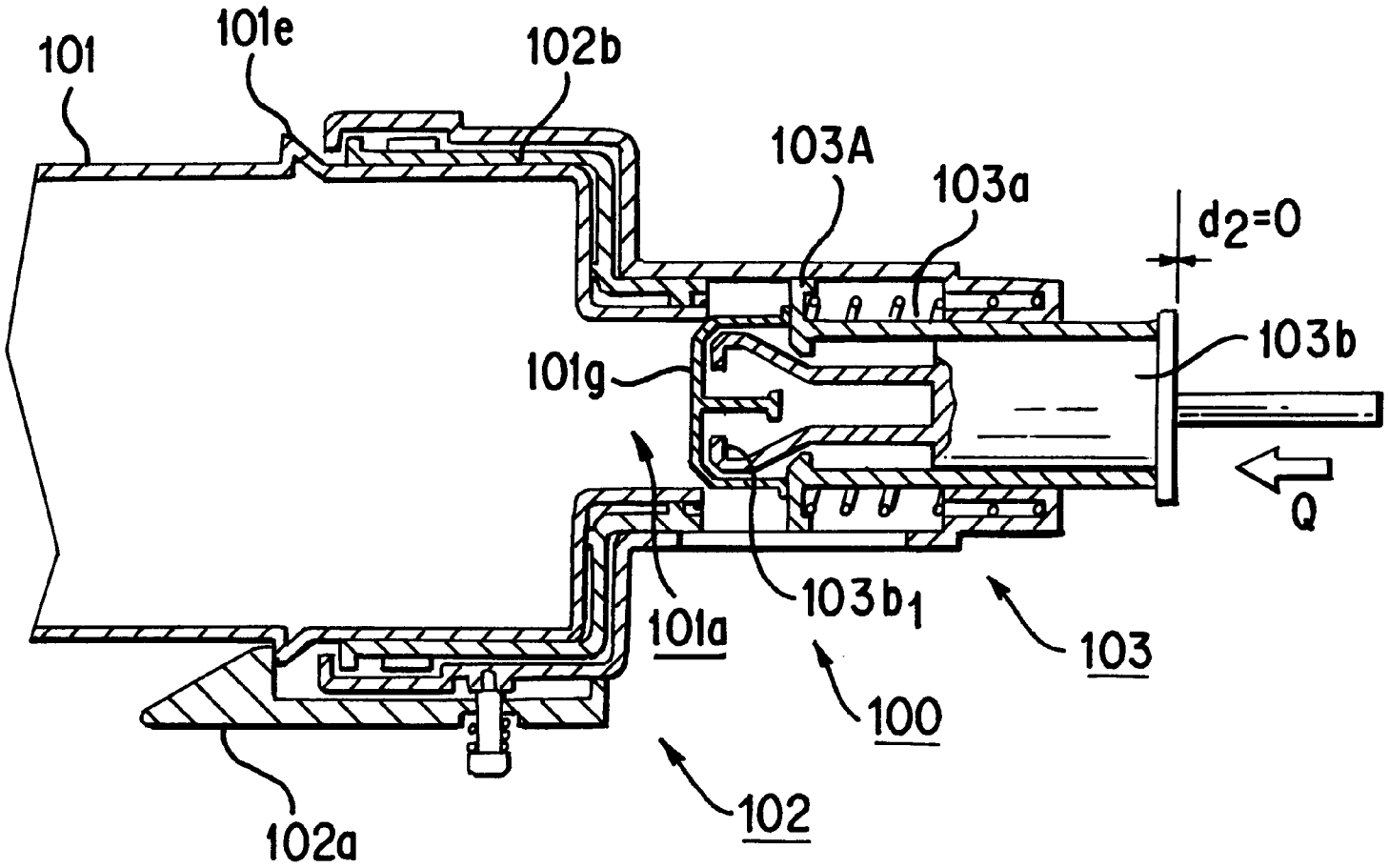
FIG. 68 PRIOR ART
Figure 69:
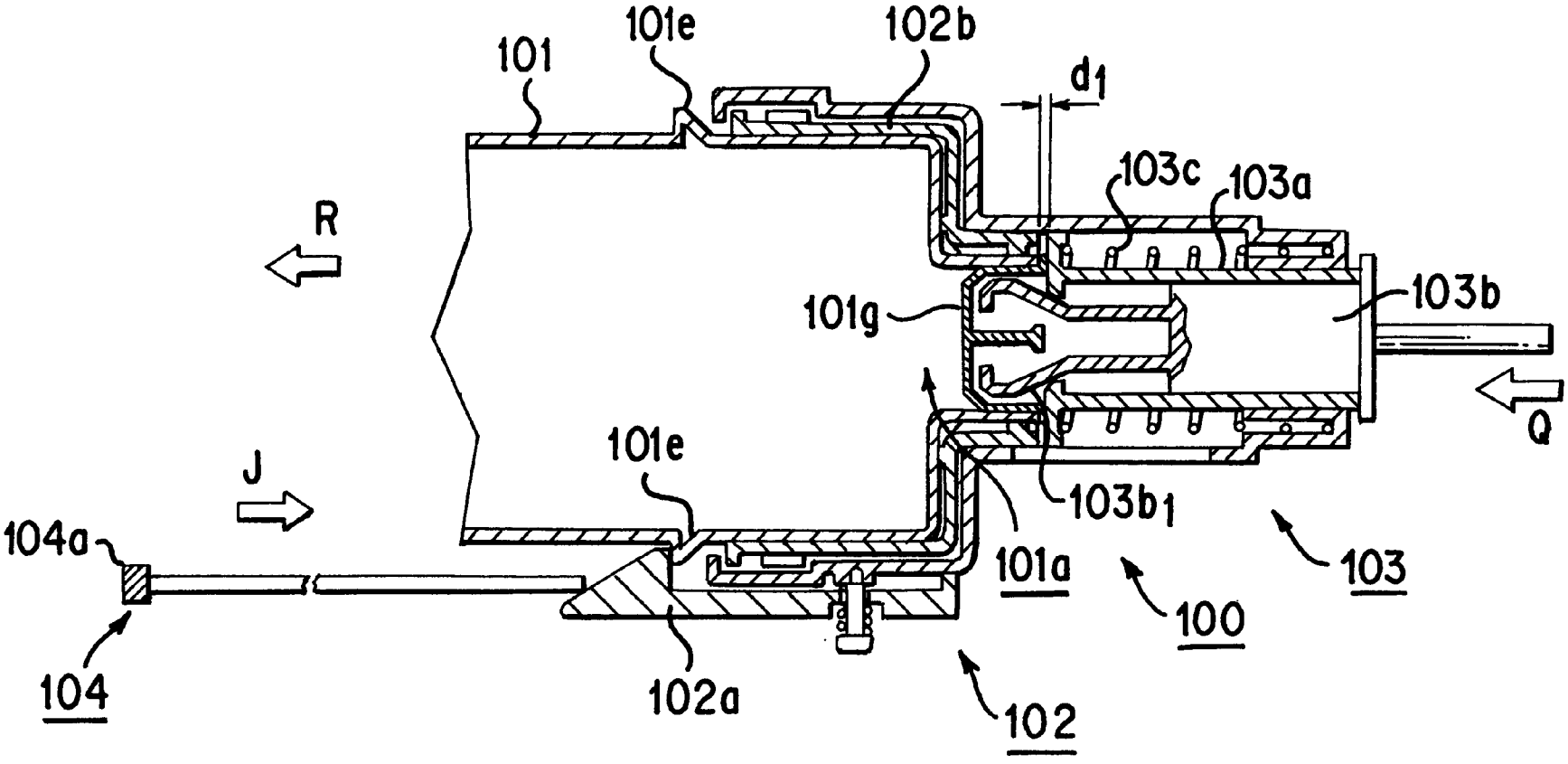
FIG. 69 PRIOR ART

FIG. 59 is a view for explaining the construction of a toner container according to another embodiment of the present invention. The handhold 240 of this embodiment is a small diameter part 240*e* recessed in the axial middle of the toner container body 201. In the toner container body 201, the step between the large diameter circumference (large diameter part 240*f*) and the small diameter part 240*e* is formed into a tapered part 240*g*. Accordingly, the operator can grasp or hold the small diameter part 240*e* of the handhold 240 upon attaching and detaching operations to the toner bank 210. It is therefore possible to provide such a toner container 200 that it can be attached to and detached from the toner bank 210 easily and securely, transported properly, manufactured at low cost because of no need for a projection or new parts, and further, replenished with toner without accumulation of toner stored therein.

A rolling prevention part 240*h* of projection type can also be provided on the outer side of the toner container body 201 of the toner container 200 so as to prevent the toner container 200 from rolling even when left on a plane or a slightly inclined plane.

Obviously, numerous additional modifications and variations of the present invention are possible in light of the above teachings. In particular, features described for certain embodiments may be employed in a logical manner to other embodiments described herein. It is therefore to be understood that within the scope of the appended claims, the present invention may be practiced otherwise than as specifically described herein.

This document is based on Japanese patent applications No. 09-236540 filed in the Japanese Patent Office on Aug. 18, 1997, No. 09-278127 filed on Sep. 25, 1997, and No. 10-036473 filed on Feb. 2, 1998, respectively, and the entire contents of each of which being hereby incorporated by reference.

What is claimed is:

1. A toner supplying device for supplying toner, contained in each of a plurality of toner containers attached to the device, to a developing device of an image forming apparatus, comprising:

a toner container insertion part configured to receive and attach to the plurality of toner containers, and having at least two insertion inlets;

a toner container holder that detachedly holds each of the plurality of toner containers inserted through the insertion inlets so as to position an opening of each of the plurality of toner containers at a predetermined position;

an open/close device configured to open and close the opening of each of the plurality of toner containers held by the toner container holder;

a toner deposit section configured to receive and deposit therein toner discharged from each of the plurality of toner containers held by the toner container holder;

a toner delivery device configured to deliver the toner deposited in the toner deposit section to the developing device of the image forming apparatus by mixing the toner with air; and a toner near-end determining device configured to determine that a dispensing toner container of the plurality of toner containers held by the toner container holder is running low on toner, wherein, when the toner near-end determining device determines that the dispensing toner container is running low on toner, another toner container of the plurality of toner containers is opened so as to discharge toner therefrom.

2. The toner supplying device of claim 1, wherein:

the opening of the dispensing toner container is configured to be closed by a cap when the toner near-end detect device determines that the dispensing toner container is running low on toner.

3. The toner supplying device of claim 2, wherein:

the opening of the dispensing toner container is configured to be closed by the cap a predetermined period of time after the toner near-end determining device determines that the toner is running low, the predetermined period of time being sufficiently long to allow for a discharge of residual toner remaining in the dispensing toner container.

4. The toner supplying device of claim 1, wherein:

the toner near-end determining device comprises a sensor that detects an existence of the toner.

5. The toner supplying device of claim 4, wherein:

the toner near-end determining device is configured to determine that the toner is low when the sensor does not detect the existence of the toner for a predetermined period of time.

6. The toner supplying device of claim 4, wherein:

the sensor is configured to detect a level of the toner being above a predetermined level in the toner deposit section.

7. The toner supplying device of claim 4, wherein:

the sensor is configured to detect a level of the toner above a predetermined level in a toner supplying section of the developing device, which receives the toner conveyed from the toner supplying device and supplies the received toner to the developing device of the image forming apparatus.

8. The toner supplying device of claim 1, wherein:

the toner near-end determining device comprises a weight sensor that detects a weight of each of the plurality of toner containers held by the toner container holder.

9. The toner supplying device of claim 8, wherein:

the toner near-end determining device is configured to determine that the toner is running low when a weight detected by the weight sensor for the discharging toner container is lighter than a predetermined weight.

10. The toner supplying device of claim 1, further comprising:

a housing case that houses at least the plurality of toner containers and the toner container holder;

a release device configured to release each of the plurality of toner containers from being held by the toner container holder; and a toner container discharging device configured to discharge each of the plurality of toner containers from the housing case such that when each of the plurality of toner containers is released by the release device from being held by the toner container holder, such that an end part of each of the plurality of toner containers comes out of the housing case to a position where each of the plurality of toner containers can be grasped.

11. The toner supplying device of claim 10, wherein:

the discharging device includes an engaging part configured to be engaged with an end part of each of the plurality of toner containers, and each of the plurality of toner containers being discharged by actuating the engaging part of the discharging device.

12. The toner supplying device of claim 11, wherein:

the engaging part being elastic.

13. The toner supplying device of claim 11, wherein:

the discharging device comprises at least a portion of the open/close device.

14. The toner supplying device of claim 11, wherein:

the discharging device is configured to cooperate with the open/close device to prevent the open/close device from opening the opening portion of each of the plurality of toner containers when the discharging device discharges each of the plurality of toner containers.

15. A toner container comprising:

a cylindrical body for containing toner therein;

an openable end part having an opening;

another end part of the cylindrical body opposite to the openable end part; and a recessed portion having a smaller diameter than the cylindrical body and being connected to the cylindrical body, wherein said toner container being configured to be disposed in a toner supplying device for supplying toner to a developing device of an image forming apparatus, the toner supplying device including, a toner container insertion part for inserting a plurality of the toner containers into the toner supplying device so as to be attached to the toner supplying device, the insertion part having at least two insertion inlets, a toner container holder for detachably holding each of the plurality of the toner containers inserted through the insertion inlets so as to position an opening of each of the plurality of the toner containers at a predetermined position, an open/close device for opening and closing the opening of each of the plurality of the toner containers held by the toner container holder, a toner deposit section for receiving and depositing therein toner discharged from each of the plurality of the toner containers held by the toner container holder, a toner delivery device for delivering the toner deposited in the toner deposit section to the developing device of the image forming apparatus by mixing the toner with air, and a toner near-end determining device for determining that one of the plurality of the toner containers held by the toner container holder, which is discharging the toner, is running out of toner, and when the toner near-end determining device determines that the one of the plurality of the toner containers, discharging the toner, is running out of toner, an other toner container of the plurality of the toner containers, not discharging the toner, starts to discharge toner therefrom.

16. The toner container of claim 15, wherein:

an inner circumferential surface of the cylindrical body has a smooth slope extending from the other end part opposite to the opening toward the recessed portion.

17. A toner container comprising:

a cylindrical toner container body for containing toner therein;

an openable end part having an opening;

another end part of the cylindrical body opposite to the openable end part; and a handhold provided on the outside surface of another end part, wherein said toner container being configured to be disposed in a toner supplying device for supplying toner to a developing device of an image forming apparatus, the toner supplying device including, a toner container insertion part for inserting a plurality of the toner containers into the toner supplying device so as to be attached to the toner supplying device, the insertion part having at least two insertion inlets, a toner container holder for detachably holding each of the plurality of the toner containers inserted through the insertion inlets so as to position an opening of each of the plurality of the toner containers at a predetermined position, an open/close device for opening and closing the opening of each of the plurality of the toner containers held by the toner container holder, a toner deposit section for receiving and depositing therein toner discharged from each of the plurality of the toner containers held by the toner container holder, a toner delivery device for delivering the toner deposited in the toner deposit section to the developing device of the image forming apparatus by mixing the toner with air, and a toner near-end determining device for determining that one of the plurality of the toner containers held by the toner container holder, which is discharging the toner, is running out of toner, and when the toner near-end determining device determines that the one of the plurality of the toner containers, discharging the toner, is running out of toner, another toner container of the plurality of the toner containers, not discharging the toner, starts to discharge toner therefrom.

18. The toner container of claim 17, wherein:

the handhold being a recessed part formed on the outside surface of the another end part.

19. The toner container of claim 18, wherein:

the recessed part has a rib inside thereof.

20. The toner container of claim 19, further comprising:

another rib.

21. The toner container of claim 17, wherein the handhold is a projected part formed on the outside surface of another end part.

22. The toner container of claim 21, wherein:

the projected part is a rib.

23. The toner container of claim 22, further comprising another rib.

24. The toner container of claim 17, wherein:

the handhold is a knob.

25. The toner container of claim 17, wherein:

a shape and position of the handhold prevent the toner container body from being set longitudinally and remain stable.

26. A toner container comprising:

a cylindrical toner container body for containing toner therein;

an openable end part having an opening;

another end part of the cylindrical toner container body opposite to the openable end part; and a handhold provided on an outer surface of the cylindrical toner container body, wherein said toner container being configured to be disposed in a toner supplying device for supplying toner to a developing device of an image forming apparatus, the toner supplying device including, a toner container insertion part for inserting a plurality of the toner containers into the toner supplying device so as to be attached to the toner supplying device, the insertion part having at least two insertion inlets, a toner container holder for detachably holding each of the plurality of the toner containers inserted through the insertion inlets so as to position the opening of each of the plurality of the toner containers at a predetermined position, an open/close device for opening and closing the opening of each of the plurality of the toner containers held by the toner container holder, a toner deposit section for receiving and depositing therein toner discharged from each of the plurality of the toner containers held by the toner container holder, a toner delivery device for delivering the toner deposited in the toner deposit section to the developing device of the image forming apparatus by mixing the toner with air, a toner near-end determining device for determining that one of the plurality of the toner containers held by the toner container holder, which is discharging the toner, is running out of toner, and when the toner near-end determining device determines that the one of the plurality of the toner containers, discharging the toner, is running out of toner, another toner container of the plurality of the toner containers, not discharging the toner, starts to discharge toner therefrom.

27. The toner container of claim 26, wherein:

the handhold being a recessed part formed on the outer surface of the cylindrical toner container body.

28. The toner container of claim 27, wherein:

the recessed part having a rib inside thereof.

29. The toner container of claim 26, wherein:

the handhold being a projected part that projects from said outer surface of the cylindrical toner container body.

30. The toner container of claim 26, wherein:

the handhold being a knob.

31. The toner container of claim 26, wherein:

the toner container device being configured to be disposed in the toner supplying device where the toner supplying device further includes a detection device for detecting a number of rotations of the handhold when the toner container is rotated so as to obtain information on a number of rotations of the toner container body based on the number of rotations of the handhold.

32. The toner container of claim 26, wherein:

the handhold being a small diameter part, relative to the toner container body, provided around the outer surface of the toner container body.

33. The toner container of claim 32, wherein:

the small diameter part being coupled to a large diameter part of the outer surface of the toner container body through a tapered part.

34. The toner container of claim 17, wherein:

the toner container body includes at least one of a handhold and a rolling prevention part disposed around the outer surface so as to prevent the toner container body from rolling.

35. An image forming apparatus, comprising:

a developing device; and a toner supplying device for supplying toner contained in each of a plurality of toner containers attached to the toner supplying device to the developing device, the toner supplying device having, a toner container insertion part configured to receive and attach the plurality of toner containers to the toner supplying device, the insertion part having at least two insertion inlets;

a toner container holder configured to detachedly hold each of the plurality of toner containers inserted through the insertion inlets so as to position an opening of each of the plurality of toner containers at a predetermined position;

an open/close device configured to open and close the opening of each of the plurality of toner containers held by the toner container holder;

a toner deposit section configured to receive and retain therein toner discharged from each of the plurality of toner containers held by the toner container holder;

a toner delivery device configured to deliver the toner in the toner deposit section to the developing device by mixing the toner with air; and a toner near-end determining device configured to determine that a dispensing toner container of the plurality of toner containers held by the toner container holder, is running out of toner, wherein, when the toner near-end determining device determines that the dispensing toner container is running out of toner, another toner container of the plurality of toner containers, which has not yet had discharged its toner, starts to discharge toner therefrom.

36. The image forming apparatus of claim 35, wherein:

the opening of the dispensing toner container is closed by a cap after the toner near-end detect device determines that the dispensing toner container is running out of toner.

37. The image forming apparatus of claim 35, wherein:

the opening of the discharging toner container being closed by the cap a predetermined period of time after the toner near-end detect device determines that the dispensing toner container is running out of toner, the predetermined period of time being sufficiently long to discharge residual toner remaining in the dispensing toner container.

38. The image forming apparatus of claim 35, wherein:

the toner near-end determining device comprises a sensor that detects existence of the toner.

39. The image forming apparatus of claim 38, wherein:

the toner near-end determining device is configured to determine that the toner is low when the sensor does not detect the existence of the toner for a predetermined period of time.

40. The image forming apparatus of claim 38, wherein:

the sensor is configured to detect a level of the toner being above a predetermined level in the toner deposit section.

41. The image forming apparatus of claim 38, wherein:

the sensor is configured to detect a level of the toner above a predetermined level in a toner supplying section of the developing device, which receives the toner conveyed from the toner supplying device and supplies the received toner to the developing device of the image forming apparatus.

42. The image forming apparatus of claim 35, wherein:

the toner near-end determining device comprises a weight sensor that detects a weight of each of the plurality of toner containers held by the toner container holder.

43. The image forming apparatus of claim 42, wherein:

the toner near-end determining device is configured to determine that the toner is running low when a weight detected by the weight sensor for the discharging toner container is lighter than a predetermined weight.

44. The image forming apparatus of claim 35, further comprising:

a housing case that houses at least the plurality of toner containers and the toner container holder;

a release device configured to release each of the plurality of toner containers from being held by the toner container holder; and a toner container discharging device configured to discharge each of the plurality of toner containers from the housing case such that when each of the plurality of toner containers is released by the release device from being held by the toner container holder, such that an end part of each of the plurality of toner containers comes out of the housing case to a position where each of the plurality of toner containers can be grasped.

45. The image forming apparatus of claim 44, wherein:

the discharging device includes an engaging part configured to be engaged with an end part of each of the plurality of toner containers, and each of the plurality of toner containers being discharged by actuating the engaging part of the discharging device.

46. The image forming apparatus of claim 45, wherein:

the engaging part being elastic.

47. The image forming apparatus of claim 46, wherein:

the discharging device comprises at least a portion of the open/close device.

48. The image forming apparatus of claim 46, wherein:

the discharging device is configured to cooperate with the open/close device to prevent the open/close device from opening the opening portion of each of the plurality of toner containers when the discharging device discharges each of the plurality of toner containers.

49. The image forming apparatus of claim 35, wherein:

each of the plurality of toner containers comprises a cylindrical toner container body that holds the toner therein, another end part closing an end opposite the opening, and a handhold provided on an outside surface of the another end part.

50. The image forming apparatus claim 49, wherein:

the handhold is a recessed part formed on the outside surface of the another end part.

51. The image forming apparatus of claim 50, wherein:

the recessed part has a rib inside thereof.

52. The image forming apparatus of claim 51, further comprising:

another rib.

53. The image forming apparatus of claim 49, wherein:

the handhold is a projected part formed on the outside surface of another end part.

54. The image forming apparatus of claim 53, wherein:

the projected part is a rib.

55. The image forming apparatus of claim 54, further comprising another rib.

56. The image forming apparatus of claim 49, wherein:

the handhold is a knob.

57. The image forming apparatus of claim 49, wherein:

a shape and position of the handhold prevent the toner container body from being set longitudinally and remain stable.

58. The image forming apparatus of claim 35, wherein:

each of the plurality of toner containers includes a cylindrical toner container body that holds toner therein, another end part closing an end opposite the opening, and a handhold provided on an outer surface of the toner container body.

59. The image forming apparatus of claim 58, wherein:

the handhold is a recessed part formed on the outer surface of the toner container body.

60. The image forming apparatus of claim 59, wherein:

the recessed part has a rib inside thereof.

61. The image forming apparatus of claim 58, wherein:

the handhold is a part that projects from said outer surface.

62. The image forming apparatus of claim 58, wherein:

the handhold is a knob.

63. The image forming apparatus of claim 58, wherein:

the toner supplying device further comprises a detection device that detects a number of rotations of the handhold when each of the plurality of toner containers is rotated so as to obtain information on an amount of rotation of the toner container body.

64. The image forming apparatus of claim 58, wherein:

the handhold being a small diameter part provided around the outer surface of the toner container body.

65. The image forming apparatus of claim 64, wherein:

the small diameter part being coupled to a large diameter part of the outer surface of the toner container body through a tapered part.

66. The image forming apparatus of claim 35, wherein:

the toner container body includes at least one of a handhold and a rolling prevention part disposed around the outer surface so as to prevent the toner container body from rolling.

67. A toner container for a toner supplying device for supplying toner to a developing device of an image forming apparatus, comprising:

a cylindrical toner container body that holds toner therein;

a cappable opening formed axially at one end of the toner container for discharging toner therethrough when opened;

another end part of the cylindrical toner container body that closes another end opposite the cappable opening; and a handhold fixed on the outside surface of the another end part;

wherein the toner container being attachable to and detachable from the toner supplying device, and wherein a shape and position of said handhold is configured to prevent said toner container body from being set longitudinally and remain stable, wherein the handhold is a recessed part formed on the outside surface of the another end part, and wherein the recessed part has a rib inside thereof, and further comprising another rib.

68. A toner container for a toner supplying device for supplying toner to a developing device of an image forming apparatus, comprising:

a cylindrical toner container body that holds toner therein;

a cappable opening formed axially at one end of the toner container for discharging toner therethrough when opened;

another end part of the cylindrical toner container body that closes another end opposite the cappable opening; and a handhold fixed on the outside surface of the another end part;

wherein the toner container being attachable to and detachable from the toner supplying device, and wherein a shape and position of said handhold is configured to prevent said toner container body from being set longitudinally and remain stable, wherein the handhold is a projected part formed on the outside surface of the another end part, and wherein the projected part is a rib, and further comprising another rib.

69. A toner container for a toner supplying device for supplying toner to a developing device of an image forming apparatus, comprising:

a cylindrical toner container body that holds toner therein;

a cappable opening formed axially at one end of the toner container for discharging toner therethrough when opened;

another end part of the cylindrical toner container body that closes another end opposite the cappable opening; and a handhold fixed on the outside surface of the another end part;

wherein the toner container being attachable to and detachable from the toner supplying device, and wherein a shape and position of said handhold is configured to prevent said toner container body from being set longitudinally and remain stable, wherein the handhold is a knob.

70. A toner container for a toner supplying device for supplying toner to a developing device of an image forming apparatus, comprising:

a cylindrical toner container body that holds toner therein, said cylindrical toner container body having an outer surface;

a cappable opening formed axially at one end of the toner container for discharging toner;

another end part of the cylindrical toner container body that closes an end opposite the cappable opening for closing the other side of the opening; and a handhold provided on the outer surface of the toner container body, wherein the toner container being attachable to and detachable from the toner supplying device;

wherein said handhold is a knob.

71. The toner container as set forth in claim 70, wherein:

the handhold is a projected part.

72. The toner container of claim 70, wherein:

the toner container body includes at least one of a handhold and a rolling prevention part disposed around the outer surface so as to prevent the toner container body from rolling.

73. A toner supplying device for supplying toner contained in each of a plurality of toner containers attached to the toner supplying device to a developing device of an image forming apparatus, comprising:

a toner container holder for detachably holding each of the plurality of toner containers so as to position an opening of each of the plurality of toner containers at a predetermined position;

an open/close device configured to open and close the opening of each of the plurality of toner containers held by the toner container holder;

a housing case that houses at least the plurality of toner containers and the toner container holder;

a release device configured to release each of the plurality of toner containers from being held by the toner container holder; and a toner container discharging device configured to discharge each of the plurality of toner containers from the housing case such that when each of the plurality of toner containers is released from being held by the toner container holder by the release device, such that an end part of each of the plurality of toner containers comes out of the housing case to a position where each of the plurality of toner containers can be grasped.

74. The toner supplying device of claim 73, wherein:

the discharging device includes an engaging part configured to be engaged with an end part of each of the plurality of toner containers, and each of the plurality of toner containers being discharged by actuating the engaging part of the discharging device.

75. The toner supplying device of claim 74, wherein:

the engaging part being elastic.

76. The toner supplying device of claim 74, wherein:

the discharging device comprises at least a portion of the open/close device.

77. The toner supplying device of claim 74, wherein:

the discharging device is configured to cooperate with the open/close device to prevent the open/close device from opening the opening portion of each of the plurality of toner containers when the discharging device discharges each of the plurality of toner containers.

78. A toner container comprising:

a cylindrical body for containing toner therein, an opening in an end of the cylindrical body, another end part of the cylindrical body opposite to the opening, and closing the other end of the cylindrical body, and a recessed portion having a smaller diameter than the cylindrical body and being connected to the cylindrical body, wherein said toner container being configured to be disposed in a toner supplying device for supplying toner to a developing device of an image forming apparatus, the toner supplying device including, a toner container holder for detachably holding each of the plurality of toner containers so as to position an opening of each of the plurality of toner containers at a predetermined position, an open/close device for opening and closing the opening of each of the plurality of toner containers held by the toner container holder, a housing case for housing at least the plurality of toner containers and the toner container holder, a release device for releasing each of the plurality of toner containers from a state being held by the toner container holder, and a toner container discharging device for discharging each of the plurality of toner containers from the housing case, when each of the plurality of toner containers is released from the state being held by the toner container holder by the release device, such that an end part of each of the plurality of toner containers comes out of the housing case to a position where each of the plurality of toner containers can be grasped.

79. The toner container of claim 78, wherein:

an inner circumferential surface of the cylindrical body has a smooth slope extending from the other end part opposite to the opening toward the recessed portion.

80. An image forming apparatus, comprising:

a developing device; and a toner supplying device configured to supply toner contained in each of a plurality of toner containers attached thereto to the developing device, the toner supplying device including, a toner container holder that detachedly holds each of the plurality of toner containers so as to position an opening of each of the plurality of toner containers at a predetermined position;

an open/close device configured to open and close the opening of each of the plurality of toner containers held by the toner container holder;

a housing case that houses at least the plurality of toner containers and the toner container holder;

a release device that releases each of the plurality of toner containers from a state being held by the toner container holder; and a toner container discharging device configured to discharge each of the plurality of toner containers from the housing case, when each of the plurality of toner containers is released from the state being held by the toner container holder by the release device, such that an end part of each of the plurality of toner containers comes out of the housing case to a position where each of the plurality of toner containers can be grasped.

81. The image forming apparatus of claim 80, wherein:

the discharging device includes an engaging part configured to be engaged with an end part of each of the plurality of toner containers, and each of the plurality of toner containers being discharged by way of the engaging part of the discharging device.

82. The image forming apparatus of claim 81, wherein:

the engaging part being elastic.

83. The image forming apparatus of claim 81, wherein:

the discharging device comprises at least a portion of the open/close device.

84. The image forming apparatus of claim 81, wherein:

the discharging device is configured to cooperate with the open/close device to prevent the open/close device from opening the opening portion of each of the plurality of toner containers when the discharging device discharges each of the plurality of toner containers.

85. The image forming apparatus of claim 80, wherein each of the plurality of toner containers comprises:

a cylindrical body that holds toner therein;

an openable end part;

another end part of the cylindrical body opposite to the openable end part; and a recessed portion having a smaller diameter than the cylindrical body and being connected to the cylindrical body.

86. The image forming apparatus of claim 85, wherein:

an inner circumferential surface of the cylindrical body has a smooth slope extending from the another end part opposite to the opening end part toward the recessed portion.

87. A method of supplying toner to a developing device of an image forming apparatus from a toner supplying device, comprising steps of:

attaching a plurality of toner containers, each containing toner therein, to the toner supplying device;

discharging toner from one of the plurality of toner containers attached to the toner supplying device to a toner deposit section of the toner supplying device;

detecting the toner existing above a predetermined level in the toner deposit section of the toner supplying device;

determining that the one of the plurality of toner containers that is open and discharging toner therefrom is running low toner when a toner level in the toner deposit section is not detected as existing above the predetermined level for a predetermined period of time; and starting a discharging of toner from another toner container of the plurality of toner containers that has not discharged its toner therefrom.

88. A method of supplying toner to a developing device of an image forming apparatus from a toner supplying device, comprising steps of:

attaching a plurality of toner containers, each containing toner therein toner, to the toner supplying device;

discharging toner from one of the plurality of toner containers attached to the toner supplying device to a toner deposit section of the toner supplying device;

detecting the toner existing above a predetermined level in the developing device of the image forming apparatus;

detecting the toner level in the toner deposit section not being above a predetermined level when it is detected that the toner does not exist above the predetermined level in the developing device;

determining that the one of the plurality of toner containers that is open and discharging toner therefrom is running low on toner when a toner level in the toner deposit section is not detected existing the above predetermined level and if toner existing above the predetermined level in the developing device of the image forming apparatus is not detected for a predetermined period of time; and starting discharging of toner from another toner container of the plurality of toner containers that has not discharged its toner therefrom when it is determined that the one of the plurality of toner containers that is open and discharging toner therefrom is running low on toner.

89. A toner container for a toner supplying device for supplying toner to a developing device of an image forming apparatus, comprising:

a cylindrical toner container body that holds toner therein said cylindrical toner container body having an outer surface;

a cappable opening formed axially at one end of the toner container for discharging toner;

another end part of the cylindrical toner container body that closes an end opposite the cappable opening for closing the other side of the opening; and a handhold provided on the outer surface of the toner container body, wherein the toner container being attachable to and detachable from the toner supplying device wherein said toner container is configured to be disposed in the toner supplying device, and wherein the toner supplying device further includes a detection device for detecting a number of rotations of the handhold when the toner container is rotated so as to obtain information on a number of rotations of the toner container body based on the number of rotations of said handhold.

90. A toner container for a toner supplying device for supplying toner to a developing device of an image forming apparatus, comprising:

a cylindrical toner container body that holds toner therein said cylindrical toner container body having an outer surface;

a cappable opening formed axially at one end of the toner container for discharging toner;

another end part of the cylindrical toner container body that closes an end opposite the cappable opening for closing the other side of the opening; and at least one of a handhold and a rolling prevention part disposed around the outer surface, wherein said at least one of a handhold and a rolling prevention part is configured so as to prevent the toner container body from rolling;

wherein said toner container is attachable to and detachable from the toner supplying device.

91. A toner container for a toner supplying device for supplying toner to a developing device of an image forming apparatus, comprising:

a cylindrical toner container body that holds toner therein;

a cappable opening formed axially at one end of the toner container for discharging toner therethrough when opened;

another end part of the cylindrical toner container body that closes another end opposite the cappable opening; and a handhold fixed on the outside surface of the another end part;

wherein the toner container being attached to and detachable from the toner supplying device, and wherein a shape and position of said handhold is configured to prevent said toner container body from being set longitudinally and remain stable, wherein said handhold further comprises a conical outer surface.

92. The toner container of claim 91, wherein said handhold does not include an outer surface which is flat, perpendicular to a longitudinal axis of said cylindrical toner container body, and which faces a direction away from said cylindrical toner container body.

* * * * *

UNITED STATES PATENT AND TRADEMARK OFFICE

CERTIFICATE OF CORRECTION

PATENT NO. : 6,097,903

DATED : August 1, 2000

INVENTOR(S): Masasumi YAHATA et al.

It is certified that an error appears in the above-identified patent and that said Letters Patent is hereby corrected as shown below:

On the title page, item [75], the 3rd Inventor's name is misspelled. The Inventors should read as follows:

--[75] Inventors: Masasumi Yahata, Kamakura; Shunji Katoh, Sagamihara; Yuji Kitajima, Kawasaki, all of Japan--

On the title page, item [30], is incorrectly listed. The Foreign Application Priority Data should be:

--[30] Foreign Application Priority Data

| | | | |
|---|---|---|---|
| Aug. 18, 1997 | [JP] | Japan | 9-236540 |
| Sep. 25, 1997 | [JP] | Japan | 9-278127 |
| Feb. 2, 1998 | [JP] | Japan | 10-035473-- |

Signed and Sealed this

Seventeenth Day of April, 2001

*Attest:*

Nicholas P. Godici

NICHOLAS P. GODICI

*Attesting Officer*

*Acting Director of the United States Patent and Trademark Office*